US009128398B2

(12) United States Patent
Nagayama et al.

(10) Patent No.: US 9,128,398 B2
(45) Date of Patent: Sep. 8, 2015

(54) TONER FOR FORMING ELECTROPHOTOGRAPHIC IMAGE, METHOD FOR MANUFACTURING TONER FOR FORMING ELECTROPHOTOGRAPHIC IMAGE, IMAGE FORMING METHOD, AND PROCESS CARTRIDGE

(75) Inventors: Masashi Nagayama, Shizuoka (JP); Mitsuo Aoki, Shizuoka (JP); Hisashi Nakajima, Shizuoka (JP); Saori Yamada, Shizuoka (JP); Mariko Takii, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/617,957

(22) Filed: Sep. 14, 2012

(65) Prior Publication Data

US 2013/0252160 A1 Sep. 26, 2013

(30) Foreign Application Priority Data

Sep. 15, 2011 (JP) ..... 2011-201954
Sep. 11, 2012 (JP) ..... 2012-199607

(51) Int. Cl.
*G03G 9/087* (2006.01)
*G03G 15/08* (2006.01)
(Continued)

(52) U.S. Cl.
CPC ..... *G03G 9/08755* (2013.01); *G03G 9/081* (2013.01); *G03G 9/0819* (2013.01);
(Continued)

(58) Field of Classification Search
CPC ..... G03G 9/08711; G03G 9/08755; G03G 9/08795; G03G 9/08797
USPC ..... 430/109.3, 109.4
See application file for complete search history.

(56) References Cited

U.S. PATENT DOCUMENTS 5,219,697 A 6/1993 Mori et al.
6,335,137 B1 1/2002 Suzuki et al.
(Continued)

FOREIGN PATENT DOCUMENTS

CN 102190871 9/2011
CN 103048897 4/2013
(Continued)

OTHER PUBLICATIONS

Partial machine English language translation of JP 2008-310280, Dec. 25, 2008.*
(Continued)

*Primary Examiner* — Hoa V Le
(74) *Attorney, Agent, or Firm* — Oblon, McClelland, Maier & Neustadt, L.L.P.

(57) ABSTRACT

A toner for forming an electrophotographic image is provided, wherein the toner includes at least four types of binder resins, wherein the binder resins includes at least:
a crystalline polyester resin (A);
a non-crystalline resin (B);
a non-crystalline resin (C); and
a composite resin (D) which includes a condensation polymerization resin unit and an addition polymerization resin unit,
wherein the non-crystalline resin (B) includes a chloroform insoluble matter,
wherein the non-crystalline resin (C) has a softening temperature (T½) lower than that of the non-crystalline resin (B) by 25° C. or more, and
wherein the toner has a main peak between 1,000 to 10,000 in a molecular weight distribution obtained by GPC from a tetrahydrofuran soluble matter, and the toner has a half-value width of the molecular weight distribution of 15,000 or less.

20 Claims, 14 Drawing Sheets

(51) Int. Cl.
*G03G 9/08* (2006.01)
*G03G 9/097* (2006.01)

(52) U.S. Cl.
CPC ..... *G03G9/08722* (2013.01); *G03G 9/08726* (2013.01); *G03G 9/08728* (2013.01); *G03G 9/08737* (2013.01); *G03G 9/08766* (2013.01); *G03G 9/08782* (2013.01); *G03G 9/08788* (2013.01); *G03G 9/08795* (2013.01); *G03G 9/08797* (2013.01); *G03G 9/0975* (2013.01); *G03G 15/0889* (2013.01)

(56) References Cited

U.S. PATENT DOCUMENTS

| | | | | |
|---|---|---|---|---|
| 9,005,862 | B2 | 4/2015 | Nagayama et al. | |
| 2001/0018157 | A1 | 8/2001 | Aoki et al. | |
| 2005/0287465 | A1 | 12/2005 | Ohshima et al. | |
| 2008/0102393 | A1* | 5/2008 | Hasegawa | 430/109.3 |
| 2009/0074450 | A1 | 3/2009 | Nagayama et al. | |
| 2009/0123857 | A1 | 5/2009 | Shu et al. | |
| 2010/0068644 | A1 | 3/2010 | Nakajima et al. | |
| 2010/0136471 | A1 | 6/2010 | Yamada et al. | |
| 2011/0165508 | A1* | 7/2011 | Nakayama et al. | 430/109.4 |
| 2011/0170915 | A1 | 7/2011 | Aoki et al. | |
| 2011/0217646 | A1 | 9/2011 | Shirai et al. | |
| 2011/0294062 | A1* | 12/2011 | Eida et al. | 430/109.3 |
| 2012/0082926 | A1 | 4/2012 | Suzuki et al. | |
| 2012/0237868 | A1 | 9/2012 | Yamada et al. | |
| 2012/0251168 | A1 | 10/2012 | Nagayama et al. | |
| 2013/0244162 | A1 | 9/2013 | Yamada et al. | |
| 2013/0252160 | A1 | 9/2013 | Nagayama et al. | |
| 2013/0260302 | A1 | 10/2013 | Nakajima et al. | |
| 2013/0260307 | A1 | 10/2013 | Nagayama et al. | |

FOREIGN PATENT DOCUMENTS

| | | |
|---|---|---|
| JP | 60-090344 | 5/1985 |
| JP | 62-063940 | 3/1987 |
| JP | 64-015755 | 1/1989 |
| JP | 2-082267 | 3/1990 |
| JP | 3-041470 | 2/1991 |
| JP | 3-229264 | 10/1991 |
| JP | 2931899 | 5/1999 |
| JP | 11-167260 | 6/1999 |
| JP | 11-305486 | 11/1999 |
| JP | 2000-242039 | 9/2000 |
| JP | 3127594 | 11/2000 |
| JP | 2001-222138 | 8/2001 |
| JP | 2002-082484 | 3/2002 |
| JP | 2002-162785 | 6/2002 |
| JP | 2002-287399 | 10/2002 |
| JP | 2003-029462 | 1/2003 |
| JP | 2004-046095 | 2/2004 |
| JP | 2004-053995 | 2/2004 |
| JP | 2005-338814 | 12/2005 |
| JP | 2006-011079 | 1/2006 |
| JP | 2007-033773 | 2/2007 |
| JP | 2008-102390 | 5/2008 |
| JP | 2008-116580 | 5/2008 |
| JP | 4118498 | 5/2008 |
| JP | 2008-310280 | 12/2008 |
| JP | 2012-078423 | 4/2012 |

OTHER PUBLICATIONS

U.S. Appl. No. 13/416,451, filed Mar. 9, 2012, Nagayama, et al.

* cited by examiner

TONER FOR FORMING ELECTROPHOTOGRAPHIC IMAGE, METHOD FOR MANUFACTURING TONER FOR FORMING ELECTROPHOTOGRAPHIC IMAGE, IMAGE FORMING METHOD, AND PROCESS CARTRIDGE

BACKGROUND OF THE INVENTION

1. Field of the Invention

The present invention relates to a toner for forming an electrophotographic image (which may also be referred to simply as "toner", hereinafter), a method for manufacturing a toner for forming an electrophotographic image, an image forming method and a process cartridge.

2. Description of the Related Art

Recently, low-temperature fixing of a toner is desired in electrophotography. This is not only for energy saving to reduce energy required for fixing but also for demands to increase speed and image quality of an electrophotographic image forming apparatus.

In general, image quality decreases for a faster electrophotographic image forming apparatus. This involves various factors, and the most influential factor is an effect of deficient fixing in a fixing step.

In a fixing step, an unfixed toner image on a recording medium typified by paper becomes a fixed image by being fused on the recording medium due to heat and pressure. However, as system speed increases, the unfixed toner cannot obtain sufficient amount of heat in the fixing process. As a result, deficient fixing such as rough surface of the final toner image or image sticking effect called cold offset occurs, and it may become a defect image. Thus, when the system speed is increased, increasing the fixing temperature may be taken into consideration in order to maintain image quality. However, increasing the fixing temperature is not necessarily the best measure in view of side effects of the temperature which leaks from a fixing member on other processes in the image forming apparatus or acceleration of wearing speed of the fixing member.

Thus, improvement of fixing performance of a toner itself is desired in a high-speed image forming apparatus. Specifically, a toner which has sufficient fixing property at a lower temperature in a fixing step is desired.

Conventionally, various studies have been conducted to improve toner fixing property. For example, a method to control thermal characteristics of a resin itself typified by glass transition temperature (Tg) and softening temperature (T½) is heretofore known to improve the fixing performance of a toner. However, lowering the glass transition temperature (Tg) of a resin may degrade heat-resistant storage stability, and lowering the softening temperature (T½) by reducing the molecular weight of the resin, for example, causes problems such as hot offset. Thus, by controlling merely the thermal characteristics of the toner itself, a favorable toner with favorable low-temperature fixing property, heat-resistant storage stability and hot-offset resistance has not been obtained yet.

In order to respond to low-temperature fixing, use of a polyester resin which has superior low-temperature fixing property and relatively favorable heat-resistant storage stability has been tried in place of a styrene-acrylic resin which has been conventionally used heavily (for example, Japanese Patent Application Laid-Open (JP-A) Nos. 60-90344, 64-15755, 02-82267, 03-229264, 03-41470 and 11-305486 are referred to). Also, addition of a particular non-olefin crystalline polymer in a resin, where the polymer has a sharp-melting property at a glass transition temperature of the resin, has been tried in order to improve the low-temperature fixing property (JP-A No. 62-63940). However, it is not necessarily optimizing molecular structure or molecular weight.

Also, a technology to improve fixing property by employing a crystalline polyester which has a sharp-melting property similarly to the particular non-olefin crystalline polymer has been proposed (Japanese Patent (JP-B) No. 2931899 and JP-A No. 2001-222138). However, a toner which uses the crystalline polyester described in JP-B No. 2931899 has a low acid value and hydroxyl value of 5 or less and 20 or less, respectively, and thus it does not have sufficient low-temperature fixing property since the affinity between paper and the crystalline polyester is low.

Regarding a toner which uses the crystalline polymer described in JP-A No. 2001-222138, a molecular weight or existing condition of the crystalline polyester is not optimized in the toner as a final product. Thus, the toner which uses the crystalline polymer described in JP-A No. 2001-222138 does not necessarily and sufficiently provide superior low-temperature fixing property and heat-resistant storage stability which comes from the crystalline polyester after production of the toner. Also, no countermeasure has been taken with respect to hot-offset resistance, and a temperature range for fixing favorable image is not necessarily ensured.

Also, a technology to form a sea-island phase-separation structure of a crystalline polyester and a non-crystalline polyester, which are incompatible with each other, has been proposed (JP-A No. 2004-46095). However, a toner of this proposal uses three types of resins including a crystalline polyester resin, and in order to maintain the sea-island structure of the crystalline polyester resin in this technology, dispersion diameter of the crystalline polyester resin becomes too large. This interferes with heat-resistant storage stability, or transfer failure occurs in transferring because electrical resistance is too low. As a result, a finally obtained image may become rough.

Also, JP-A No. 2007-33773 proposes a technology to control an existing state of a crystalline polyester resin by defining an amount of an endothermic peak appearing at a heat absorption side in a DSC curve measured by a differential scanning calorimeter so as to exert a significant effect of the crystalline polyester resin and to provide a toner with a low-temperature fixing property and heat-resistant storage stability. However, this proposal assumes to use a resin having a relatively high softening temperature as a non-crystalline polyester resin used in combination with the crystalline polyester resin, and thus the crystalline polyester resin bears a role of low-temperature fixing property. Therefore, an amount of the crystalline polyester resin used increases inevitably, and a risk of degraded heat-resistant storage stability increases due to miscibility with the non-crystalline resin.

Also, JP-A No. 2005-338814 proposes a technology that a toner includes a large amount of crystalline polyester resin. However, this proposal has a problem that heat-resistant storage stability degrades due to miscibility with a non-crystalline resin because the content of the crystalline polyester resin is very large.

Also, JP-B No. 4118498 proposes a technology to define a peak and a half-value width of a molecular weight distribution of a toner and an amount of chloroform insoluble matter or to use two or more types of resins having different softening temperatures as a binder resin. In this proposal, however, a crystalline polyester resin is not used, and low-temperature fixing property is insufficient compared to a toner with a crystalline polyester resin.

Conventionally, as a developing apparatus using a two-component developer including a toner and a magnetic carrier, an apparatus having a structure illustrated in FIG. 1 has been know. In the developing apparatus 4 illustrated in FIG. 1, a path to supply a developer to a developing roller 5 as a developer bearing member and a path to stir the developer are separately arranged, and the developer is circulated by conveying it in the two paths in opposite directions.

In the developing apparatus 4 illustrated in FIG. 1, the path to supply the developer to the developing roller 5 and a path to collect the developer which has been supplied to the developing roller 5 and passed the developing region are in common. Thus, there is a problem that the developer which has been supplied to the developing roller 5 has a lower toner concentration at a more downstream side in a conveying direction of the path which supplies the developer to the developing roller 5. When the developer supplied to the developing roller 5 has a decreased toner concentration, an image density in development decreases as well. In FIGS. 1, 10, 11, 401 and 403 represent a stirring path, a mixing auger, a mixing auger and a partition wall, respectively.

JP-B No. 3127594 and JP-A No. 11-167260 propose a developing apparatus as a solution to such a problem, where an auger for supplying a developer to a developing roller and an auger for collecting a developer after development are arranged in separate developer paths. Hereinafter, structures of the developing apparatuses described in JP-B No. 3127594 and JP-A No. 11-167260, respectively, are explained.

FIG. 2 illustrates a developing apparatus described in JP-B No. 3127594.

In a developing apparatus 4 illustrated in FIG. 2, a supplying path 9 for supplying a developer to a developing roller 5 and a collecting path 7 for collecting the developer which has passed a developing region are separately arranged. In FIG. 2, 1 represents a photoconductor; 6, 8 and 209 represent a mixing auger; 16 represents a developer regulating member; and 403 represents a partition wall.

In the developing apparatus 4, the developer having passed through the developing region is not mixed into the supplying path 9 because it is sent to the collecting path 7. By this, the toner concentration of the developer in the supplying path 9 does not vary, and the developer supplied to the developing roller 5 remains constant.

However, even though a toner is replenished for an appropriate toner concentration, the developer is not sufficiently stirred because the developer sent to the collecting path 7 is immediately supplied to the supplying path. Thus, there is a problem of an uneven image density or density decrease in development. Such problems are more prominent for an image having a high printing rate because the toner concentration of the collected developer decreases.

Next, a developing apparatus described in JP-A No. 11-167260 is illustrated in FIG. 3.

A developing apparatus illustrated in FIG. 3, a supplying path 9 for supplying a developer to a developing roller 5 and a collecting path 7 for collecting the developer which has passed a developing region are separately arranged. Further, it is equipped with a stirring path 10 which stirs the developer conveyed to the most downstream side of the supplying path 9 and a collected developer conveyed to the most downstream side of the collecting path 7 and conveys the developer in a direction opposite to the supplying path 9.

In the developing apparatus 4, the developer having passed through the developing region is not mixed into the supplying path 9 because it is sent to the collecting path 7. By this, the toner concentration of the developer in the supplying path 9 does not vary, and the developer supplied to the developing roller 5 remains constant. In FIGS. 3, 6, 8 and 11 represent mixing augers, respectively; 16 represents a developer regulating member; and 404 and 405 represent partition walls respectively.

Further, it does not supply the collected developer immediately to the supplying path 9; rather, it supplies the developer to the supplying path 9 after stirring it in the stirring path 10. Thus, it is possible to supply the developer again to the supplying path in a condition that the developer having passed through the supplying path 9 without being used in development and the collected developer are stirred. Accordingly, a technique to prevent uneven image density and decrease in image density in development, which was the problem of the developing apparatus explained with FIG. 2 is demonstrated.

However, the technologies described in JP-B No. 3127594 and JP-A No. 11-167260 aim at stabilizing the concentration of an output image, and they do not aim at improving overall quality of a system for forming an electrophotographic image forming system such as low-temperature fixing property, hot-offset resistance and a storage stability of a toner.

SUMMARY OF THE INVENTION

The present invention is aimed at providing a toner for forming an electrophotographic image, an image forming method and a process cartridge which support exceptional low-temperature fixing property, high hot-offset resistance and favorable storage stability and which are able to form a high-quality image for a long period of time.

The means for solving the above problems are as follows. That is:

A toner for forming an electrophotographic image of the present invention includes at least four types of binder resins, wherein the binder resins includes at least:

a crystalline polyester resin (A);

a non-crystalline resin (B);

a non-crystalline resin (C); and a composite resin (D) which includes a condensation polymerization resin unit and an addition polymerization resin unit, wherein the non-crystalline resin (B) includes a chloroform insoluble matter, wherein the non-crystalline resin (C) has a softening temperature (T½) lower than that of the non-crystalline resin (B) by 25° C. or more, and wherein the toner has a main peak between 1,000 to 10,000 in a molecular weight distribution obtained by GPC from a tetrahydrofuran soluble matter, and the toner has a half-value width of the molecular weight distribution of 15,000 or less.

The present invention can provide a toner for forming an electrophotographic image, an image forming method and a process cartridge which support exceptional low-temperature fixing property, high hot-offset resistance and favorable storage stability and which are able to form a high-quality image for a long period of time.

DETAILED DESCRIPTION OF THE INVENTION

Figure 1:
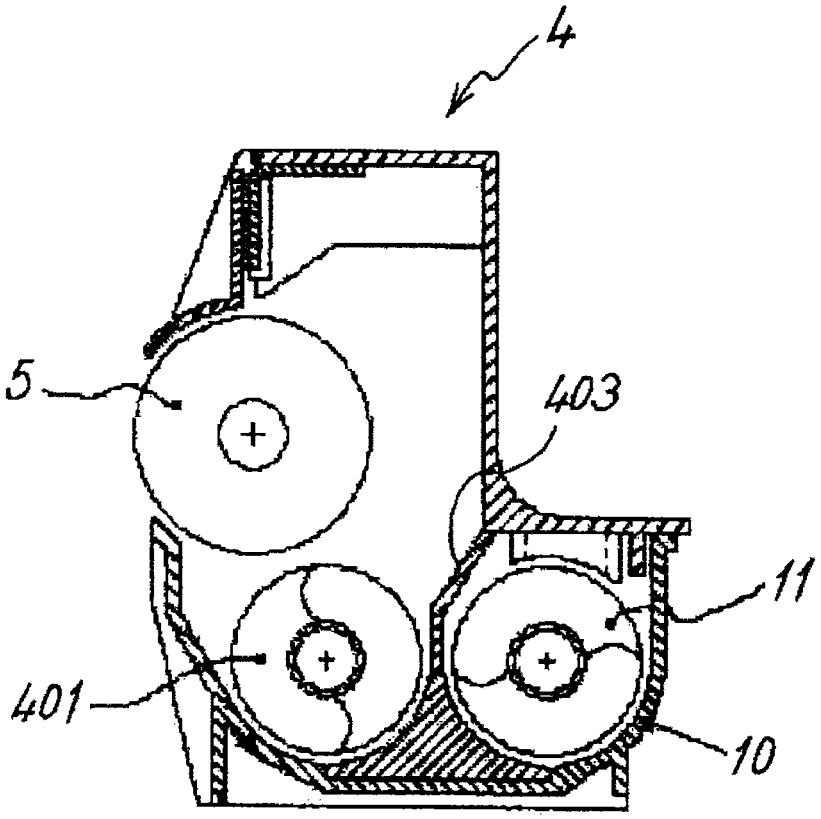
FIG. 1 is a diagram illustrating one example of a conventional two-component developing apparatus where a developer supplying path and a developer recovery path are in common.
Figure 2:
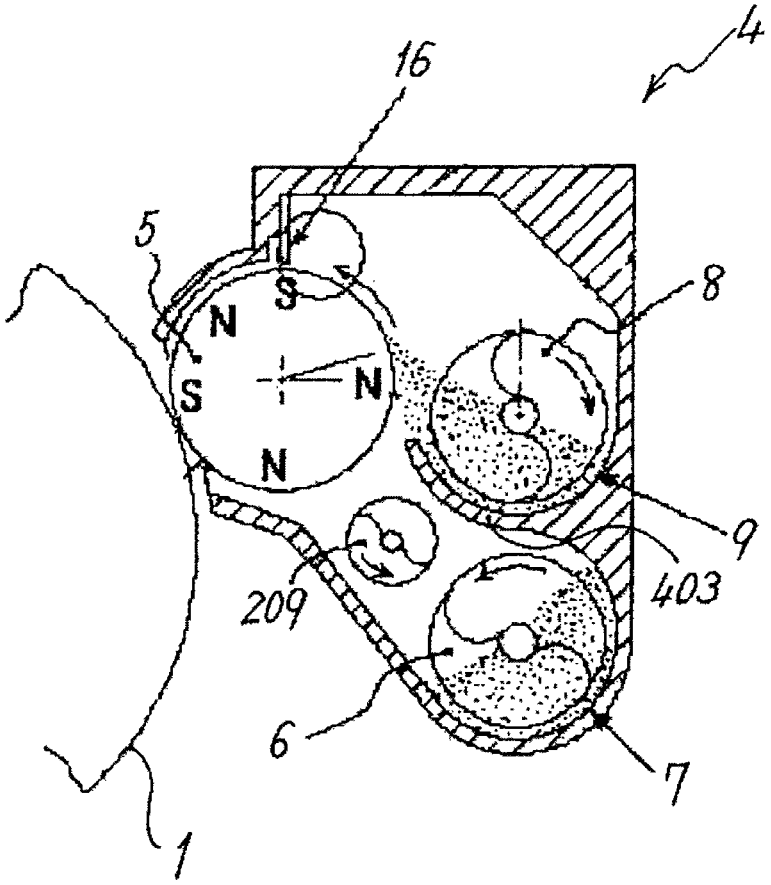
FIG. 2 is a diagram illustrating one example of a conventional two-component developing apparatus having a developer path provided with a first agitating chamber including an auger for supplying a developer and a second agitating chamber including an auger for collecting the developer.
Figure 3:
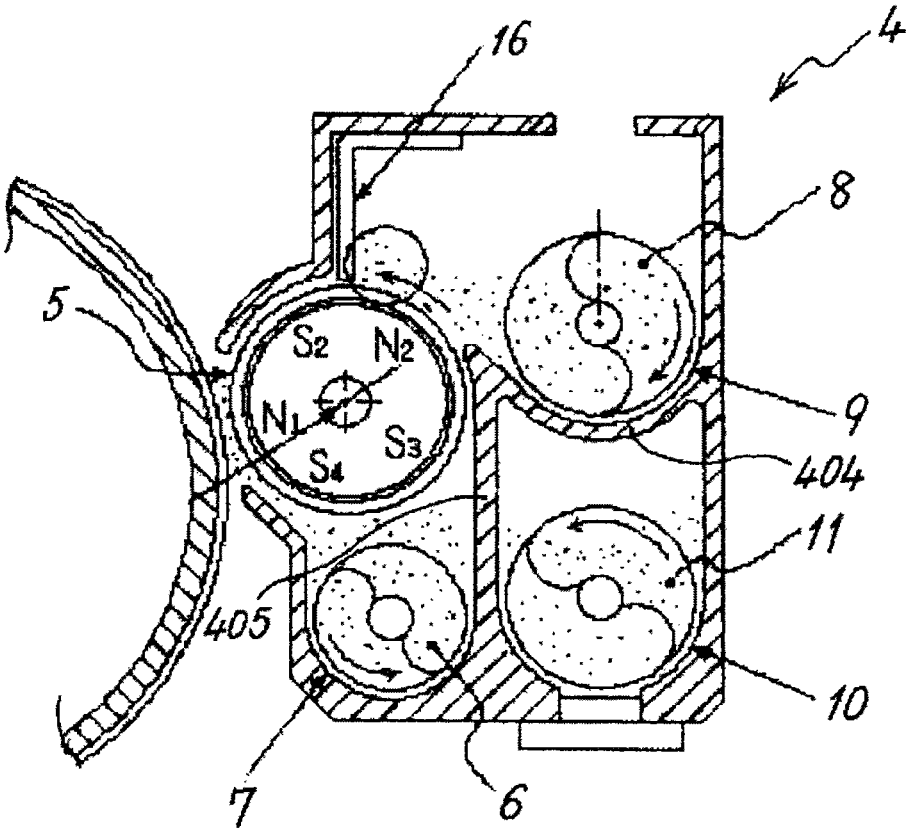
FIG. 3 is a diagram showing another example of a conventional two-component developing apparatus equipped with a stirring path which stirs a developer conveyed to the most downstream side of a developer supplying path and a collected developer conveyed to the most downstream side of the developer collecting path, which is different from the developer supplying path, and conveys the developer in a direction opposite to the developer supplying path.

Hereinafter, the present invention is explained in detail.

(Toner for Forming Electrophotographic Image)

A toner for forming an electrophotographic image of the present invention includes at least four types of binder resins, preferably includes a colorant, a charge controlling agent, a releasing agent and a fatty acid amide compound, and further includes other components according to necessity.

The binder resins include at least: a crystalline polyester resin (A); a non-crystalline resin (B); a non-crystalline resin (C); and a composite resin (D).

Recently, low-temperature fixing of a toner is desired in electrophotography. This is not only for energy saving to reduce energy required for fixing but also for demands to increase the speed and image quality of an electrophotographic image forming apparatus. Combined with diversified intended use of an electrophotographic image forming apparatus, the demand has increased.

A softening temperature (T½) of a toner is simply reduced to reduce a fixing temperature of the toner. However, a glass transition temperature of the toner decreases as the softening temperature is reduced, which degrades heat-resistant storage stability. It also degrades hot-offset resistance because an upper limit of the fixing temperature (upper-limit fixing temperature) is reduced along with decrease of the lower limit of the fixing temperature (lower-limit fixing temperature) at which no problem occurs in terms of image quality, and it also harms hot-offset resistance. Thus, it has been a very difficult proposition for those who design a toner for forming an electrophotographic image to ensure the compatibility of low-temperature fixing property, heat-resistant storage stability and hot-offset resistance.

The present inventors earnestly examined the proposition. As a result, they have found the following technical concepts and achieved the solution of the problems.

A crystalline polyester resin (A) used in a binder resin of a toner for forming an electrophotographic image is able to provide the toner with low-temperature fixing property and heat-resistant storage stability because of its sharp-melting property.

However, hot-offset resistance largely degrades when the crystalline polyester resin alone is used as the binder resin, and the toner obtained thereby is not practically usable because of an extremely narrow fixing temperature range.

Thus, the present inventors considered that a non-crystalline resin (B) which includes a chloroform insoluble matter is used in addition to the crystalline polyester resin (A) to improve hot-offset resistance and widen the fixing temperature range.

However, for a toner including only the crystalline polyester resin (A) and the non-crystalline resin (B), low-temperature fixing property recedes if the non-crystalline resin (B) is in excess. On the other hand, if the crystalline polyester resin (A) is in excess, heat-resistant storage stability extremely degrades because the crystalline polyester resin (A) becomes compatible with components other than chloroform insoluble matter of the non-crystalline resin (B) in melt-kneading of a manufacturing process, which significantly decreases the glass transition temperature of the non-crystalline resin (B). As a result of intensive research by the present inventors by varying the compositions of the crystalline polyester resin (A) and the non-crystalline resin (B), no mixing ratio was found to exist which makes these shortcomings to an acceptable level requested for electrophotography of recent years.

Thus, as a result of further examination, a non-crystalline resin (C) having a softening temperature (T½) lower by 25° C. or more than that of the non-crystalline resin (B) is further combined; the composition of the crystalline polyester resin (A) is reduced to suppress compatibility, and the non-crystalline resin (C) supports the low-temperature fixing property of the crystalline polyester resin (A) while it does not inhibit the hot-offset resistance of the non-crystalline resin (B).

Still, a risk to heat-resistant storage stability does not completely disappear. Even though incompatibility of the crystalline polyester resin (A) is suppressed and decrease of the glass transition temperature of the binder resin is suppressed, an interface between the crystalline polyester resin (A) and the binder resin tends to become a pulverization interface in pulverizing if the crystalline polyester resin (A) exists with its dispersion diameter remaining large. As a result, the crystalline polyester resin (A) tends to appear on a toner surface. The crystalline polyester resin (A) is a sharp-melting material, and it exhibits excellent heat-resistant storage stability as described above when it exists inside toner particles. However, it slightly melts even at a temperature below the glass transition temperature, and the slightly melt crystalline polyester resin (A) acts as a binder between toner particles when it exists on a surface of the toner particles. As a result, it degrades heat-resistant storage stability of the toner. This phenomenon is particularly pronounced in a crystalline polyester resin having a low degree of crystallization.

Also, in view of electrical characteristics, a problem occurs with a toner formulated with the crystalline polyester resin (A), the non-crystalline resin (B) and the non-crystalline resin (C). Because the crystalline polyester resin (A) has a relatively low electrical resistance, the toner tends to have a low electrical resistance if the crystalline polyester resin (A) exists with its dispersion diameter remaining large. When the electrical resistance decreases and exceeds its allowable range, it causes poor image transfer in transferring during image formation. In particular, when the compatibility of the crystalline polyester resin (A) is suppressed for the purpose of maintaining low-temperature fixing property as described above, the crystalline polyester resin tends to maintain its large dispersion diameter. As a result, the electrical characteristics of the crystalline polyester resin (A) are likely to be dominant in the toner, and the electrical resistance tends to decrease.

Also, when a resistance adjusting agent is included, the resistance adjusting agent exists in the non-crystalline resin (B) and the non-crystalline resin (C) in a relatively high concentration since it cannot penetrate into a domain configured by the crystalline polyester resin (A). Thus, it tends to be trapped in the toner as an aggregate, and the resistance tends to reduce excessively. The problem may be resolved by adjusting the amount of the resistance adjusting agent if it is used only for the purpose of decreasing the resistance. However, if the resistance adjusting agent is also a colorant, an example thereof being carbon black, it is not necessarily possible to reduce the amount in view of coloring strength, and it cannot be adjusted to appropriate electrical resistance.

The present inventors repeated intensive studies to solve these technical issues. As a result, they have found that concerns of reduced heat-resistant storage stability and reduced electrical resistance which develop characteristically in a formulation of the crystalline polyester resin (A), the non-crystalline resin (B) and the non-crystalline resin (C) may be resolved simultaneously by formulating a composite resin (D) including a condensation polymerization resin unit and an addition polymerization resin unit to the formulation of the crystalline polyester resin (A), the non-crystalline resin (B) and the non-crystalline resin (C).

It has been known conventionally that an addition of the composite resin (D) improves dispersion of a releasing agent. In the formulation of the crystalline polyester resin (A), the non-crystalline resin (B) and the non-crystalline resin (C), dispersion of the crystalline polyester resin (A) also improves, and it is possible to have it present in the toner in a state of fine dispersion while retaining its crystallinity. In particular, shear force cannot be very well applied to a raw material including the non-crystalline resin (C) when it is subjected to melt-kneading because the viscosity of the non-crystalline resin (C) significantly decreases, and thus the dispersion diameter of the crystalline polyester resin (A) tends to be larger. On the other hand, when a raw material of the crystalline (A) and the non-crystalline resin (C) in addition to the composite resin (D) is subjected to melt-kneading, appropriate shear force is applied to the raw material, and fine dispersion of the crystalline polyester resin (A) is promoted. When it is finely dispersed, the crystalline polyester resin (A) appears on a toner surface less frequently during pulverization, and the heat-resistant storage stability dramatically improves. Also, it is possible to maintain appropriate electrical resistance because the crystalline polyester resin (A) is finely dispersed.

Further, the composite resin (D) tends to be an interface during pulverization since it is harder than the non-crystalline resin (D) having a peak in a region of relatively low molecular weight of a molecular weight distribution. Thus, it tends to be present relatively on the toner surface and effectively suppresses the non-crystalline resin (C) having a low softening temperature appearing on the toner surface, which contributes to improved heat-resistant storage stability.

In addition, since hardness of the toner surface may be enhanced, toner degradation is minimal when the toner is physically stressed. In particular, since embedding of an external additive is improved, variation in charging characteristics is reduced before and after stress is applied. Accordingly, it is possible to provide stable image quality over a long period of time.

However, even though a combination of the crystalline polyester resin (A), the non-crystalline resin (B), the non-crystalline resin (C) and the composite resin (D) is used, there are cases where advantages coming from thermal properties of the raw material resins are not exhibited. This is mainly because of change in the molecular weight due to breakage of molecular chains in the resins during melt-kneading. In particular, the molecular weight distribution of the toner as a whole becomes broad when a chain of a chloroform insoluble matter included in the non-crystalline resin (B) is broken. This negatively affects the thermal properties coming from the non-crystalline resin (C), and low-temperature fixing property is impaired.

The present inventors have found the following as a result of intensive research. As described hereinafter, for example, by melt-kneading raw material resins over a moderate temperature to optimize shear force on the raw material resins and to re-crystallize the crystalline polyester resin (A) in a cooling step, an obtained toner has a main peak between 1,000 and 10,000 in a molecular weight distribution obtained by GPC based on tetrahydrofuran (THF) soluble matter and a half-value width of the molecular weight distribution of 15,000 or less. Such a toner has a large absolute amount of low molecular-weight content and a sharp molecular weight distribution, and it may provide excellent low-temperature fixing property, heat-resistant storage stability and hot-offset resistance, while utilizing the characteristics of the crystalline polyester resin (A), the non-crystalline resin (B), the non-crystalline resin (C) and the composite resin (D), respectively.

The molecular weight distribution and the half-value width of the toner are measured using GPC (Gel-Permeation Chromatography) as follows.

A column is stabilized in a heat chamber at 40° C., and tetrahydrofuran (THF) is flown as a solvent in the column at this temperature at a flow rate of 1 mL/min. Measurement is made by injecting 50 μL to 200 μL of a THF sample solution of a resin with its sample concentration adjusted to 0.05% by mass to 0.6% by mass A molecular weight of a sample (toner) is measured by calculating a molecular weight of the sample from a relation between logarithmic values and the number of counts of a calibration curve prepared using several monodispersed polystyrene standard samples.

As the standard polystyrene samples for the calibration curve, using samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ or $4.48\times10^6$, for example, manufactured by Pressure Chemical Co. or Tosoh Corporation, it is appropriate to use at least 10 standard polystyrene samples. As a detector, an RI (Refractive Index) detector is used.

The softening temperature (T½) of a resin is measured using an elevated flow tester CFT-500 (manufactured by Shimadzu Corporation) based on a temperature corresponding to ½ of the temperatures from a flow start point to a flow end point when a sample of 1 $cm^2$ is melt and flown under conditions of a die hole diameter of 1 mm; an applied pressure of 20 $kg/cm^2$ and a temperature rise of 6° C./min.

An amount of the crystalline polyester resin (A) in the toner is preferably 1% by mass to 15% by mass, and more preferably 1% by mass to 10% by mass.

An amount of the non-crystalline resin (B) in the toner is preferably 10% by mass to 40% by mass.

An amount of the non-crystalline resin (C) in the toner is preferably 50% by mass to 90% by mass.

An amount of the composite resin (D) in the toner is preferably 3% by mass to 20% by mass.

—Crystalline Polyester Resin (A)—

For the crystalline polyester resin (A), examples of an alcohol component includes 1,4-butanediol, 1,5-pentanediol and 1,6-hexanediol, and examples of a carboxylic acid component includes fumaric acid, maleic acid, terephthalic acid, succinic acid and trimellitic acid.

The crystalline polyester resin (A) preferably includes an ester bond in a molecular main chain thereof represented by General Formula (I) below:

$$[—OCO—R—COO—(CH_2)_n—] \qquad \text{General Formula (1)}$$

where, in General Formula (1), R represents a straight-chain unsaturated aliphatic dicarboxylic residue having 2 to 20 carbon atoms, and n represents an integer of 2 to 20.

The presence of the structure of General Formula (1) may be confirmed with a solid-state $^{13}C$ NMR.

Examples of the straight-chain unsaturated aliphatic group include a straight-chain unsaturated aliphatic group derived from straight-chain unsaturated dicarboxylic acid such as maleic acid, fumaric acid, 1,3-n-propendicarboxylic acid and 1,4-n-butenedicarboxylic acid.

In General Formula (I), $(CH_2)_n$ represents a straight-chain aliphatic dihydric alcohol residue. In this case, examples of the straight-chain aliphatic dihydric alcohol residue include those derived from a straight-chain aliphatic dihydric alcohol such as ethylene glycol, 1,3-propylene glycol, 1,4-butanediol and 1,6-hexanediol.

For the crystalline polyester resin (A), using the straight-chain unsaturated aliphatic dicarboxylic acid as an acid component thereof is advantageous over an aromatic dicarboxylic acid in view of easier formation of crystalline structure, and it enables the crystalline polyester resin (A) to fulfill its full function more effectively.

The crystalline polyester resin (A) may be manufactured by, for example, polycondensation reaction of: (i) a polycarboxylic component including a straight-chain unsaturated aliphatic dicarboxylic acid or a reactive derivative thereof (acid anhydrides, lower alkyl esters having 1 to 4 carbon atoms, acid halides, etc.); and (ii) a polyhydric alcohol component including a straight-chain aliphatic diol. In this case, a small amount of other polycarboxylic acids may be added to the polycarboxylic acid component, if necessary The polycarboxylic acid includes: (i) a branched-chain unsaturated aliphatic dicarboxylic acid; (ii) a saturated aliphatic carboxylic acid such as saturated aliphatic dicarboxylic acid and saturated aliphatic tricarboxylic acid; and (iii) an aromatic polycarboxylic acid such as aromatic dicarboxylic acid and aromatic tricarboxylic acid.

An amount of these polycarboxylic acids is usually 30% by mole or less, and preferably 10% by mole or less with respect to the total carboxylic acid, and it is appropriately selected as long as the obtained polyester has crystallinity.

Examples of the polycarboxylic acid which may be added according to necessity includes: dicarboxylic acids such as malonic acid, succinic acid, glutaric acid, adipic acid, suberic acid, sebacic acid, citraconic acid, phthalic acid, isophthalic acid and terephthalic acid; and polycarboxylic acids having 3 or more carboxylic groups such as trimellitic anhydride, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxylic-2-methylenecarboxylypropane and 1,2,7,8-octanetetracarboxylic acid.

A small amount of an aliphatic branched-chain dihydric alcohol, a cyclic dihydric alcohol or a polyhydric alcohol of 3 or more hydroxyl groups may be added to the polyhydric alcohol component. The amount thereof is 30% by mole or less, preferably 10% by mole or less, and it is appropriately selected as long as the obtained polyester has crystallinity.

Examples of the polyhydric alcohol added according to necessity includes 1,4-bis(hydroxymethyl)cyclohexane, polyethylene glycol, ethylene oxide adduct of bisphenol A, propylene oxide adduct of bisphenol A and glycerin.

The crystalline polyester resin (A) preferably has a sharp molecular weight distribution in view of low-temperature fixing property and preferably has a relatively low molecular weight.

In a molecular weight distribution by GPC of o-dichlorobenzene soluble matter, the crystalline polyester resin (A) preferably has a weight-average molecular weight (Mw) of 5,500 to 6,500, a number-average molecular weight (Mn) of 1,300 to 1,500 and a ratio Mw/Mn of 2 to 5.

The molecular weight distribution is based on a molecular weight distribution chart having an abscissa of log (M: molecular weight) and an ordinate of mass in %. For the case of the crystalline polyester resin (A), it preferably has a molecular weight peak in a range of 3.5% by mass to 4.0% by mass, and a half-value width of the peak is preferably 1.5 or less.

The crystalline polyester resin (A) preferably has a low glass transition temperature (Tg) and a low softening temperature (T½) as long as the heat-resistant storage stability of the resultant toner does not degrade. In general, the glass transition temperature (Tg) is preferably 80° C. to 130° C. and more preferably 80° C. to 125° C., and the softening temperature (T½) is preferably 80° C. to 130° C. and more preferably 80° C. to 125° C. When Tg and T½ exceed their upper limits, the lower limit of the fixing temperature of the resultant toner increases, and thus the low-temperature fixing property may degrade.

Whether or not the crystalline polyester resin (A) has crystallinity may be determined by the presence of a peak in an x-ray diffraction pattern by a powder x-ray diffraction apparatus.

The crystalline polyester resin (A) preferably has at least one diffraction peak at 2θ of 19° to 25° and more preferably has diffraction peaks at 2θ of (i) 19° to 20°, (ii) 21° to 22°, (iii) 23° to 25°, and (iv) 29° to 31°. Presence of a diffraction peak at 2θ of 19° to 25° for a produced toner indicates that the crystalline polyester resin (A) maintains its crystallinity, which is preferable since it ensures the crystalline polyester resin (A) to fulfill its full function.

The powder x-ray diffraction measurement may be performed by, for example, RINT 1100 manufactured by Rigaku Corporation, with Cu as a vacuum tube and tube voltage-current of 50 kV-30 mA, using a wide-angle goniometer.

—Non-Crystalline Resins (B) and (C)—

The non-crystalline resin (B) includes a chloroform insoluble matter.

It is preferable that the non-crystalline resin (B) includes 5% by mass to 40% by mass of the chloroform insoluble matter. It is preferable that a toner having the resin including 5% by mass to 40% by mass of the chloroform insoluble matter easily develops hot-offset resistance. Also, a produced toner including 2% by mass to 20% by mass of chloroform insoluble matter is preferable because hot-offset resistance is maintained while the compositions of the resins other than the non-crystalline resin (B) is ensured. When the chloroform insoluble matter in the toner is less than 2% by mass, hot-offset resistance resulting from the chloroform insoluble matter becomes dilute. When the chloroform insoluble matter exceeds 20% by mass, the composition of the binder resin which contributes to low-temperature fixing property relatively decreases, and thus low-temperature fixing property may degrade.

The chloroform insoluble matter is measured, for example, as follows.

About 1.0 g of a toner (or a binder resin) is weighed, to which about 50 g of chloroform is added. The solution is sufficiently dissolved, separated by centrifugation and filtered at a room temperature using a qualitative filter No. 5C of JIS Standard (P3801). A filtration residue corresponds to the insoluble content, and an amount of the chloroform insoluble matter is obtained based on a ratio of the mass of the toner used and the mass of the filtration residue (% by mass)

When the chloroform insoluble matter of a toner is measured, about 1.0 g of the toner is weighed, and the same measurement procedure as the binder resin is performed. However, a solid content such as pigment exists in the filtration residue, and thus it may be obtained separately by thermal analysis.

The non-crystalline resin (C) has a softening temperature (T½) lower by 25° C. or more than the non-crystalline resin (B). This is because the non-crystalline resin (B) and non-crystalline resin (C) assume separate functions; the non-crystalline resin (C) assumes a function contributing to lower limit of fixing to support low-temperature fixing property of the crystalline polyester resin (A), and the non-crystalline resin (B) assumes a function contributing to upper limit of fixing to support hot-offset resistance resulting from the chloroform insoluble matter.

The non-crystalline resin (C) preferably has a main peak between 1,000 and 10,000 in a molecular weight distribution obtained by GPC based on THF soluble matter having a main peak and has a half-value width of the molecular weight distribution of 15,000 or less. Such non-crystalline resin (C) demonstrates excellent low-temperature fixing property, and it may support the low-temperature fixing property sufficiently in the toner even when the amount of the crystalline polyester resin (A) is decreased.

It is paradoxical, but despite using the non-crystalline resin (C) having the above molecular weight distribution, the composition of the non-crystalline resin (C) is high among the binder resins constituting the toner if the toner has a molecular weight distribution having a main peak between 1,000 and 10,000 and having a half-value width of 15,000 or less.

As a result of extensive study, the present inventors have found that a toner, manufactured with a formulation that the crystalline polyester resin (A), the non-crystalline resin (B), the non-crystalline resin (C) and the composite resin (D) are combined and having higher composition of the non-crystalline resin (C), is the most well-balanced, that side effects by excessive crystalline polyester resin or excessive THF insoluble matter or adverse effects of hardness of the composite resin (D) to the lower-limit of fixing do not become obvious, that each resin fulfills its full function, and that favorable low-temperature fixing property, heat-resistant storage stability and hot-offset resistance may be obtained.

As the non-crystalline resin (B) and the non-crystalline resin (C), heretofore known materials may be used, provided that the non-crystalline resin (B) includes the chloroform insoluble matter, that the non-crystalline resin (C) satisfies the molecular weight distribution, and that the non-crystalline resin (B) and the non-crystalline resin (C) satisfy the relation regarding the softening temperatures. Resins below may be used, for example.

Examples thereof include: styrene resins (homopolymers or copolymers including styrene or styrene substitutes) such as polystyrene, chloropolystyrene, poly-α-methylstyrene, styrene/chlorostyrene copolymer, styrene/propylene copolymer, styrene/butadiene copolymer, styrene/vinyl chloride copolymer, styrene-vinyl acetate copolymer, styrene/maleic acid copolymer, styrene/acrylic ester copolymer (styrene/methyl acrylate copolymer, styrene/ethyl acrylate copolymer, styrene/butyl acrylate copolymer, styrene/octyl acrylate copolymer, styrene/phenyl acrylate copolymer, etc), styrene/methacrylic ester copolymer (styrene/methyl methacrylate copolymer, styrene/ethyl methacrylate copolymer, styrene/butyl methacrylate copolymer, styrene/phenyl methacrylate copolymer, etc.), styrene/methyl α-chloroacrylate copolymer and styrene/acrylonitrile/acrylic ester copolymer; a vinyl chloride resin; a styrene/vinyl acetate copolymer; a rosin-modified maleic acid resin; a phenolic resin; an epoxy resin; a polyethylene resin; a polypropylene resin; an ionomer resin; a polyurethane resin; a silicone resin; a ketone resin; an ethylene/ethyl acrylate copolymer; a xylene resin; a polyvinyl butyral resin; a petroleum-based resin and a hydrogenated petroleum resin. These may be used alone or in combination of two ore more.

A method for manufacturing these resins is not particularly restricted, and any one of bulk polymerization, solvent polymerization, emulsion polymerization and suspension polymerization may be used.

The non-crystalline resin (B) and the non-crystalline resin (C) are preferably polyester resins in view of low-temperature fixing property. As the polyester resins, those obtained by, for example, condensation polymerization of an alcohol and a carboxylic acid may be used.

Examples of the alcohol include: glycols such as ethylene glycol, diethylene glycol, triethylene glycol and propylene glycol; ethylation bisphenols such as 1,4-bis(hydroxymethyl) cyclohexane and bisphenol A; and other dihydric alcohol monomers and trihydric or more polyhydric alcohol monomers.

Examples of the carboxylic acid includes: organic acid monomers having 2 carboxylic groups such as maleic acid, fumaric acid, phthalic acid, isophthalic acid, terephthalic acid, succinic acid and malonic acid; and polycarboxylic acid monomers having 3 or more carboxylic groups such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane and 1,2,7,8-octanetetracarboxylic acid.

The polyester resins preferably have a glass transition temperature Tg of 55° C. or more, and more preferably 60° C. or more in terms of heat-resistant storage stability.

The composite resin (D) is a resin that a condensation polymerization monomer and an addition polymerization monomer are chemically bonded (also referred to as a hybrid resin). That is, the composite resin (D) includes a condensation polymerization resin unit and an addition polymerization resin unit.

The composite resin (D) may be obtained by subjecting a mixture including a condensation polymerization monomer and an addition polymerization monomer as raw materials to parallel reactions of condensation polymerization and addition polymerization in a reactor or to sequential reactions of condensation polymerization and addition polymerization or vice versa.

Examples of the condensation polymerization monomer in the composite resin (D) include: a polyhydric alcohol and a polycarboxylic acid forming a polyester resin unit; a polycarboxylic acid and amine forming a polyamide resin unit or a polyester-polyamide resin unit and an amino acid.

Examples of the dihydric alcohol as the polyhydric alcohol include 1,2-propanediol, 1,3-propanediol, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtained by polymerization of cyclic ether such as ethylene oxide and propylene oxide to bisphenol A.

Examples of the polyhydric alcohol having 3 or more hydroxyl groups include: sorbitol, 1,2,3,6-hexanetetraol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylol ethane, trimethylol propane and 1,3,5-trihydroxybenzene.

Among these, the alcohol component having bisphenol A skeleton such as hydrogenated bisphenol A and diols obtained by polymerization of cyclic ether such as ethylene oxide and propylene oxide to bisphenol A are particularly preferable since they may provide heat-resistant storage stability or mechanical strength to the binder resin.

Examples of the dicarboxylic acid as the polycarboxylic acid include: benzenedicarboxylic acids and anhydrides thereof such as phthalic acid, isophthalic acid and terephthalic acid; alkyldicarboxylic acids and anhydrides thereof such as succinic acid, adipic acid, sebacic acid and azelaic acid; unsaturated dibasic acids such as maleic acid, citraconic acid, itaconic acid, alkenyl succinic acid, fumaric acid and mesaconic acid; and unsaturated dibasic acid anhydride such as maleic anhydride, citraconic anhydride, itaconic anhydride and alkenyl succinic acid anhydride.

Examples of the polycarboxylic acid having 3 or more carboxylic groups include: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxylate propane, tetra(methylenecarboxy)methane, 1,2,7,8-octanetetracarboxylic acid, EMPOL trimer acid, an anhydride thereof, and a partial lower alkyl ester thereof.

Among these, aromatic polycarboxylic acid compounds such as phthalic acid, isophthalic acid, terephthalic acid and trimellitic acid are favorably used in view of heat-resistant storage stability and mechanical strength.

Examples of the amine or amino acid include diamines (B1), tri- or higher polyamines (B2), aminoalcohols (B3), aminomercaptans (B4), amino acids (B5) and amino-blocked compounds (B6) obtained by blocking the amino groups of (B1) to (B5).

Examples of the diamines (B1) include: aromatic diamines (e.g., phenylene diamine, diethyltoluene diamine and 4,4'-diaminodiphenylmethane); alicyclic diamines (e.g., 4,4'-diamino-3,3'-dimethyldicyclohexylmethane, diaminecyclohexane and isophorondiamine); and aliphatic diamines (e.g., ethylenediamine, tetramethylenediamine and hexamethylenediamine).

Examples of the tri- or higher polyamines (B2) include diethylenetriamine and triethylenetetramine.

Examples of the aminoalcohols (B3) include ethanolamine and hydroxyethylaniline.

Examples of the aminomercaptans (B4) include aminoethylmercaptan and aminopropylmercaptan.

Examples of the amino acids (B5) include aminopropionic acid, aminocaproic acid and ϵ-caprolactam.

Examples of the amino-blocked compounds (B6) obtained by blocking the amino groups of (B1) to (B5) include ketimine compounds and oxazolidine compounds derived from the amines (B1) to (B5) and ketones (e.g., acetone, methyl ethyl ketone and methyl isobutyl ketone).

A molar ratio of the condensation polymerization monomer component in the composite resin (D) is preferably 5% by mole to 40% by mole, and more preferably 10% by mole to 25% by mole.

When the molar ratio is less than 5% by mole, dispersion with the polyester resins may degrade. When it exceeds 50% by mole, dispersion of a releasing agent tends to degrade.

Also, an esterification catalyst may be used in the condensation polymerization, and catalysts described above may all be used.

The addition polymerization monomer of the composite resin (D) is not particularly restricted and may be appropriately selected according to purpose, and it is typically a vinyl monomer.

Examples of the vinyl monomer includes: styrene vinyl monomers such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-4-dichlorostyrene, m-nitrostyrene, o-nitrostyrene and p-nitrostyrene; acrylic acid vinly monomers such as acrylic acid, methyl acrylate, ethyl acrylate, propyl acrylate, n-butyl acrylate, isobutyl acrylate, n-octyl acrylate and n-dodecyl acrylate; methacrylic acid vinyl monomers such as methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate and diethylaminoethyl methacrylate; and other vinyl monomers or other vinyl monomers forming a copolymer. These may be used alone or in combination of two or more.

Examples of the other vinyl monomers or other vinyl monomers forming a copolymer include: monoolefins such as ethylene, propylene, butylene and isobutylene; polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole, N-vinylpyrrolidone; vinyl naphthalenes; acrylic acid or methacrylic acid derivatives such as acrylonitrile, methacrylonitrile and acrylamide; unsaturated dibasic acids such as maleic acid, citraconic acid, itaconic acid, alkenyl succinic acid, fumaric acid and mesaconic acid; unsaturated dibasic acid anhydrides such as maleic anhydride, citraconic anhydride, itaconic anhydride and alkenyl succinic acid anhydride; mono-esters of unsaturated dibasic acid such as monomethyl maleate, monoethyl maleate, monobutyl maleate, monomethyl citraconate, monoethyl citraconate, monobutyl citraconate, monomethyl itaconate, monomethyl alkenyl succinate, monomethyl fumarate and monomethyl mesaconate; unsaturated dibasic acid esters such as dimethyl maleic acid and dimethyl fumaric acid; α- or β-unsaturated acids such as crotonic acid and cinnamic acid; α- or β-unsaturated acid anhydrides such as crotonic anhydride and cinnamic anhydride; monomers having a carboxyl group such as anhydrides of the α- or β-unsaturated acids and lower fatty acids, alkenyl malonic acids, alkenyl glutaric acid, alkenyl adipic acid, acid anhydrides thereof and monoesters thereof, hydroxyalkyl esters of acrylic acid or methacrylic acid such as 2-hydroxyethyl acrylate, 2-hydroxyethyl methacrylate and 2-hydroxypropyl methacrylate; and monomers having a hydroxyl group such as 4-(1-hydroxy-1-methylbutyl)styrene and 4-(1-hydroxy-1-methylhexyl)styrene.

Among these, styrene, acrylic acid, n-butyl acrylate, 2-ethylhexyl acrylate, methacrylic acid, n-butyl methacrylate, 2-ethylhexyl methacrylate are preferable, and a combination including at least styrene and acrylic acid is particularly preferable since it provides excellent dispersion of a releasing agent.

A crosslinking agent of the addition polymerization monomer may be further added according to necessity.

Examples of the crosslinking agent include an aromatic divinyl compound, diacrylate compounds linked by an alkyl chain, diacrylate compounds linked by an alkyl chain including an ether bond, polyester diacrylate compounds and polyfunctional crosslinking agents.

Examples of the aromatic divinyl compound include divinylbenzene and divinylnaphthalene.

Examples of the diacrylate compounds linked by an alkyl chain include ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and these compounds whose acrylates are replaced by methacrylates.

Examples of the diacrylate compounds linked by an alkyl chain including an ether bond includes diethylene glycol diacrylate, triethylene glycol diacrylate, tetraethylene glycol diacrylate, polyethylene glycol #400 diacrylate, polyethylene glycol #600 diacrylate, dipropylene glycol diacrylate and these compounds whose acrylates are replaced by methacrylates.

Other examples include diacrylate and dimethacrylate compounds linked by a chain including an aromatic group and an ether bond.

Examples of the polyester diacrylate compounds include MANDA, commercially available from Nippon Kayaku Co., Ltd.

Examples of the polyfunctional crosslinking agents include pentaerythritol triacrylate, trimethylolethane triacrylate, trimethylolpropane triacrylate, tetramethylolmethane tetraacrylate, oligoester acrylate, these compounds whose acrylates are replaced by methacrylates, triallyl cyanurate and triallyl trimellitate.

An amount of the crosslinking agent is preferably 0.01 parts by mass to 10 parts by mass, and more preferably 0.03 parts by mass to 5 parts by mass with respect to 100 parts by mass of the addition polymerization monomer used.

A polymerization initiator used when the addition polymerization monomer is polymerized is not particularly restricted and may be appropriately selected according to purpose. Examples thereof include: an azo-based polymerization initiator such as 2,2'-azobisisobutyronitrile, 2,2'-azobis(4-methoxy-2,4-dimethylvaleronitrile) and 2,2'-azobis(2,4-dimethylvaleronitrile); and a peroxide-based polymerization initiator such as methyl ethyl ketone peroxide, acetylacetone peroxide, 2,2-bis(tert-butylperoxy)butane, tert-butylhydroperoxide, benzoyl peroxide and n-butyl-4,4-di-(tert-butylperoxy)valerate.

These may be used alone, or in combination of two or more for the purpose of adjusting the molecular weight and the molecular weight distribution of the resins.

An amount of the polymerization initiator is preferably 0.01 parts by mass to 15 parts by mass, and more preferably 0.1 parts by mass to 10 parts by mass with respect to 100 parts by mass of the addition polymerization monomer used.

A monomer which is reactive in both condensation polymerization and addition polymerization are used, for example, in order to bind chemically a condensation polymerization resin unit and an addition polymerization resin unit.

Examples of such a multi-reactive monomer include: an unsaturated carboxylic acid such as acrylic acid and methacrylic acid; an unsaturated dicarboxylic acid and a derivative thereof such as fumaric acid, maleic acid, citraconic acid and itaconic acid; and a vinyl monomer having a hydroxyl group.

An amount of the multi-reactive monomer is preferably 1 part by mass to 25 parts by mass, and more preferably 2 parts by mass to 20 parts by mass with respect to 100 parts by mass of the addition polymerization monomer used.

Regarding the composite resin (D), the condensation polymerization reaction and the addition polymerization reaction proceed and/or complete in parallel if they take place in an identical reactor; these reactions may take place independently by selecting respective reaction temperature and time.

As an exemplary method, a mixture including addition polymerization monomers and a polymerization initiator is dropped into another mixture of condensation polymerization monomers in a reactor for mixing these mixtures beforehand; an addition polymerization is completed first by a radical polymerization reaction, and then a condensation polymerization takes place at an elevated reaction temperature.

Accordingly, by proceeding two independent reactions in a reactor, two types of resin units may be effectively dispersed and bound.

The composite resin (D) having a polyester condensation polymerization resin unit and a vinyl resin addition polymerization unit may fulfill its full function more effectively.

The composite resin preferably has a softening temperature (T½) of 90° C. to 130° C., and more preferably 100° C. to 120° C.

When the softening temperature (T½) is less than 90° C., heat resistant storage stability and hot-offset resistance may degrade. When it exceeds 130° C., low-temperature fixing property may degrade.

The composite resin (D) preferably has a glass transition temperature of 45° C. to 80° C., more preferably 50° C. to 70° C., and further preferably 53° C. to 65° C. in view of low-temperature fixing property, storage stability and durability.

The composite resin (D) preferably has an acid value of 5 mgKOH/g to 80 mgKOH/g, and more preferably 15 mgKOH/g to 40 mgKOH/g in view of chargeability and environmental stability.

—Charge Controlling Agent—

A toner of the present invention preferably includes a charge controlling agent according to necessity.

Examples of the charge controlling agent include: nigrosine and nigrosine modified with fatty acid metal salt, onium salts such as phosphonium salt and lake pigments thereof, triphenylmethane dyes and lake pigments thereof, and metal salts of higher fatty acid; diorganotin oxide such as dibutyltin oxide, dioctyltin oxide, dicyclohexyltin oxide diorganotin borate such as dibutyltin borate, dioctyltin borate and dicyclohexyltin borate, organic metal complex, chelate compound, monoazo metal complex, acetylacetone metal complexes, aromatic hydroxylcarboxylic acid, metal complex of aromatic dicarboxylic acid, quaternary ammonium salts, salicylic acid metal compound, aromatic hydroxylcarboxylic acid, aromatic mono- and polycarboxylic acids, metal salts thereof, anhydrides thereof, esters thereof, and phenolic derivatives such as bisphenol. These may be used alone or in combination of two or more.

An amount of the charge controlling agent is preferably 0.1 parts by mass to 10 parts by mass, and more preferably 1 part by mass to 5 parts by mass with respect to 100 parts by mass of the resin component of the toner.

Among the charge controlling agents, it is preferable to include the salicylic acid metal compound since it improves hot-offset resistance as well. In particular, a complex having a metal of 3 or more valences, which possibly forms a six-coordinate configuration, reacts with a portion having high reactivity with a resin and a wax to form a mild crosslinking structure, and thus it is effective in terms of hot-offset resistance. Also, dispersion improves when it is combined with the composite resin (D), and charging polarity control function may be exhibited more effectively.

As the salicylic acid metal compound, compounds represented by the following general formula may be used. Examples of a metal complex having M as zinc include BONTRON E-84, manufactured by Orient Chemical Industries Co., Ltd.

Further, examples of metals having 3 or more valences include Al, Fe, Cr and Zr.

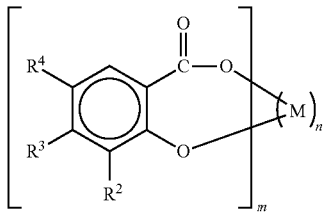

In the above general formula, each of $R_2$, $R_3$ and $R_4$ independently represents a hydrogen atom, a straight-chain or branched-chain alkyl group having 1 to 10 carbon atoms or an alkenyl group having 2 to 10 carbon atoms; M represents chromium, zinc, calcium, zirconium or aluminum; m represents an integer of 2 or more; and n represents an integer of 1 or more.

The toner for forming an electrophotographic image of the present invention preferably has an endothermic peak associated with the crystalline polyester resin (A) in a range of 90° C. to 130° C. in an endothermic peak measurement of the toner by a DSC. When the endothermic peak associated with the crystalline polyester resin (A) exists in a range of 90° C. to 130° C., the toner may develop heat-resistant storage stability and low-temperature fixing property more effectively because the crystalline polyester resin (A) does not melts at an ordinary temperature but melts in a relatively low fixing temperature range and is able to fix on a recording medium.

Also, in the endothermic peak measurement of the toner by the DSC, an endothermic energy amount of the endothermic peak is preferably 1 J/g to 15 J/g.

When the endothermic energy amount is less than 1 J/g, the crystalline polyester resin (A) may not fulfill its full function since an amount of the crystalline polyester resin (A) which functions effectively in the toner is too small. On the other hand, when the endothermic energy amount exceeds 15 J/g, the glass transition temperature of the toner decreases, inviting decrease of heat-resistant storage stability, since an amount of the crystalline polyester resin (A) which functions effectively in the toner is in excess, and an absolute amount which is miscible with the non-crystalline resins becomes large.

Regarding the DSC measurements (endothermic peak and glass transition temperature Tg), the measurement may be performed by elevating a temperature from 20° C. to 150° C. at 10° C./minute using a differential scanning calorimeter (DSC-60, manufactured by Shimadzu Corporation).

In the present invention, the endothermic peak derived from a crystalline polyester exists around 80° C. to 130° C., which is a melting point of the crystalline polyester resin (A). The endothermic energy amount is obtained from an area surrounded by a base line and an endothermic curve. An endothermic energy amount in a DSC measurement is generally measured after temperature elevation is performed twice, but in the present invention, the endothermic peak and glass transition temperature are obtained using an endothermic curve after the first temperature elevation.

When the endothermic peak derived from the crystalline polyester resin (A) overlaps with the endothermic peak of a wax, the endothermic energy amount of the wax is subtracted from the endothermic energy amount of the overlapping peaks. The endothermic energy amount of the wax is calculated from an endothermic energy amount of the wax alone and an amount of the wax in the toner.

—Aliphatic Amide Compound—

A toner of the present invention preferably includes a fatty acid amide compound.

When the fatty acid amide compound is formulated along with the crystalline polyester resin (A) to a pulverized toner whose manufacturing process includes a melt-kneading step, re-crystallization of the crystalline polyester resin (A) which has melted during melt-kneading in the kneaded mixture is promoted during cooling, which decreases miscibility with resins. This accordingly suppresses decrease of the glass transition temperature of the toner and improves heat-resistive storage stability. Also, when it is combined with a releasing agent, it enables the releasing agent to remain on a surface of a fixed image, which makes the image resistant to rubbing and improves smear resistance.

An amount of the aliphatic amide compound in the toner is preferably 0.5% by mass to 10% by mass.

One example of the aliphatic amide compound is a compound represented by $R_1$—CO—$NR_2R_3$.

$R_1$ is an aliphatic hydrocarbon group having 10 to 30 carbon atoms. Each of $R_2$ and $R_3$ is independently a hydrogen atom, an alkyl group having 1 to 10 carbon atoms, an aryl group having 6 to 10 carbon atoms or an aralkyl group having 7 to 10 carbon atoms. Here, the alkyl group, the aryl group and the aralkyl group of the $R_2$ and $R_3$ may be substituted by a substituent which is usually inactive such as fluorine atom, chlorine atom, cyano group, alkoxy group and alkylthio group. The groups are more preferably unsubstituted.

Examples of the fatty acid amide compounds include stearic acid amide, stearic acid methylamide, stearic acid diethylamide, stearic acid benzylamide, stearic acid phenylamide, behenic acid amide, behenic acid dimethylamide, myristic acid amide and palmitic acid amide.

Also, as the fatty acid amide compound, an alkylenebis (fatty acid amide) is particularly favorably used.

The alkylenebis(fatty acid amide) is a compound represented by General Formula (II).

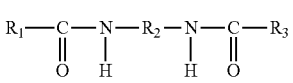

<General Formula (II)> where, in General Formula (II), $R_1$ and $R_3$ represent an alkyl group or an alkenyl group having 5 to 21 carbon atoms; and $R_2$ represents an alkylene group having 1 to 20 carbon atoms.

Examples of the alkyelenebis fatty acid amide represented by General Formula (II) include methylenebis(stearic amide), ethylenebis(stearic amide), methylenebis(palmitic amide), ethylenebis(palmitic amide), methylenebis(behenic amide), ethylenebis(behenic amide), hexamethylenebis (stearic amide), hexamethylenebis(palmitic amide) and hexamethylenebis(behenic amide). These may be used alone or in combination of two or more. Among these, ethylenebis (stearic amide) is particularly preferable.

The fatty acid amide compound having a softening temperature (T½) lower than a surface temperature of a fixing member during fixing may be effective as a releasing agent as well on the surface of the fixing member.

Other examples of the alkylenebis fatty acid amide compounds include an alkylenebis fatty acid amide compound of a saturated or mono- or di-unsaturated fatty acid such as propylenebis(stearic amide), butylenebis(stearic amide), methylenebis(oleic amide), ethylenebis(oleic amide), propylenebis(oleic amide), butylenebis(oleic amide), methylenebis (lauric amide), ethylenebis(lauric amide), propylenebis(lauric amide), butylenebis(lauric amide), methylenebis(myristic amide), ethylenebis(myristic amide), ropylenebis(myristic amide), butylenebis(myristic amide), propylenebis(palmitic amide), butylenebis(palmitic amide), methylenebis(palmitoleic amide), ethylenebis(palmitoleic amide), propylenebis (palmitoleic amide), butylenebis(palmitoleic amide), methylenebis(arachidic amide), ethylenebis(arachidic amide), propylenebis(arachidic amide), butylenebis(arachidic amide), methylenebis(eicosenoic amide), ethylenebis (eicosenoic amide), propylenebis(eicosenoic amide), butylenebis(eicosenoic amide), methylenebis(behenic amide), ethylenebis(behenic amide), propylenebis(behenic amide), butylenebis(behenic amide), methylenebis(erucic amide), ethylenebis(erucic amide), propylenebis(erucic amide) and butylenebis(erucic amide).

—Colorant—

A colorant used in the toner of the present invention is not particularly restricted and may be appropriately selected according to purpose. Examples thereof include: carbon black, lamp black, iron black, aniline blue, phthalocyanine blue, phthalocyanine green, Hansa yellow G, rhodamine 6C lake, Carco Oil Blue, chrome yellow, quinacridone, benzidine yellow, rose bengal and triarylmethane dyes. These may be used alone or in combination of two or more.

Among these, carbon black has a favorable black coloring ability. However, it is a favorable electrically-conductive material as well. Thus, when a large amount thereof is used or it exists in an agglomerated state in the toner, electrical resistance of the toner decreases, inviting transfer failure in the transfer step. Especially, when it is used in combination with the crystalline polyester resin (A), the carbon black particles cannot penetrate in a domain of the crystalline polyester resin (A). Thus, when the crystalline polyester resin (A) is present in the toner with a large distribution diameter, the carbon black particles exist in the resins other than the crystalline polyester resin (A) with a relatively high concentration. Accordingly, the carbon black particles tend to remain as agglomerates and are trapped in the toner, and the resistance tends to decrease excessively.

In the present invention, carbon black is favorably dispersed since it is used in combination with the composite resin (D), and the risk described above may be alleviated. Also, the melted toner with carbon black has high viscosity when the toner is fixed on a recording medium, and thus it provides an effect that hot offset which occurs due to viscosity decrease when a large amount of the non-crystalline resin (C) is formulated may be suppressed.

An amount of the colorant is preferably 1% by mass to 30% by mass, and more preferably 3% by mass to 20% by mass with respect to the resin component of the toner.

—Releasing Agent—

A releasing agent used in the toner of the present invention is not particularly restricted and may be appropriately selected according to purpose. Examples thereof include; a low-molecular-weight polyolefin wax such as low-molecular-weight polyethylene and low-molecular-weight polypropylene; a synthetic hydrocarbon wax such as Fischer-Tropsch wax; a natural wax such as beeswax, carnauba wax, candelilla wax, rice wax and montan wax; a petroleum wax such as paraffin wax and microcrystalline wax; a higher fatty acid such as stearic acid, palmitic acid and myristic acid, a metal salt thereof, a higher fatty acid amide, a synthetic ester wax and various modified waxes thereof. These may be used alone or in combination of two or more.

Among these, carnauba wax, modified carnauba wax, polyethylene wax and synthetic ester wax are preferable. Carnauba wax is particularly preferable since it finely disperses in a polyester resin and polyol resin in a moderate manner and easily provides a toner having superior hot-offset resistance, transfer property and durability and having further improved smear resistance when it is combined with a fatty acid amide compound because it is very effectively retained on a surface of a fixed image.

An amount of the releasing agent is preferably 2% by mass to 15% by mass with respect to the toner. When the amount is less than 2% by mass, hot offset prevention effect is insufficient. When it exceeds 15% by mass, transfer property and durability may degrade.

The releasing agent preferably has a melting point of 70° C. to 150° C. When the melting point is less than 70° C., heat-resistant storage stability of the toner may degrade. When it exceeds 150° C., releasing property may not be fully demonstrated.

A particle diameter of the toner of the present invention is not particularly restricted and may be appropriately selected according to purpose. In order to achieve high-quality image with excellent fine-line reproducibility, the toner preferably has a volume average particle diameter of 4 μm to 10 μm.

When the volume average particle diameter is less than 4 μm, cleaning property in developing and transfer efficiency in transferring are interfered, which may degrade image quality. When it exceeds 10 μm, fine-line reproducibility of an image may degrade.

The volume average particle diameter of the toner may be measured by various methods, and Coulter Counter TA II, manufactured by Coulter Electronics, Inc. may be used, for example.

(Method for Manufacturing Toner for Forming Electrophotographic Image)

A method for manufacturing a toner for forming an electrophotographic image of the present invention is a method for manufacturing the toner for forming an electrophotographic image of the present invention, including:

melt-kneading a toner material including at least 4 types of binder resins; and cooling the melt-kneaded material, and it preferably includes pulverizing and classifying, and it further includes other steps.

The toner is a pulverized toner manufactured using a so-called pulverization method, where the manufacturing process thereof includes at least melt-kneading.

The pulverization method is a method to obtain a pulverized toner by dry mixing, melt-kneading in a kneader and pulverizing a toner material including at least the crystalline polyester resin (A), the non-crystalline resin (B), the non-crystalline resin (C), the composite resin (D) and preferably the colorant, the releasing agent, the charge controlling agent and the fatty acid amide compound.

First the toner material is mixed, and the mixture is charged in a melt-kneader for melt-kneading. As the melt-kneader, for example, a monoaxial or biaxial continuous kneader or a batch kneader with a roll mill may be used. Preferable examples thereof include a twin screw extruder KTK manufactured by Kobe Steel, Ltd., an extruder TEM manufactured by Toshiba Machine Co., Ltd., a twin screw extruder manufactured by KCK Co., Ltd., a twin screw extruder PCM manufactured by Ikegai Corp. and a co-kneader manufactured by BUSS Company. The melt-kneading is preferably performed under appropriate conditions so as not to break molecular chains of the binder resins. Specifically, the temperature of the melt-kneading is adjusted while taking the softening point of the binder resins into consideration. When the temperature of the melt-kneading is considerably higher than the softening point, the breaking occurs significantly. When the temperature thereof is considerably lower than the softening point, dispersion may not proceed.

In pulverizing, the thus-kneaded product is pulverized. In this pulverization, it is preferable that the kneaded product is roughly pulverized and then finely pulverized. Preferred examples of pulverizing methods include: a method in which the kneaded product is crushed against a collision plate in a jet stream for pulverization; a method in which the particles are crushed against one another in a jet stream for pulverization; and a method in which the kneaded product is pulverized by passage through the narrow gap between a mechanically rotating rotor and a stator.

In classifying, the pulverized product obtained in the pulverizing is classified to produce particles having a predetermined particle diameter. The classification is performed by removing microparticles using a cyclone, a decanter or a centrifugal separator.

After completion of the above pulverization and classification, the obtained pulverized product is classified in a gas flow by an action of centrifugal force, whereby a toner having a predetermined particle diameter is manufactured.

The toner of the present invention is a pulverized toner which undergoes melt-kneading in its manufacturing process. In cooling after melt-kneading the materials, a cooling speed of the melt-kneaded material decreases when a thickness of the melt-kneaded material is 2.5 mm or greater. This enables the function of the crystalline polyester resin (A) to fulfill its full function since the time for re-crystallization of the crystalline polyester resin (A) which has been melted in the kneaded material becomes longer, promoting re-crystallization. To promote re-crystallization, it is also effective to formulate a fatty acid amide as described above, but the same effect may be achieved by adjusting the manufacturing process. An upper limit of the thickness of the melt-kneaded material is not restricted, but the thickness is preferably 8 mm or less since the thickness exceeding 8 mm significantly reduces efficiency in pulverization.

In order to enhance fluidity, storage stability, developability and transferability of the toner, inorganic particles such as hydrophobic silica fine powder may be further added and mixed to the toner base particles manufactured as above.

A conventional powder mixer is used for such mixing of an additive, but it is preferable that the mixer is equipped with a jacket so that its internal temperature is controlled. To change the history of load on the additive, for example, the addition of additives may be added in the middle or in a gradual manner.

The number of revolutions, rolling speed, time and temperature may be appropriately varied. For example, a high loading is applied first and then a relatively low loading is applied, and vice versa.

Examples of a mixing equipment which may be used in mixing an external additive include a V-type mixer, ROCKING MIXER, LOEDIGE MIXER, NAUTOR MIXER and HENSCHEL MIXER.

After mixing, coarse particles or agglomerated particles may be removed by passing through a sieve of 250 mesh or more.

<Developer>

The toner of the present invention may be used as a one-component developer composed only of the toner or a two-component developer by mixing the toner with a carrier when it is used as a developer, which is not particularly restricted. It is preferably used as a two-component developer in view of prolonged life when it is used for a high-speed printer that corresponds to the improvement of information processing speed in recent years.

(Image Forming Method)

An image forming method of the present invention includes at least: an electrostatic latent image forming step to form an electrostatic latent image on an electrostatic latent image bearing member; a developing step to form a visible image by developing the electrostatic latent image using a toner; a transfer step to transfer the visible image to a recording medium; and a fixing step to fix the transferred image transferred on the recording medium, and it further includes other steps according to necessity.

As the toner, the toner for forming an electrophotographic image of the present invention is used.

Figure 6:
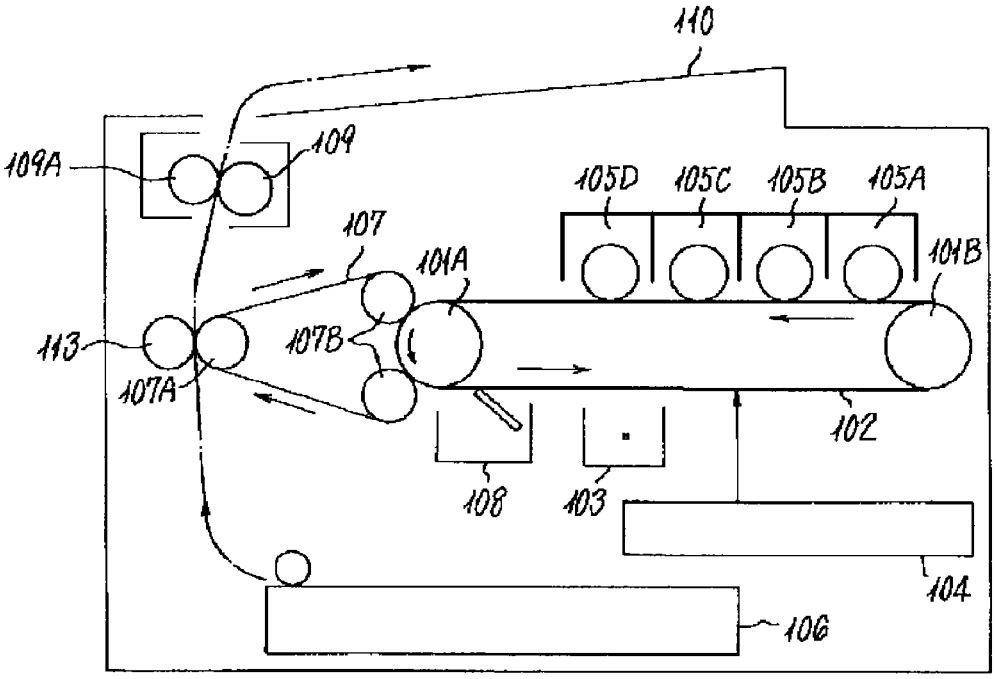
FIG. 6 is a schematic diagram illustrating one example of an electrophotographic image forming apparatus used in the present invention.

One example of an electrophotographic color image forming apparatus of the present invention is illustrated in FIG. 6.

In FIG. 6, 101A denotes drive roller; 101B denotes a driven roller; 102 denotes a photoreceptor belt; 103 denotes a charger; 104 denotes a laser writing unit, 105A to 105D denote development units which accommodate yellow, magenta, cyan and black toners, respectively; 106 denotes a paper cassette; 107 denotes an intermediate transfer belt; 107A denotes a roller drive shaft for driving the intermediate transfer belt; 107B denotes a driven shaft roller to support the intermediate transfer belt; 108 denotes a cleaning device; 109 denotes a fixing roller; 109A denotes a pressure roller; 110 denotes a paper discharge tray 110; and 113 denotes a paper transfer roller.

In the color image forming apparatus, the intermediate transfer belt 107 which is flexible against a transfer drum is used; the intermediate transfer belt 107 as an intermediate transfer body is stretched over the roller drive shaft 107A and a pair of driven shaft rollers 107B and conveyed in a circular manner in a clockwise direction; and a belt surface between the pair of driven shaft rollers 107B contacts the photoconductor belt 102 at a circumference of the roller drive shaft 101A from a horizontal direction.

When a normal color image is printed, toner images of respective colors formed on the photoconductor belt 102 are transferred to the intermediate transfer belt 107 every time they are formed, and a color toner image is synthesized. This is transferred at once to a transfer paper conveyed from the paper cassette 106 by the paper transfer roller 113. The transfer paper after transfer is conveyed between the fixing roller 109 and the pressure roller 109A of the fixing apparatus, fixed by the fixing roller 109 and the pressure roller 109A and ejected to the paper discharge tray 110.

When the developing units 105A to 105E develop the toners, the concentration of the toners in the developers contained in the developing units decreases. The decrease of the toner concentration in the developers is detected by a toner concentration sensor (not shown). When the decrease of the toner concentration is detected, toner supplying apparatuses connected to the respective developing units are activated to supply toners and increase the toner concentration. Here, the supplied toner may be a developer for a so-called trickle developing system that a carrier and a toner are mixed, provided that the developing units are equipped with a developer discharge mechanism.

In FIG. 6, the toner images are superimposed on the intermediate transfer belt 107 to form an image, but a system where transfer is performed directly from a transfer drum to a recording medium without using an intermediate transfer belt may be considered similarly as an electrophotographic image forming apparatus of the present invention.

Figure 7:
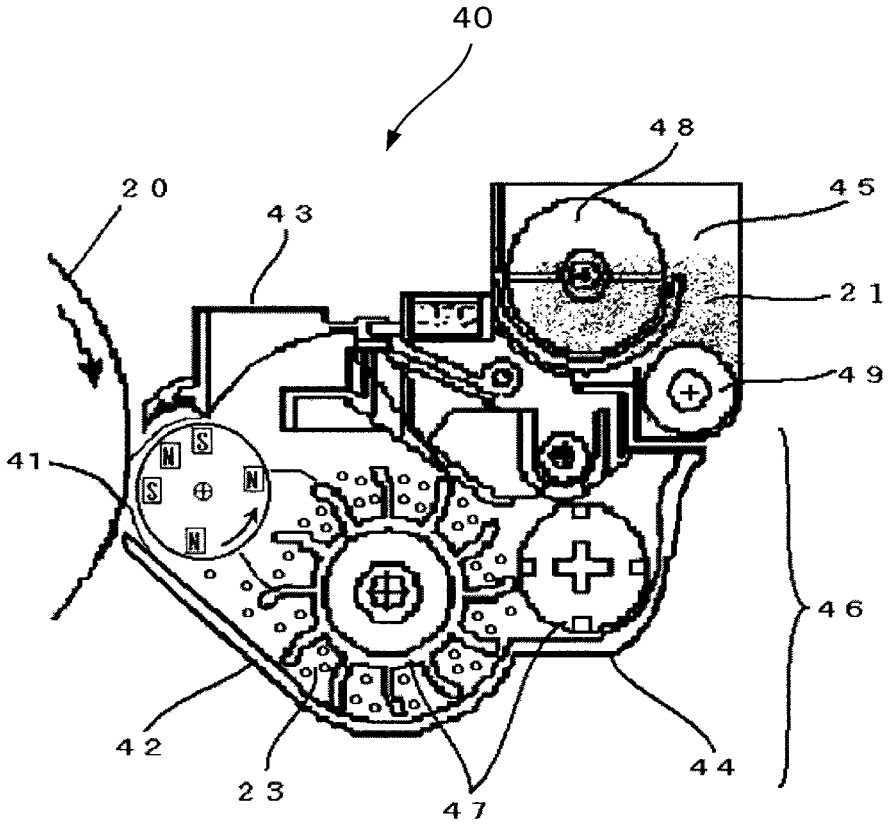
FIG. 7 is a schematic diagram illustrating one example of a developing apparatus used in the present invention.

FIG. 7 is a diagram illustrating one example of a developing apparatus used in the present invention, and modified examples described hereinafter also belong to the scope of the present invention.

In FIG. 7, a developing apparatus 40 arranged facing a photoconductor 20 as a latent image bearing member is composed primarily of a developing sleeve 41, a developer containing member 42, a doctor blade 43 as a regulating member and a support case 44.

In the support case 44 having an opening on a side of the photoconductor 20, a toner hopper 45 as a toner container which contains a toner 21 is connected internally. A developer container 46 which contains a developer including the toner 21 and a carrier 23 is equipped with a developer stirring mechanism 47 for stirring the toner 21 and the carrier 23 to provide the toner 21 with friction/peeling charge.

The toner hopper 45 is equipped internally with a toner agitator 48 and a toner supplying mechanism 49 as a toner supplying unit turned by a drive unit (not shown). The toner agitator and the toner supplying mechanism 49 send the toner 21 in the toner hopper 45 to the developer container 46 with stirring.

The developing sleeve 41 is arranged in a space between the photoconductor 20 and the toner hopper 45. The developing sleeve 41, which is driven to rotate in a direction of an arrow in the figure by a drive unit (not shown), includes a magnet (not shown) as a magnetic field generating unit arranged internally position-invariant relative to the developing apparatus 40 to form a magnetic brush by the carrier 23.

The doctor blade 43 is integrally mounted on a side opposite to the side of the developer containing member 42 attached to the support case 44. In this example, the doctor blade 43 is disposed while maintaining a certain gap between its tip and an outer peripheral surface of the developing sleeve 41.

By employing such an apparatus in an unlimited way, the image forming method of the present invention is accomplished as follows. That is, with the above configuration, the toner 21 sent from an inside of the toner hopper 45 by the toner agitator 48 and the toner supplying mechanism 49 is conveyed to the developer container 46, and the toner is provided with desired friction/peeling charge through stirring by the developer stirring mechanism 47. The toner is supported by the developing sleeve 41 and conveyed to a location opposite to the outer periphery of the photoconductor 20. Only the toner 21 binds electrostatically with the electrostatic latent image formed on the photoconductor 20, and a toner image is formed on the photoconductor 20.

Figure 8:
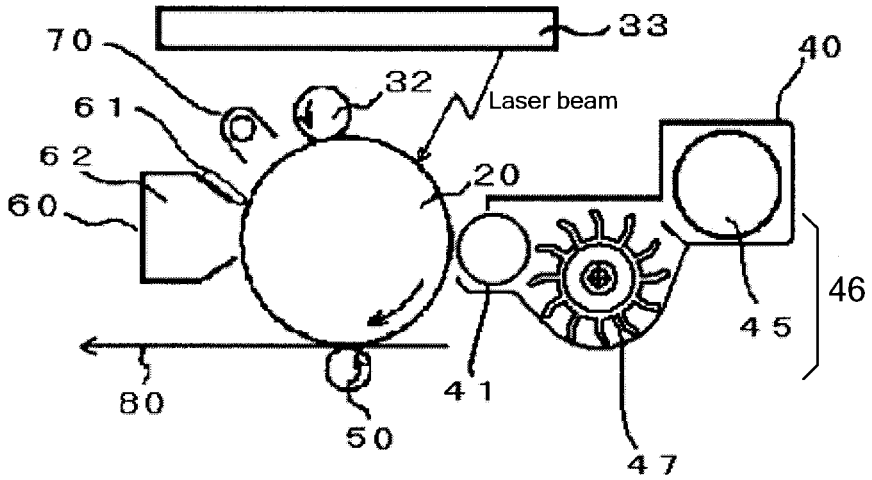
FIG. 8 is a diagram illustrating one example of an image forming apparatus including the developing apparatus of FIG. 7.

FIG. 8 is a diagram illustrating one example of an image forming apparatus including the developing apparatus of FIG. 7. A charging member 32, an image exposure system 33, a developing apparatus 40, a transferring apparatus 50, a cleaning apparatus 60 and a discharge lamp 70 are arranged around a drum-shaped photoconductor 20. In this example, a surface of the charging member 32 is not in contact with a surface of the photoconductor, leaving a gap of about 0.2 mm. When the photoconductor 20 is charged by the charging member 32, it is possible and effective to reduce uneven charge by charging the photoconductor 20 with an electric field that an AC component is superimposed on a DC component by a voltage applying unit (not shown). The image forming method including a developing method is carried out in the following operations.

A series of processes for forming an image may be explained by a negative-positive process. The photoconductor 20 typified by a photoconductor having an organic photoconductive layer (OPC) is discharged by the discharge lamp 70 and uniformly and negatively charged with the charging member 32 such as charger or charging roller, and a latent image is formed thereon by a laser beam irradiated from the image exposure system 33 such as laser optical system (in this example, an absolute value of the potential at an exposed area is lower than an absolute value of the potential at a non-exposed area).

The laser beam is irradiated from a semiconductor laser and scans a surface of the photoconductor 20 in a direction of the axis of rotation by, for example, a polygonal mirror (polygons) of a polygonal column rotating at a high speed. The latent image formed in this way is developed by a developer composed of a mixture of a toner and a carrier supplied on the developing sleeve 41 as a developer bearing member in the developing apparatus 40, and a toner image is formed. When the latent image is being developed, from a voltage applying mechanism (not shown) to the developing sleeve 41, a developing bias of a suitable magnitude as a DC voltage or an AC voltage superimposed on the DC voltage is applied between an exposed area and a non-exposed area of the photoconductor 20.

Meanwhile, a recording medium (paper, for example) is fed from a paper feeding mechanism (not shown). It is synchronized with a front edge of the image at a pair of upper and lower resist rollers (not shown) and fed between the photoconductor 20 and the transfer apparatus 50, and the toner image is transferred on the recording medium. Here, a potential of opposite polarity to the polarity of the charged toner is preferably applied as a transfer bias on the transfer apparatus 50. Thereafter, the recording medium 80 is separated from the photoconductor 20, and a transfer image is obtained.

Also, the toner remaining on the photoconductor 20 is recovered by a cleaning blade as a cleaning member in a toner collection chamber 62 in the cleaning apparatus 60.

The recovered toner may be conveyed to the developer container 46 and/or the toner hopper 45 by a toner recycling unit (not shown) and reused.

The image forming apparatus may be an apparatus equipped with a plurality of the above developing apparatus, where a toner image is sequentially transferred on a recording medium and sent to a fixing mechanism that fixes the toner by heat, etc, or where a plurality of a toner image is once transferred on an intermediate recording medium, then collectively transferred on a recording medium and fixed in the same manner.

Figure 9:
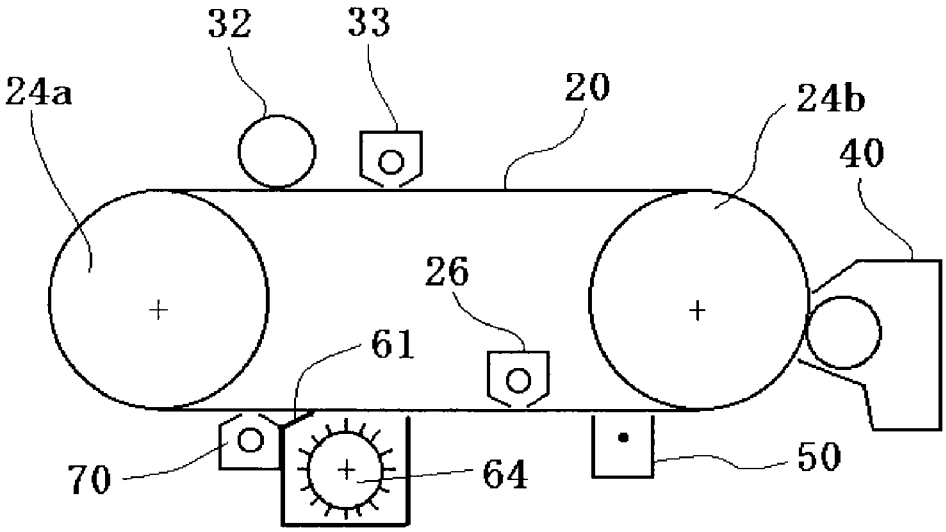
FIG. 9 is a diagram illustrating another example of an image forming apparatus used in the present invention.

FIG. 9 is a diagram illustrating another example of an image forming apparatus used in the present invention.

In the image forming apparatus of FIG. 9, a photoconductor 20 includes at least a photosensitive layer disposed on a conductive substrate, and it is driven by drive rollers 24*a* and 24*b* and is repeatedly subjected to charging by a charging member 32, image exposure by an image exposure system 33, developing by a developing apparatus 40, transfer by a transfer apparatus 50, pre-cleaning exposure by a pre-cleaning exposure light source 26, cleaning by a brush-like cleaning unit 64 and a cleaning blade 61, and discharging by a discharge lamp 70. In FIG. 9, the photoconductor is subjected to pre-cleaning exposure from a side of the substrate (the substrate is of course transparent in this case).

Also, an image having a low-temperature fixing property, hot-offset resistance and heat-resistant storage stability of a toner and having less inconsistent density on a recording medium may be provided by using a developing apparatus having a specific structure. This developing apparatus having a specific structure includes: a developer bearing member which rotates while supporting on its surface a two-component developer including a toner for forming an electrophotographic image of the present invention and a magnetic carrier and which supplies the toner to a latent image on a surface of a latent image bearing member at a location facing the latent image bearing member for development; a developer supplying path equipped with a developer supplying and conveying member which conveys the developer along an axial direction of the developer bearing member and supplies the developer to the developer bearing member; a developer collecting path equipped with a developer collecting and conveying member which conveys the developer recovered from the developer bearing member after passing a location facing the latent image bearing member along an axial direction of the developer bearing member as well as in the same direction as a developer supplying and conveying member; and a developer stirring path equipped with a developer stirring and conveying member, which is supplied with an excess developer, which has been unused for developing and conveyed to the most downstream side of a conveying direction of the developer supplying path, and a collected developer, which has been recovered from the developer bearing member and conveyed to the most downstream side of a conveying direction of the developer collecting path, and conveys the developer in a direction opposite to the developer supplying and conveying member while stirring the excess developer and the collected developer, and supplies the developer to the developer supplying path, wherein the three developer paths of the developer collecting path, the developer supplying path and the developer stirring path are partitioned by partitioning members, wherein the developer stirring path and the developer collecting path are allocated approximately at the same elevation, and wherein the developer supplying path is allocated at an elevation greater than the other two developer paths.

Meanwhile, an image having a low-temperature fixing property, hot-offset resistance and heat-resistant storage stability of a toner, capable of promptly responding to variation in toner concentration due to toner supply, and having less inconsistent density on a recording medium may be provided by using a second developing apparatus having a specific structure. This second developing apparatus having a specific structure includes: a developer bearing member which rotates while supporting on its surface a two-component developer including a toner for forming an electrophotographic image of the present invention and a magnetic carrier and supplies the toner to and develops a latent image on a surface of a latent image bearing member at a location facing the latent image bearing member; a developer supplying path equipped with a developer supplying and conveying member which conveys the developer along an axial direction of the developer bearing member and supplies the developer to the developer bearing member; and a developer stirring path equipped with a developer stirring and conveying member, which is supplied with an excess developer which has been unused for developing and conveyed to the most downstream side of a conveying direction of the developer supplying path and conveys the excess developer in a direction opposite to the developer supplying and conveying member while stirring the excess developer, and supplies the developer to the developer supplying path, wherein the developer collecting path and the developer stirring path are partitioned by a partitioning member at a central part excluding at least both ends in a longitudinal direction, wherein the developer which has passed a location facing the latent image bearing member is collected by the developer stirring path, mixed with the developer which has been conveyed in the developer stirring path, and then supplied to the developer supplying path. Also, this second developing apparatus has a benefit of having a reduced size since it has developer paths fewer than the previous developing apparatus.

In other words, a toner for forming an electrophotographic image of the present invention may be preferably used in a developing apparatus requiring three paths, namely a supplying path by a supplying and conveying member (first axis), a stirring path by a stirring and conveying member (second axis) and a collecting path by a collecting and conveying member (third axis), or in a developing apparatus requiring two paths, namely a supplying path by a supplying and conveying member (first axis) and a stirring path by a stirring and conveying member (second axis) since such a developing apparatus may provide an image having less inconsistent density on a recording medium.

What is common between these developing apparatus is that a developer supplied to a developing region by a supplying member does not return directly to a supplying path but is sent to a stirring path either directly or via a collecting path and then sent back to the supplying path. Hereinafter in this specification, such developing method is also referred to as a one-way circulatory development in the present specification.

In the former developing method, a developer having passed a developing region is once collected by a collecting path (third axis) and then sent to a stirring path (one-way circulatory development with three axes). On the other hand, the latter developing method does not include a collecting path by a collecting and conveying member, and a developer having passed a developing region is directly sent to a stirring path (one-way circulatory development with two axes).

In the both developing methods, a developer having passed a supplying path without being supplied to a developing region and a developer having passed the developing region and being recovered by a stirring path or a collecting path are mixed in the stirring path and sent to the supplying path.

Since a developer having a low toner concentration after being used in development does not mix in a supplying path, unevenness of the toner adhesion amount resulting from uneven toner concentration is unlikely to occur during development. Accordingly, an image having a stable concentration may be provided on any part of a recording medium.

When a image forming apparatus is configured similarly to the two-axis one-way circulatory development such that a developer having passed a latent image bearing member is recovered by a developer stirring path instead of a developer collecting path, mixed with a developer which has been conveyed in the developer stirring path and then supplied to a developer supplying path, there is an advantage that a toner is dispersed and homogenized very quickly into the developer when the toner is supplied.

It is inevitable a portion having a high toner concentration and a portion having a low toner concentration occur immediately after the toner is replenished in the developer going around in an image forming apparatus. In order to homogenize the toner concentration, it is necessary that the replenished toner quickly reaches the entire developer.

In a conventional image forming apparatus which only has a developer supplying path and a developer stirring path or an image forming apparatus like a three-axis one-way circulatory developing apparatus that a loop path length is set, it takes time for the replenished toner reaches from the location where the toner is supplied to the furthest location within the flow of the developer. Thus, there is a risk that the developer supplied to a developing region during that time has an uneven toner concentration, which results in inconsistent density in an output image.

For two-axis one-way circulatory development, the developer having a high toner concentration which has been flown into the developer supplying path is recovered over the full length in a longitudinal direction thereof via the developing region with respect to the developer flowing the developer stirring path, and thus the replenished toner is quickly delivered to the developer as a whole. As a result, the toner concentration is quickly homogenized, and it may prevent occurrence of inconsistent density in an output image caused by toner replenishment.

Further, the two-axis one-way circulatory development does not have a developer collecting path, and there is a benefit that a developing apparatus thereof has a reduced size.

Figure 10:
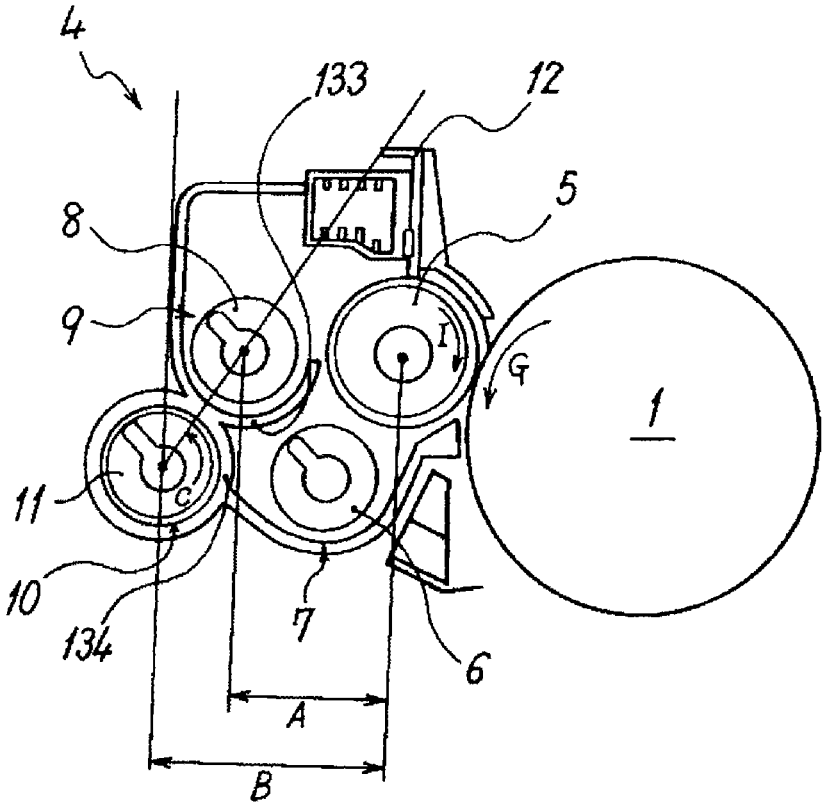
FIG. 10 is a diagram illustrating one example of a developing system including a developer supplying path, a developer collecting path and a developer stirring path partitioned by a partitioning member.
Figure 11:
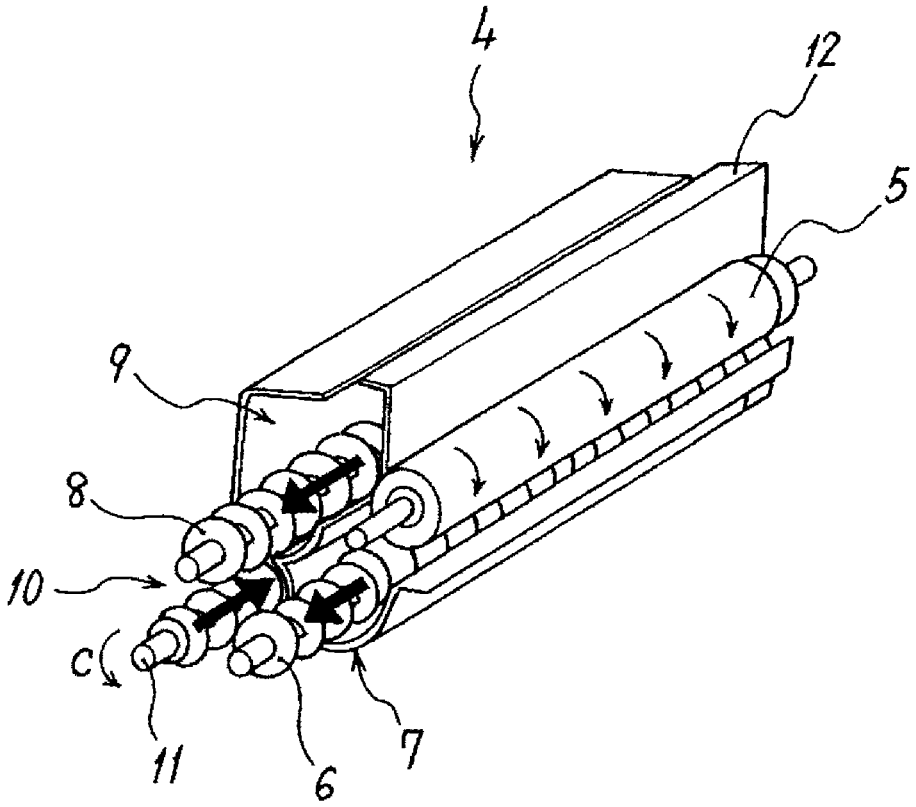
FIG. 11 is a diagram explaining a flow of a developer in the developer paths in the developing system of FIG. 10.
Figure 12:
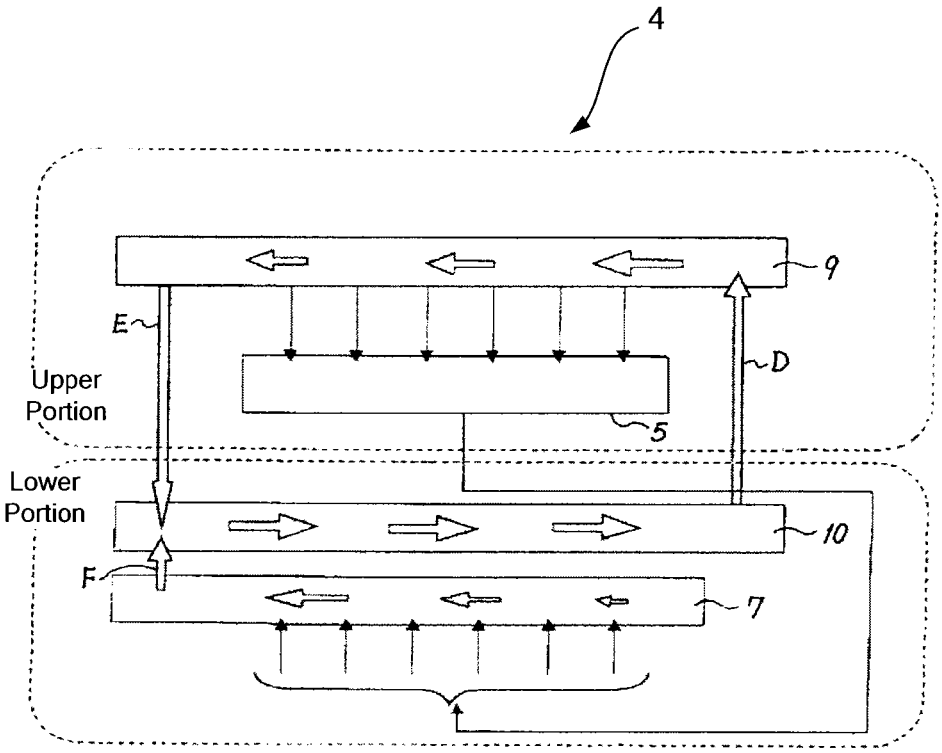
FIG. 12 is a view showing a frame format of the flow of the developer in the developing system of FIG. 10.

A configuration of a two-axis one-way circulatory developing apparatus is explained. FIG. 10 to FIG. 12 illustrate a developing method having a developer supplying path, a developer collecting path and a developer stirring path partitioned by partitioning members.

FIG. 10 is an enlarged configuration diagram illustrating a developing apparatus and a photoconductor.

As illustrated in FIG. 10, a surface of a photoconductor 1 is charged by a charging apparatus (not shown) while the photoconductor 1 is rotating in a direction of an arrow G in the figure. An electrostatic latent image is formed on the charged surface of the photoconductor 1 by a laser beam irradiated from an exposure apparatus (not shown), and the latent image was supplied with a toner from a developing apparatus 4 to form a toner image.

The developing apparatus 4 includes a developing roller 5 as a developer bearing member which supplies a developer on the latent image on the surface of the photoconductor 1 while moving on the surface in a direction I in FIG. 10 and develops the image. The developing apparatus 4 also includes a supplying screw 8 as a developer supplying and conveying member which supplies the developer to the developing roller 5 and conveys the developer in a direction into FIG. 10.

In a downstream side of a surface moving direction from a portion where the developing roller 5 is facing the supplying screw 8, the developing apparatus 4 includes a developing doctor 12 as a developer regulating member which regulates the developer supplied to the developing roller 5 to have a thickness appropriate for development.

In a downstream side of a surface moving direction from a portion where the developing roller 5 is facing the developing roller 5, the developing apparatus 4 includes a collecting screw 6 as a developer collecting and conveying member which conveys the collected developer in the same direction as the supplying screw 8. A supplying path 9 as a developer supplying path equipped with the supplying screw is arranged side by side in a transverse direction of the developing roller 5, and a collecting path 7 as a developer collecting path equipped with the collecting screw 6 is arranged side by side in a transverse direction of the developing roller 5.

The developing apparatus 4 is equipped with a stirring path 10 as a developer stirring path in parallel with the collecting path 7 below the supplying path 9. The stirring path 10 is equipped with a stirring screw 11 as a developer stirring member which conveys, while stirring, the developer in a direction from FIG. 10, which is opposite to the supplying screw 8.

The supplying path 9 and the stirring path 10 are partitioned by a first partitioning wall 133 as a partitioning member. Both front and back ends of the portion of the first partitioning wall 133 which partitions the supplying path 9 and the stirring path 10 are openings, and the supplying path 9 and the stirring path 10 communicate with each other.

Here, the supplying path 9 and the collecting path 7 are also partitioned by the first partitioning member 133, but no openings are allocated at the portion of the first partitioning wall 133 which partitions the supplying path 9 and the stirring path 7.

Also, the two paths, namely the stirring path 10 and the collecting path 7, are partitioned by a second partitioning wall 134. The second partitioning wall 134 has an opening at a front side in the figure, where the stirring path 10 and the collecting path 7 are communicating with each other.

In the apparatus of this example, the supplying screw 8, the collecting screw 6 and the stirring screw 11 as developer conveying members include a plastic screw. As one example, each screw has a diameter of 18 mm, a screw pitch of 25 mm and the number of revolution of about 500 rpm.

Development is performed by conveying the developer on the developing roller which has been thinned by the developing doctor 12 including stainless steel to a developing region opposing the photoconductor 1. A surface of the developing roller 5 has been V-grooved or sandblasted. As an exemplary configuration, using an aluminum (Al) element tube having a diameter of 25 mm, a gap between the developing doctor 12 and the photoconductor 1 was set at around 0.3 mm.

A developer after development is recovered at the collecting path 7 and conveyed to a front side of the cross-section in FIG. 10. The developer is transferred to the stirring path 10 at the opening of the first partitioning wall 133 arranged at a non-image region. Here, the toner is supplied to the stirring path 10 from a toner supplying opening arranged at an upper side of the stirring path 10 around the opening of the first partitioning path at an upstream side in the developer conveying direction in the stirring path 10. In FIG. 10, A represents a distance between a center of the developing roller 5 and a center of the supplying screw 8; and B represents a distance between the center of the supplying screw 8 and a center of the stirring screw 11.

Next, circulation of the developer in the three developer paths is explained.

FIG. 11 is a perspective cross-sectional view of the developing apparatus 4 explaining a flow of a developer in the developer paths in the developing system of FIG. 10. Arrows in FIG. 11 respectively denote a moving direction of the developer.

Also, FIG. 12 is a schematic diagram of the flow of the developer in the developing apparatus 4 in FIG. 10. Similarly to FIG. 11, arrows in FIG. 12 respectively denote a moving direction of the developer.

The supplying path 9, which has been supplied with the developer from the stirring path 10, conveys the developer to a downstream side of the conveying direction of the supplying screw 8 while supplying the developer to the developing roller 5. Then, the developer in excess which has been supplied to the developing roller 5 but conveyed to the downstream end of the conveying direction of the supplying path 9 without being used in development is supplied to the stirring path 10 from the opening of the first partitioning wall 133 (the arrow E in FIG. 12).

The collected developer which has been sent to the collecting path 7 from the developing roller 5 and conveyed by the collecting screw 6 to the downstream end of the conveying direction of the collecting path 7 is supplied to the stirring path 10 from the opening of the second partitioning wall 134 (the arrow F in FIG. 12).

Then, the stirring path 10 stirs the supplied excess developer and collected developer and conveys the developer to an upstream side of a conveying direction of the supplying screw 8, which is also a downstream side of a conveying direction of the stirring screw 11, and the developer is supplied to the supplying path 9 from an opening of the first partitioning wall 133 (the arrow D in FIG. 12).

In the stirring path 10, the stirring screw 11 stirs and conveys the collected developer, the excess developer and the toner replenished according to necessity in a direction opposite to the developer in the collecting path 7 and the supplying path 9. The stirred developer is transferred to the upstream side of the conveying direction of the supplying path 9 communicating at a downstream side of the conveying direction. Here, a toner concentration sensor (not shown) is disposed at a lower side of the stirring path 10, which operates a toner replenishment controlling apparatus (not shown) by a sensor output for toner replenishment from a toner container (not shown).

The developing apparatus in FIG. 12 is equipped with the supplying path 9 and the collecting path 7, where supply and recovery of a developer are carried out in different developer paths, and thus a developer which has been used in development does not mix into the supplying path 9. Thus, decrease of toner concentration in the developer supplied to the developing roller 5 may be prevented towards a downstream side of the conveying direction of the supplying path 9. Also, the apparatus is equipped with the collecting path 7 and the stirring path 10, where recovery and stirring of a developer are carried out in different developer paths, and thus the developer after development does not fall during stirring. Accordingly, the sufficiently stirred developer is supplied to the supplying path 9, and insufficient stirring of the developer supplied to the supplying path 9 may be prevented. In this way, the image density during developing may be maintained since the reduction of toner concentration and insufficient stirring of the toner in the developer in the supplying path 9 may be prevented.

Figure 13:
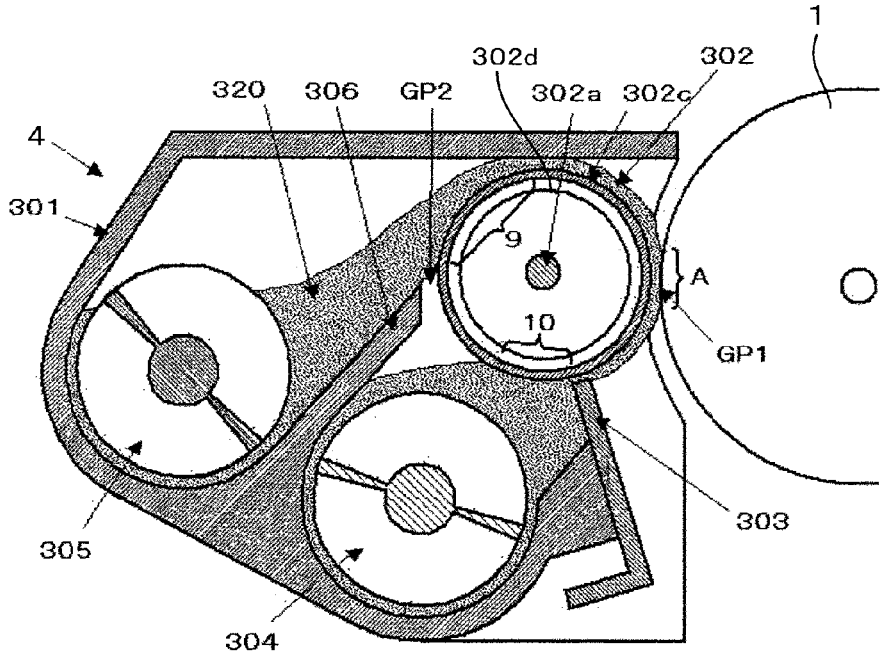
FIG. 13 is a diagram schematically illustrating an arrangement of each member around a photoconductor when a developing apparatus is employed for an image forming apparatus with the photoconductor as a latent image bearing member.

FIG. 13 is a diagram schematically illustrating an arrangement of each member around a photoconductor 1 when a developing apparatus 4 is employed for an image forming apparatus with the photoconductor 1.

In a casing 301, the developing apparatus 4 is equipped with: a developer supplying and conveying member 304 which stirs and conveys a developer 320 in a developer supplying path; a developer stirring and conveying member 305 which stirs and conveys the developer 320 in a developer stirring path; a rotary member such as developing roller 302; and other members. The developing roller 302 has a length in its longitudinal direction substantially equal to the length of the photoconductor 1 in its longitudinal direction.

The developing roller 302 is arranged adjacent and facing the photoconductor 1 so as to constitute a developing nip region A. A portion of the casing 301 which corresponds to a portion facing this photoconductor 1 is open so as to expose the developing roller 302.

Because of the developing roller 302, a developer 320 in the casing 301 is conveyed to the developing nip region A. At the developing nip region A, a toner in the developer 320 is adhered to an electrostatic latent image formed on a surface of the photoconductor 1, which is visualized as a toner image.

The developing apparatus 4 includes, in the casing 301, the developing roller 302, the developer supplying and conveying member 304, the developer stirring and conveying member 305 and a developer regulating member 303, and is circulating the developer 320 by stirring and conveying it.

A sleeve 302*c* in a cylindrical shape, located around the developing roller 302, is formed of a non-magnetic metal such as aluminum. A magnet roller 302*d* is fixed on an immobile member such as casing 301 so that each magnet faces a prescribed direction. The sleeve 302*c* rotates around it and conveys the developer 320 which has been attracted by a plurality of magnets arranged in a circumferential direction of the magnet roller 302*d*.

The developing roller 302 and the photoconductor 1 do not directly contact at the developing nip region A but are facing with each other while maintaining a developing gap GP1, a certain distance suitable for development.

The developer 320 is place on the developing roller 302 and subjected to "ear or spike" formation. By contacting the developer 320 with the photoconductor 1, a toner is adhered to an electrostatic latent image on a surface of the photoconductor 1 to form an image.

In this developing apparatus 4, a grounded power supply for bias (not shown) is connected to a fixed shaft 302*a*. A voltage of the power supply connected to the fixed shaft 302*a* is applied to the sleeve 302*c*. Meanwhile, a conductive substrate as a lowermost layer constituting the photoconductor 1 (not shown) is grounded.

In this way, an electric field is formed in the developing nip region A for transferring a toner departed from a carrier to a side of the photoconductor 1, and the developing nip region A serves to transfer the toner to the side of the photoconductor 1 by a potential difference between the sleeve 302*c* and the electrostatic latent image formed on the surface of the photoconductor 1.

Here, the developing apparatus of this example is combined with an image forming apparatus of writing with an exposure light. It employs a so-called reversal development method, where the photoconductor 1 is charged uniformly with a negative polarity by a charging apparatus (not shown), and a character portion is exposed with an exposure light to reduce an amount of writing so that the character portion (electrostatic latent image) having a reduced potential is developed with a toner of negative polarity. This is only one example, and the polarity of the charge put on the photoconductor 1 is not a big problem in the developing method of the present invention.

After development, the developer 320 after development supported on the developing roller 320 is conveyed to a downstream side along with a rotation of the developing roller 302 and drawn into the casing 301. A part of the casing 301 is curved along a peripheral surface of the sleeve 302*c*, and it functions as so-called preventing the toner from scattering by sealing effect.

An "agent releasing" effect acts on the drawn developer that the developer 320 which as been attracted around the developing roller 302 is released from the developing roller 302, and a developer releasing region (denoted as 9 in FIG. 13) is formed.

The developer 320 that has the toner adhered to the photoconductor 1 has a reduced toner concentration. A problem arises that desired image density cannot be obtained if this developer with a reduced toner concentration is conveyed again to the developing nip region A and supplied to development without leaving the developing roller 302.

To prevent this, in this example, the developer is released from the developing roller 302 in the developer releasing region 9 after development. The developer released from the developing roller 302 is then sufficiently stirred and mixed in the casing 301 for a desired toner concentration and toner charged amount.

In this way, the developer having a desired toner concentration and charged amount is drawn to the developing roller 302 in a developer drawing region (denoted as 10 in FIG. 13).

The developer attracted and so-called drawn to the developing roller 302 is adjusted to a predetermined thickness by passing through a developer regulating member 303, and it is conveyed to the developing nip region A while forming a magnetic brush.

Figure 14:
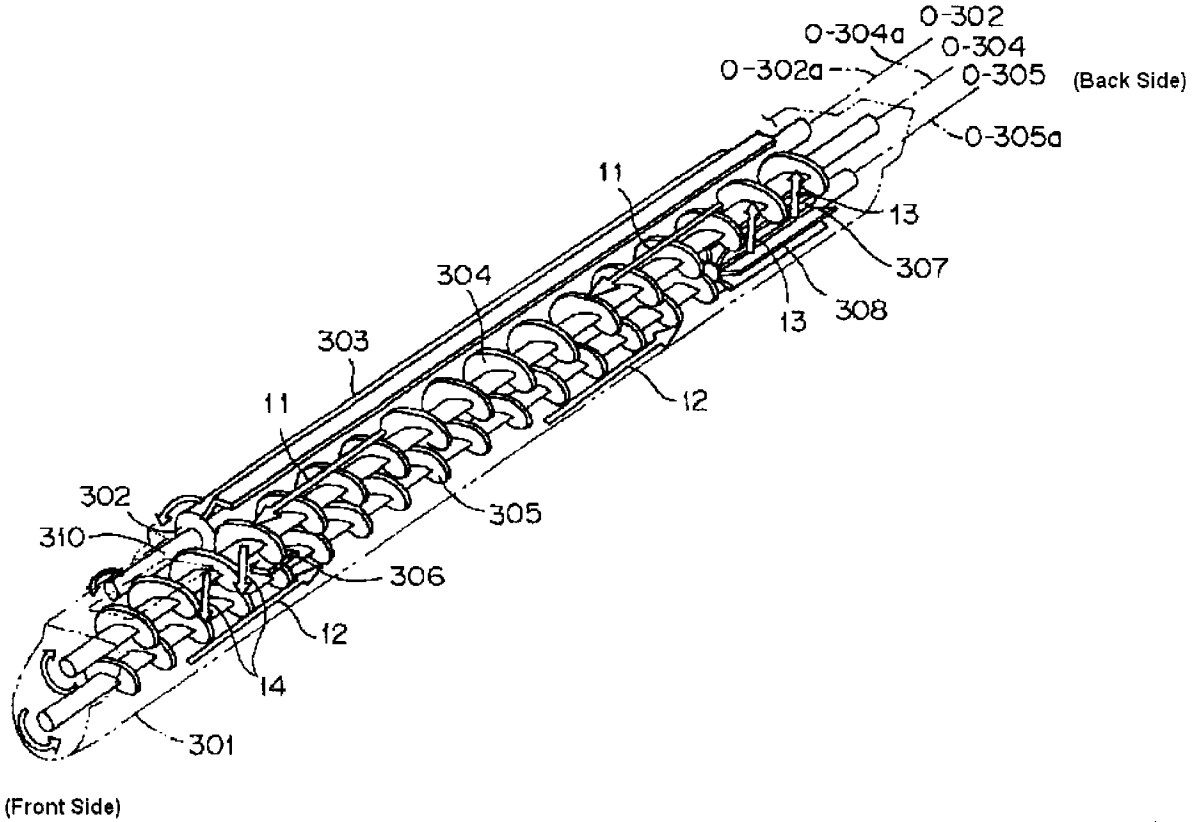
FIG. 14 is a diagram illustrating an exemplary configuration of an assembly of an interior of a developing apparatus including the relationship between a developer supplying and conveying member and a developer stirring and conveying member.
Figure 15:
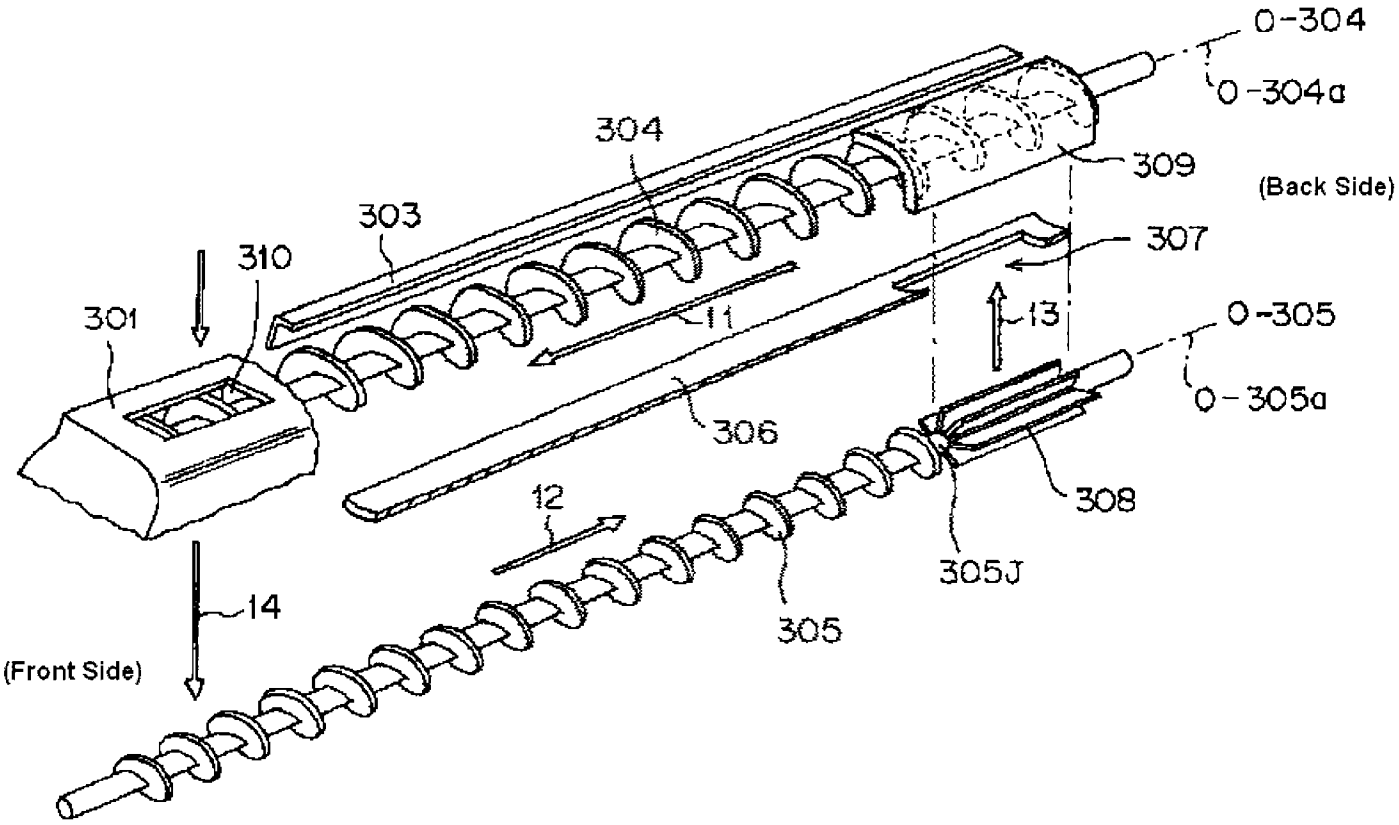
FIG. 15 is a diagram illustrating an exemplary configuration of each member of the interior of a developing apparatus including a relationship between a developer supplying and conveying member and a developer stirring and conveying member.

Hereinafter, arrangement and configuration of each member is explained with reference to FIG. 14 and FIG. 15, illustrating an assembled and disassembled states, respectively, of the internal configuration of the developing apparatus according to necessity. As shown in FIG. 13, the developer supplying and conveying member 304 is located around the developing roller 302 and is arranged in a vicinity of the developer drawing region 10. This location is also an upstream side of the developer regulating member 303. As shown in FIG. 14 and FIG. 15, the developer supplying and conveying member 304 has a shape of a screw with a spiral provided around its axis of rotation. It rotates around a center line (O-304*a*) which is parallel to a center line (O-302*a*) passing through a center of the developing roller 302 and conveys the developer with stirring from a back side toward a front side of a longitudinal direction of the center line (O-304*a*) as indicated by an arrow 11. That is, the developer supplying and conveying member 304 conveys the developer in its axial direction by the rotation of its axis of rotation.

The developer stirring and conveying member 305 is located around the developing roller 302 and is arranged in a vicinity of the developer releasing region 9. As shown in FIG. 14, the developer stirring and conveying member 305 has a shape of a screw with a spiral provided around its axis of rotation. It rotates around a center line (O-305*a*) which is parallel to the center line (O-302*a*) passing through the center of the developing roller 302 and conveys the developer with stirring from a back side toward a front side of a longitudinal direction of the center line (O-305*a*) as indicated by an arrow 12. That is, the developer stirring and conveying member 305 conveys the developer in a direction opposite to the conveying direction by the developer supplying and conveying member 304 by the rotation of its axis of rotation.

The developer stirring and conveying member 305 is preferably positioned obliquely upward with respect to the developer supplying and conveying member 304, and a space around the developer supplying and conveying member 304 and a space around the developer stirring and conveying member 305 are adjacent to each other in the casing 301.

A supply of the developer to a back end portion of the developing roller 302 is ensured by arranging back end portions of the developer supplying and conveying member 304 and the developer stirring and conveying member 305 slightly to a back side of the back end portion of the developing roller 302. Also, a space for toner replenishment described hereinafter is ensured by arranging the front end portions of the developer supplying and conveying member 304 and the developer stirring and conveying member 305 to a front side of a front end portion of the developing roller 302. The developer regulating member 303 is arranged to fit the length of the developing roller 302.

At a central portion between the developer supplying and conveying member 304 and the developer stirring and conveying member 305, and excluding the both ends in the longitudinal direction the developing roller 302, a partition plate 306 which divide the space around the developer supplying and conveying member 304 and the space around the developer stirring and conveying member 305 is formed cantilevered and integrally with an inner wall of the casing 301 on a side away from the developing roller 302.

The partition plate 306 in its longitudinal direction is located at the central portion excluding the both ends in the longitudinal direction the developing roller 302, and it is not located at portions corresponding to the both ends in the in the longitudinal direction the developing roller 302. On the other hand, ends in the longitudinal directions of the developer supplying and conveying member 304 and the developer stirring and conveying member 305 extend to both ends of the longitudinal direction of the developing roller 302.

The developer conveyed in the direction of the arrow 12 in the developer stirring and conveying member 305 is blocked its way at an end in its conveying direction by a side wall of the casing 301 and thus proceeds along the side wall to the developer supplying path, and it proceeds the developer supplying path along the arrow 13 by the developer supplying and conveying member 304.

Similarly, the developer conveyed in the direction of the arrow 11 by the developer supplying and conveying member 304 is blocked its way at an end in its conveying direction by a side wall of the casing 301 and thus proceeds along the side wall to the developer supplying path, and it proceeds the developer supplying path along the arrow 14 by the developer stirring and conveying member 305.

The partition plate 306 in its longitudinal direction is located at the central portion excluding the both ends in the longitudinal direction the developing roller 302 because it enables the developer to flow along the arrows 13 and 14 at the end portions in the longitudinal direction to form a circulatory path along the arrows 11, 14, 12 and 13 as a whole.

In the illustrated example, the partition plate 306 has an opening 307 near its back end, and the developer moves from the developer stirring path to the developer supplying path via this opening 307. Thus, it is also possible to configure the partition plate 306 to extend to the back end portion in the longitudinal direction of the developing roller 302.

Accordingly, the developing apparatus 4 of the present invention has a configuration including: the developing roller 302, which bears a developer and rotates to form a visible image of an electrostatic latent image formed on the photoconductor 1; the developer supplying and conveying member 304, which is arranged near the developer drawing region 10 which draws the developer to the developing roller 302, rotates around the center line (O-304*a*) which is parallel to the center line (O-302*a*) passing through the center of the developing roller 302 and conveys the developer with stirring from the back side toward the front side of the longitudinal direction of the center line (O-304*a*); the developer stirring and conveying member 305, which is arranged in a vicinity of the developer releasing region 9 where the developer is released from the developing roller 302, rotates around the center line (O-305*a*) which is parallel to the center line (O-302*a*) passing through the center of the developing roller 302 and conveys the developer with stirring in a direction opposite to the conveying direction by the developer supplying and conveying member 304; and the partition plate 306 which is arranged between the developer supplying and conveying member 304 and the developer stirring and conveying member 305 and divides the developer supplying and conveying member 304 and the developer stirring and conveying member 305 at a central portion excluding the both ends in the longitudinal direction the developing roller 302 in the developing apparatus 4, i.e. the casing. With such a configuration, the developer supplying and conveying member 304 and the developer stirring and conveying member 305 in the casing 301 which configure the circular path along the arrows 11, 14, 12 and 13 are arranged side by side next to the developing roller 302. Accordingly, it is possible to reduce the size of the (horizontal) side of the developing apparatus, compared to the technology illustrated in FIG. 10 where two stirring and conveying members are arranged in a (horizontal) direction away from the developing roller.

Further, in the developing apparatus 4 with its horizontal size reduced as described above, the space around the developer supplying and conveying member 304 and the space around the developer stirring and conveying member 305 are divided by the partition plate 306, excluding the both ends in the longitudinal direction the developing roller 302. Thus, only the developer 320 that a toner and a carrier are sufficiently stirred and mixed is provided by the developing roller 302 by the developer supplying and conveying member 304, and the developer with low toner concentration right after development is not directly supplied to the developing roller but is only stirred and carried by the developer stirring and conveying member 305. Accordingly, only a toner having a desired charged amount is used for development on the developing roller, and a high-quality image may be achieved.

The partition plate 306 bears the developer 320 which is stirred and conveyed by the developer supplying and conveying member 304 and forms a developer path, and at the same time, prevents the developer, which is released from the developing roller 302 at the developer releasing region 9 in an upstream side of the partition plate 306 and stirred and conveyed by the developer stirring and conveying member 305 from being drawn again to the developing roller 302 and moves to a space stirred by the developer supplying and conveying member 304.

To ensure this feature more, it is preferable to maintain a partition plate gap (GP2), a gap between an outer circumference of the developing roller 302 and the partition plate 306, of around 0.2 mm to 1 mm. When it is less than 0.2 mm, the partition place 306 may hit the developing roller 302 due to eccentricity of the developing roller during rotation. When it exceeds 1 mm, cutting "ear or spike" may be incompletely performed. Because of this, sufficient function may be obtained with the partition plate 306 arranged at an arbitrary location in the developer releasing region 9. That is, a degree of freedom of the position of the partition plate increases.

Further, it is possible to obtain function as a partition plate even though it deviates from the developer releasing region 9. However, when it deviates from the developer releasing region 9, a case may arise where the partition plate regulates a large amount of developer, and this is not preferable since the developer is heavily stressed.

In that case, it is preferably configured that the developer releasing region 9 is located around the developing roller 302 and opposite to the photoconductor 1 via the developing roller 302, that the developer drawing position 10 is located adjacent to the developer releasing region 9 in a downstream side on the direction of the rotation of the developing roller, that the partition plate 306 is arranged at a location between the developer releasing region 9 and the developer drawing position 10 where the lowest amount of the developer is adhered such that the space of the developer supplying path and the space of the developer stirring path are divided, and that an end portion of the partition plate 306 on a side of the developing roller 302 is facing the developing roller 302.

With such a configuration, the partition plate 306 may fulfill its full function without setting the partition plate gap (GP2) of 0.2 mm to 1 mm since the location of the partition plate has the lowest amount of developer adhesion around the developing roller 302. Also, the stress on the developer may be minimized due to regulation by the partition plate. In other words, it may mitigate the gap management in setting the partition plate. However, with a configuration that a condition of the partition plate gap (GP2) of 0.2 mm to 1 mm is further added, the stress on the developer may be further reduced.

As shown in FIG. 14 and FIG. 15, the developer stirring and conveying member 305 conveys the developer 320 released from the developing roller 302 with stirring in a direction of the arrow 12 toward the back side of the developing apparatus. At a downstream side of the conveying direction of the developer stirring path, i.e. the back end of the developing apparatus, an opening 307 is allocated at a part of the partition plate 306 as shown in FIG. 14 and FIG. 15, and the developer 320 conveyed by the developer stirring and conveying member 306 moves along a direction of the arrow 13 to the developer supplying path.

As shown in FIG. 15, at a downstream portion of the conveying direction of the developer by the developer stirring and conveying member 305, an impeller 308 may be used in place of the screw within a range corresponding to the opening 307.

This impeller 308 has a configuration with a plurality of blade members extending in plates in a normal direction from a shaft center (a center line (O-305*a*)) of a shaft member 305J of the developer stirring and conveying member 305, and it has a function to splash the developer 320 when it rotates.

A center (O-304) of the developer supplying and conveying member 304 and a center (O-305) of the developer stirring and conveying member 305 are on substantially the same vertical line, and the developer 320 splashes along the inner wall of the casing 301 by rotation of the impeller 308. The opening 307 is preferably formed to extend from a position slightly closer to the inner wall of the casing than the substantially vertical line connecting the center (O-304) and the center (O-305) so that it does not interfere with the course of the developer 302 due to this splash.

The developer supplying and conveying member 304 preferably rotates in a direction opposite to the developing roller 302. In general, a screw draws a conveying object toward a direction of rotation while sending it to an axial direction, and the developer supplying and conveying member 304 conveys the developer 320 in the developer supplying path while drawing it. Thus, a continuous developer supply to the developing roller 302 becomes possible.

The developer stirring and conveying member 305 conveys the developer 302 while drawing it in a direction away from the developing roller 302 when the developer stirring and conveying member 305 is rotated in the same direction as the developing roller 302, and it may prevent the developer released from the developing roller 302 by magnetic force or the partition plate 306 at the developer releasing region 9 from adhering again to the developing roller 302. Thus, it may prevent the developer having a decreased toner concentration from being conveyed to a region of the developer supplying and conveying member 304.

For the developer 320 in the developing apparatus 4, the toner is consumed after development operation is repeated, and it is necessary to replenish the toner externally to the developer in the apparatus. The toner may be replenished externally from an upstream end of the developer stirring path arranged in the vicinity of the developer releasing region 9 where the developer 320 is released from the developing roller 302, i.e. a developer replenishing unit arranged near a front end of the developing apparatus. In this way, the replenished toner is not immediately supplied to development; instead, it is stirred in the developer stirring and conveying member 305 and supplied to development with a stable and predetermined toner concentration.

The developer stirring path only recovers the released developer 320, and it does not supply a toner to the developing roller 302. Thus, a developer having an uneven toner concentration due to the newly replenished toner from an opening for replenishment 310 is not provided to development.

The replenished toner is conveyed to the back side of the developing apparatus 4 while it is stirred and mixed with the developer 320 released from the developing roller 302 and having a reduced toner concentration. By then, the toner concentration has been adjusted to an appropriate value, and the developer is supplied to the developing roller 302 while it is conveyed to the front side by the developer supplying and conveying member 304 and used for development.

In the developing apparatus 4 of this example, the developer 320 conveyed by the developer supplying and conveying member 304 is drawn to the developing roller 302 while it is being conveyed to the front side. The developer 320 drawn by the developing roller 302 contacts the photoconductor 1 via the magnetic brush and is subjected to development, and then it is released from the developing roller 302 at the developer releasing region 9 in the developing apparatus 4 and conveyed toward the back side by the developer stirring and conveying member 305.

Such a developer circulating path is explained by the arrows 11, 14, 12 and 13 in FIG. 14 and FIG. 15. Meanwhile, there is a case where more developer 320 is returned to the back side by the developer stirring and conveying member 305 and accumulates at the back side since it is used for development before conveyed to the front side by the developer supplying and conveying member 304. If this is unattended, there is a possibility that smooth circulation of the developer is inhibited.

This may be resolved by balancing the conveyance of the developer in a depth direction by making a developer conveying capacity of the developer supplying and conveying member 304 greater than a developer conveying capacity of the developer stirring and conveying member 305 so that a conveyance amount of the developer supplying and conveying member 304 per unit time is greater than a conveyance amount of the developer stirring and conveying member 305 per unit time. In this way, smooth circulation of the developer may be maintained over time.

It is possible to increase the developer conveying capacity of the developer stirring and conveying member 305 by increasing the outer diameter of the screw of the developer supplying and conveying member 304 with respect to the developer stirring and conveying member 305. The same benefit may be achieved by increasing the spiral pitch or the number of revolutions of the screw of the developer supplying and conveying member 304, or by increasing the space of the developer path by the developer supplying and conveying member 304.

(Process Cartridge)

A process cartridge of the present invention integrally supports an image bearing member and a developing unit which forms a visible image of an electrostatic latent image formed on the image bearing member using a developer including a toner and a carrier, and it is detachably mounted on an image forming apparatus body. It further includes other units according to necessity.

As the toner, the toner for forming an electrophotographic image of the present invention is used.

Figure 16:
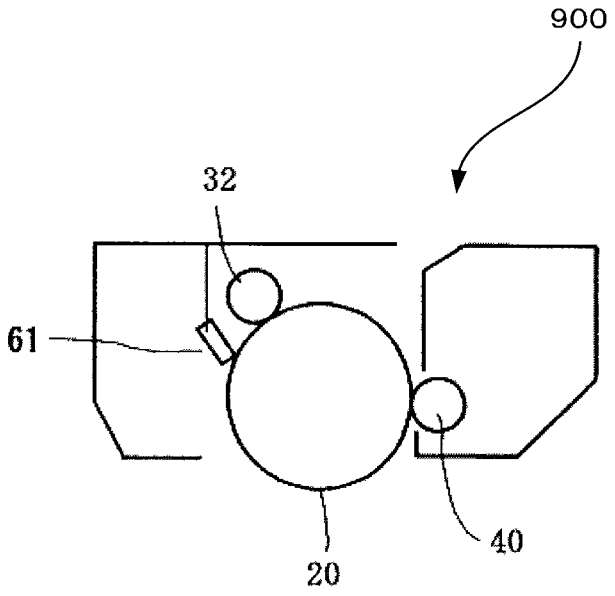
FIG. 16 is a diagram illustrating one example of a process cartridge of the present invention.

One example of a process cartridge of the present invention is illustrated in FIG. 16. This process cartridge 900 uses a toner of the present invention and integrally supports a photoconductor 20, a proximity-type brush-shaped contact charging unit 32, a developing unit 40 which contain a developer and a cleaning unit which includes at least a cleaning blade 61 as a cleaning device, and it may be detachably mounted on an image forming apparatus body.

In the present invention, the above-mentioned constitutional elements are integrally combined and configured as a process cartridge, and this process cartridge is configured such that it may be detachably mounted on an image forming apparatus body such as copiers and printers.

EXAMPLES

Hereinafter, the present invention will be explained in detail on the basis of examples but the present invention is not limited to the examples below.

Example 1

Preparation of Pulverized Toner

<Pulverized Toner 1>

Crystalline polyester resin (A): a1 . . . 4 parts by mass
Non-crystalline resin (B): b1 . . . 35 parts by mass
Non-crystalline resin (C): c1 . . . 55 parts by mass
Composite resin (D): d1 . . . 10 parts by mass
Colorant: p1 . . . 14 parts by mass
Releasing agent: carnauba wax (melting point: 81° C.) . . . 6 parts by mass
Charge controlling agent: monoazo metal complex (chromium complex dye, BONTRON S-34, manufactured by Orient Chemical Industries Co., Ltd.) . . . 2 parts by mass A toner material of the raw materials described in Table 1 to Table 5, the releasing agent, and the charge controlling agent are premixed using a HENSCHEL MIXER (FM20B, manufactured by Mitsui Miike Machinery Co., Ltd.) and then melt-kneaded at a temperature of 100° C. to 130° C. A kneaded matter obtained was rolled to a thickness of 2.8 mm, then cooled to a room temperature by a belt cooler and finally coarsely pulverized to 200 μm to 300 μm using a hammer mill. It was then finely pulverized using a supersonic jet mill LABOJET (manufactured by Nippon Pneumatic Mfg. Co., Ltd.) and classified using a dispersion separator (MDS-I, manufactured by Nippon Pneumatic Mfg. Co., Ltd.) while adjusting opening of louver so that a mass average particle diameter was 5.6 μm±0.2 μm, and thus toner base particles were obtained. Then, 1.0 parts by mass of an additive (HDK-2000, manufactured by Clariant K. K.) with respect to 100 parts by mass of the toner base particles were agitated and mixed using a HENSCHEL MIXER to obtain Pulverized Toner 1.

Pulverized Toner 1 thus prepared was measured for: main peak of molecular weight distribution; half-value width of molecular weight distribution; DSC peak temperature and endothermic energy amount in a range of 90° C. to 130° C. resulting from the crystalline polyester resin (A); presence or absence of diffraction peaks in 2θ=19° to 25° in an X-ray diffraction measurement; and volume-average particle diameter. The results are shown in Table 7.

<<Measurement of Main Peak of Molecular Weight Distribution, Half-Value Width of Molecular Weight Distribution>>

The main peak of molecular weight distribution and the half-value width of molecular weight distribution of a pulverized toner were measured using GPC (Gel-Permeation Chromatography) as follows.

A column was stabilized in a heat chamber at 40° C., and tetrahydrofuran (THF) was flown as a solvent in the column at this temperature at a flow rate of 1 ml/min. Measurement was made by injecting 504 to 200 μL of a THF sample solution of the resin with its sample concentration adjusted to 0.05% by mass to 0.6% by mass.

A molecular weight of the sample (toner) was measured by calculating a molecular weight of the sample from the relation between logarithmic values and number of counts of a calibration curve prepared using several monodispersed polystyrene standard samples.

As the standard polystyrene samples for the calibration curve, using samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ or $4.48\times10^6$, for example, manufactured by Pressure Chemical Co. or Tosoh Corporation are used, it is appropriate to use at least 10 standard polystyrene samples. As a detector, an RI (Refractive Index) detector was used.

<<Measurement of Absorption Peak and Glass Transition Temperature of Toner>>

An absorption peak and a glass transition temperature Tg of the toner were measured by the DSC method. For the DSC method, measurements were taken by increasing the sample temperature from 20° C. to 150° C. at 10° C./min using a differential scanning calorimeter (DSC-60, manufactured by Shimadzu Corporation).

<<Measurement of X-Ray Diffraction>>

The powder x-ray diffraction was measured using RINT 1100 manufactured by Rigaku Corporation, with Cu as a vacuum tube and tube voltage-current of 50 kV-30 mA, using a wide-angle goniometer.

<<Volume-Average Particle Diameter of Toner>>

A volume-average particle diameter of the toner was measured using a particle size measuring device (Coulter Counter TA II, manufactured by Coulter Electronics, Inc.).

First, 0.1 mL to 5 mL of a surfactant (polyoxyethylene alkyl ether; commercially available as DRYWELL) was added as a dispersant to 100 mL to 150 mL of an electrolyte aqueous solution. Here, an aqueous solution having 1% by mass of NaCl prepared using first-class sodium chloride (ISOTON-II, manufactured by Coulter Electronics, Inc.) was used as the electrolyte solution. Further, 2 mg to 20 mg of a measurement sample was added. The electrolyte solution suspended with the sample was subjected to a dispersion process with a ultrasonic dispersing device for 1 minute to 3 minutes. Using the measurement apparatus, the volume and the number of particles of the toner were measured with a 100-μm aperture as an aperture, and a volume-based distribution and a number-based distribution were calculated. From the obtained distributions, a volume-average particle diameter of the toner was obtained.

As channels, the following 13 channels were used, and particles having a particle diameter of 2.00 μm or greater and less than 40.30 μm were covered: 2.00 μm or greater and less than 2.52 μm; 2.52 μm or greater and less than 3.17 μm; 3.17 μm or greater and less than 4.00 μm; 4.00 μm or greater and less than 5.04 μm; 5.04 μm or greater and less than 6.35 μm; 6.35 μm or greater and less than 8.00 μm; 8.00 μm or greater and less than 10.08 μm; 10.08 μm or greater and less than 12.70 μm; 12.70 μm or greater and less than 16.00 μm; 16.00 μm or greater and less than 20.20 μm; 20.20 μm or greater and less than 25.40 μm; 25.40 μm or greater and less than 32.00 μm; and 32.00 μm or greater and less than 40.30 μm.

<<Softening Temperature of Resin>>

The softening temperature (T½) of the resin was measured using an elevated flow tester CFT-500 (manufactured by Shimadzu Corporation) based on a temperature corresponding to ½ of the temperatures from a flow start point to a flow end point when a sample of 1 $cm^2$ is melt and flown under conditions of a die hole diameter of 1 mm; an applied pressure of 20 $kg/cm^2$ and a temperature rise of 6° C./min.

Next, 5% by mass of Pulverized Toner 1 and 95% by mass of a coating ferrite carrier were uniformly mixed using a TURBULA mixer (manufactured by Willy A. Bachofen AG Maschinenfabrik) at 48 rpm for 5 minutes, and Developer 1 was prepared.

Examples 2 to 35 and Comparative Examples 1 to 8

Toners 2 to 43 were obtained by mixing, kneading, pulverizing, and mixing additives similarly to Example 1 using the materials described in Table 1 to Table 5, and releasing agents, charge controlling agents, rolling thickness and fatty acid amide compounds depending on manufacturing examples, in amounts in parts by mass described in Table 6. The physical properties were measured in the same manner as Example 1. The results are shown in Table 7.

Then, Developers 2 to 43 were prepared in the same manner as Example 1.

Regarding Toner 31, however, the colorant was pre-kneaded with Non-crystalline Resin c3 and pure water prior to mixing with other materials to form a masterbatch since it did not disperse well in the resin, and a toner using Colorant p2 was prepared. In forming the toner, by calculating backwards from the amount of Non-crystalline Resin c3 included in the masterbatch, the toner composition was adjusted so that the composition of the raw materials in the final product was that shown in Table 6.

<Preparation of Masterbatch of Pulverized Toner 31>

Non-crystalline resin (C): c3 . . . 100 parts by mass

Colorant: p2 . . . 50 parts by mass

Pure water . . . 50 parts by mass

Of course, a method for preparing a masterbatch is not construed as limited to the above method.

Regarding the metal salicylate compound of the charge controlling agent used in Examples 30 to 35, a metal complex as a zinc salicylate compound (BONTRON E-84, manufactured by Orient Chemical Industries Co., Ltd.) was used.

TABLE 1

| Crystalline polyester (A) | Glass transition temperature (° C.) | Softening temperature (° C.) | Presence of ester bond in General Formula (1) | Alcohol component | Carboxylic acid component |
|---|---|---|---|---|---|
| a1 | 98 | 104 | No | 1,5-pentanediol | fumaric acid |
| a2 | 81 | 86 | No | 1,4-butanediol | terephthalic acid |
| a3 | 84 | 89 | No | 1,5-pentanediol | maleic acid |
| a4 | 116 | 122 | No | 1,6-hexanediol | terephthalic acid |
| a5 | 119 | 126 | No | 1,5-pentanediol | terephthalic acid |
| a6 | 100 | 106 | Yes | 1,6-hexanediol | fumaric acid |

—Synthesis of Crystalline Polyester Resins a1 to a6—

Crystalline Polyester Resins a1 to a6 are resins obtained by using compounds as an alcohol component selected from 1,4-butanediol, 1,5-pentanediol and 1,6-hexanediol and compounds as a carboxylic acid component selected from fumaric acid, maleic acid and terephthalic acid.

Specifically, monomers of the alcohol component and carboxylic acid component shown in Table 1 were subjected to esterification reaction under an ordinary pressure at a temperature of 170° C. to 260° C. with no catalyst. Then, the reaction system was added with 400 ppm of antimony trioxide with respect to the total carboxylic acid component and was subjected to polycondensation at 250° C. while removing glycol under vacuum of 3 Torr from the system, and a crystalline resin was obtained. Here, the crosslinking reaction was conducted until a stirring torque reached 10 kg·cm (100 ppm), and the reaction was terminated by releasing the vacuum condition of the reaction system.

Also, it was confirmed that Crystalline Polyester Resins a1 to a6 were crystalline polyester since they have at least one diffraction peak existing at a location of 2θ=19° to 25° in an x-ray diffraction pattern obtained by a powder x-ray diffraction apparatus.

Figure 4:
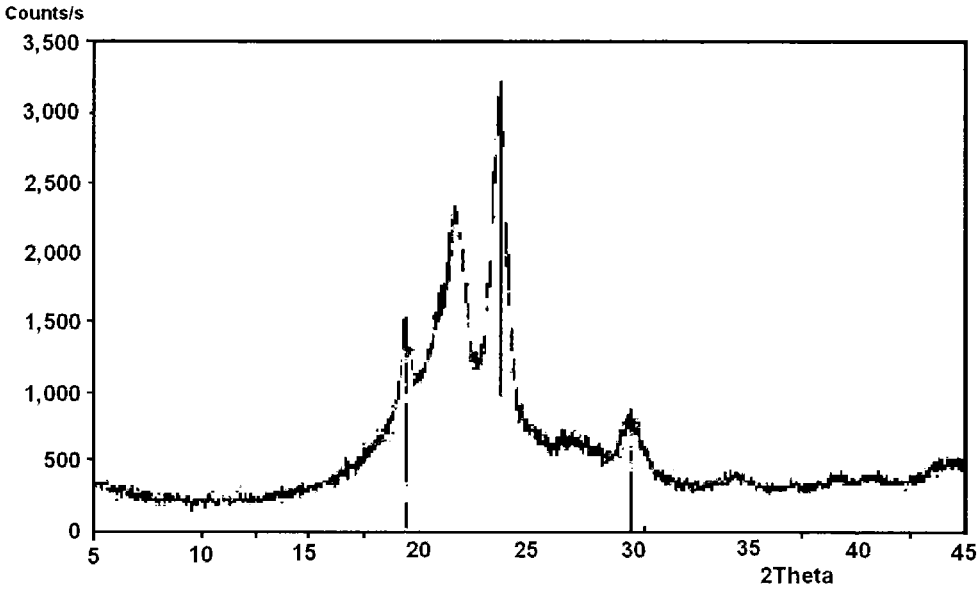
FIG. 4 is a plot of an x-ray diffraction result of Crystalline Polyester Resin 6*a* used in an example.
Figure 5:
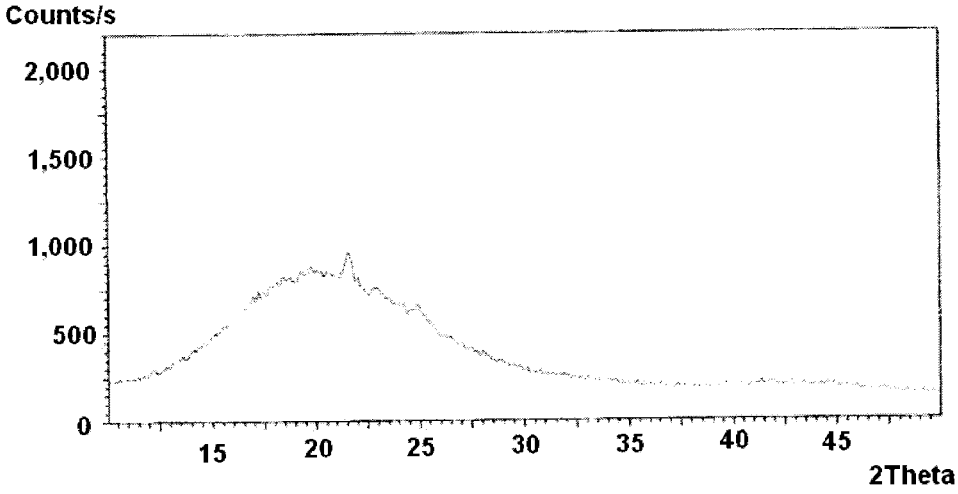
FIG. 5 is a plot of an x-ray diffraction result of a toner of Example 35.

FIG. 4 illustrates an x-ray diffraction result of Crystalline Polyester Resin a6. FIG. 6 illustrates an x-ray diffraction result of the toner of Example 35.

<Measurement of Chloroform Insoluble Matter>

First, 1.0 g of a resin was weighted, to which 50 g of chloroform was added. Then, the solution was sufficiently dissolved, separated by centrifugation and filtered at a room temperature using a qualitative filter No. 5C of JIS Standard (P3801). A filtration residue corresponds to an insoluble content, and an amount of the chloroform insoluble matter was obtained based on a ratio of the mass of the resin used and the mass of the filtration residue (% by mass).

TABLE 2

| Non-crystalline resin (B) | Material | Softening temperature T1/2 (° C.) | Chloroform insoluble matter (% by mass) | Acid component | Alcohol component |
|---|---|---|---|---|---|
| b1 | polyester | 140 | 21 | fumaric acid<br>trimellitic anhydride | bisphenol A (2,2)propylene oxide<br>bisphenol A (2,2)ethylene oxide |
| b2 | polyester | 145 | 4 | isophthalic acid<br>trimellitic anhydride | bisphenol A (2,2)propylene oxide<br>bisphenol A (2,2)ethylene oxide |
| b3 | polyester | 140 | 6 | fumaric acid<br>trimellitic anhydride | bisphenol A (2,2)propylene oxide<br>bisphenol A (2,2)ethylene oxide |
| b4 | polyester | 151 | 39 | dodecenyl succinic anhydride<br>trimellitic anhydride | bisphenol A (2,2)propylene oxide<br>bisphenol A (2,2)ethylene oxide |
| b5 | polyester | 141 | 41 | fumaric acid<br>trimellitic anhydride | ethylene glycol<br>bisphenol A (2,2)propylene oxide<br>bisphenol A (2,2)ethylene oxide |
| b6 | styrene-acrylic | 165 | 13 | styrene-methyl acrylate copolymer resin | |

TABLE 3

| Non-crystalline resin (C) | Material | Softening temperature T1/2 (° C.) | Glass transition temperature Tg (° C.) | Molecular weight distribution main peak | Half-value width | Acid component | Alcohol component |
|---|---|---|---|---|---|---|---|
| c1 | polyester | 100 | 63 | 5,000 | 17,000 | fumaric acid | bisphenol A (2,2)propylene oxide<br>bisphenol A (2,2)ethylene oxide |
| c2 | styrene-acrylic | 135 | 60 | 14,000 | 31,000 | styrene/methyl acrylate copolymer resin | |
| c3 | polyester | 89 | 62 | 4,000 | 13,000 | terephthalic acid<br>dodecenyl succinic anhydride<br>trimellitic anhydride | bisphenol A (2,2)propylene oxide<br>bisphenol A (2,2)ethylene oxide |

—Synthesis of Non-Crystalline Resins b1 to b5, c1, c3—

Non-Crystalline Resins b1 to b5, c1 and c3 are resins obtained as described below.

An aromatic diol component and a monomer selected from ethylene glycol, glycerin, adipic acid, terephthalic acid, isophthalic acid and itaconic acid were subjected to esterification reaction under conditions of a normal pressure, at 170° C. to 260° C. and no catalyst. Then, the reaction system was added with antimony trioxide at a concentration of 400 ppm with respect to the total carboxylic acid component and subjected to polymerization condensation at 250° C. under a vacuum of 3 Torr with glycol being removed out of the system, and a resin was obtained. Here, the crosslinking reaction was performed until the stirring torque reached 10 kg·cm (100 ppm), and the reaction was terminated by releasing the vacuum condition of the reaction system.

Non-Crystalline Resins b1 to b6 and c1 to c3 were confirmed as non-crystalline since no diffraction peak existed in their respective x-ray diffraction patterns.

TABLE 4

| Composite resin (D) | Condensation polymerization unit | Addition polymerization unit |
|---|---|---|
| d1 | polyester | vinyl |
| d2 | polyamide | vinyl |

—Synthesis of Composite Resin d1—

In a 5-liter, four-necked flask equipped with a nitrogen inlet tube, a dehydration tube, a stirrer, a dropping funnel and a thermocouple, 0.8 mol of terephthalic acid, 0.6 mol of fumaric acid, 0.8 mol of trimellitic anhydride, 1.1 mol of bisphenol A (2,2)ethylene oxide and 0.5 mol of bisphenol A (2,2)propylene oxide as condensation polymerization monomers, and 9.5 mol of dibutyl tin oxide as an esterification catalyst were placed. It was heated to 135° C. under a nitrogen atmosphere.

While stirring, 10.5 mol of styrene, 3 mol of acrylic acid and 1.5 mol of 1,2-ethylhexylacrylate as addition polymerization monomers and 0.24 mol of t-butyl hydroperoxide as a polymerization initiator were placed in the dropping funnel, and this mixture was further added dropwise over 5 hours. The reaction was carried out for 6 hours.

Then, the temperature was raised to 210° C. over 3 hours, and a reaction was carried out at 210° C. and 10 kPa until a desired softening temperature was obtained. Thus, Composite Resin d1 was synthesized.

Composite Resin d1 obtained had a softening temperature of 115° C., a glass transition temperature of 58° C. and an acid value of 25 mgKOH/g.

—Synthesis of Composite Resin d2—

Composite Resin d2 was synthesized in the same manner as Composite Resin d1 except that hexamethylene diamine and ε-caprolactam were used as condensation polymerization monomers, and 10.5 mol of styrene, 3 mol of acrylic acid and 1.5 mol of 2-ethylhexyl acrylate were used as addition polymerization monomers in the synthesis of Composite Resin d1.

TABLE 5

| Colorant | Material |
|---|---|
| p1 | carbon black |
| p2 | phthalocyanine blue |

In Tables 6-A, 6-B and 6-C, "pbm" denotes "parts by mass".

TABLE 6-A

| | | Crystalline polyester (A) material/pbm | Non-crystalline resin (B) material/pbm | Non-crystalline polyester (C) material/pbm | Composite resin (D) material/pbm |
|---|---|---|---|---|---|
| Ex. 1 | Toner 1 | a1/4 parts | b1/35 parts | c1/55 parts | d1/10 parts |
| Comp. Ex. 1 | Toner 2 | none | b1/35 parts | c1/55 parts | d1/10 parts |
| Comp. Ex. 2 | Toner 3 | a1/4 parts | none | c1/90 parts | d1/10 parts |
| Comp. Ex. 3 | Toner 4 | a1/4 parts | b1/90 parts | none | d1/10 parts |
| Comp. Ex. 4 | Toner 5 | a1/4 parts | b1/35 parts | c1/55 parts | none |
| Comp. Ex. 5 | Toner 6 | a1/4 parts | b1/35 parts | c2/55 parts | d1/10 parts |
| Comp. Ex. 6 | Toner 7 | a1/4 parts | b1/45 parts | c1/45 parts | d1/10 parts |
| Ex. 2 | Toner 8 | a1/4 parts | b1/40 parts | c1/50 parts | d1/10 parts |
| Ex. 3 | Toner 9 | a1/4 parts | b1/25 parts | c1/65 parts | d1/10 parts |
| Comp. Ex. 7 | Toner 10 | a1/4 parts | b1/20 parts | c1/70 parts | d1/10 parts |
| Ex. 4 | Toner 11 | a1/4 parts | b1/28 parts | c1/62 parts | d1/5 parts |
| Comp. Ex. 8 | Toner 12 | a1/4 parts | b1/30 parts | c1/60 parts | d1/5 parts |
| Ex. 5 | Toner 13 | a2/4 parts | b1/35 parts | c1/55 parts | d1/10 parts |
| Ex. 6 | Toner 14 | a3/4 parts | b1/35 parts | c1/55 parts | d1/10 parts |
| Ex. 7 | Toner 15 | a4/4 parts | b1/35 parts | c1/55 parts | d1/10 parts |
| Ex. 8 | Toner 16 | a5/4 parts | b1/35 parts | c1/55 parts | d1/10 parts |
| Ex. 9 | Toner 17 | a1/1 part | b1/35 parts | c1/55 parts | d1/10 parts |
| Ex. 10 | Toner 18 | a1/2 parts | b1/35 parts | c1/55 parts | d1/10 parts |
| Ex. 11 | Toner 19 | a1/16 parts | b1/35 parts | c1/55 parts | d1/10 parts |
| Ex. 12 | Toner 20 | a1/19 parts | b1/35 parts | c1/55 parts | d1/10 parts |
| Ex. 13 | Toner 21 | a1/4 parts | b1/35 parts | c3/55 parts | d1/10 parts |
| Ex. 14 | Toner 22 | a1/4 parts | b1/35 parts | c3/55 parts | d1/10 parts |
| Ex. 15 | Toner 23 | a1/4 parts | b2/35 parts | c3/55 parts | d1/10 parts |
| Ex. 16 | Toner 24 | a1/4 parts | b3/35 parts | c3/55 parts | d1/10 parts |
| Ex. 17 | Toner 25 | a1/4 parts | b4/35 parts | c3/55 parts | d1/10 parts |
| Ex. 18 | Toner 26 | a1/4 parts | b5/35 parts | c3/55 parts | d1/10 parts |
| Ex. 19 | Toner 27 | a1/4 parts | b3/10 parts | c3/80 parts | d1/10 parts |

TABLE 6-A-continued

| | | Crystalline polyester (A) material/pbm | Non-crystalline resin (B) material/pbm | Non-crystalline polyester (C) material/pbm | Composite resin (D) material/pbm |
|---|---|---|---|---|---|
| Ex. 20 | Toner 28 | a1/4 parts | b3/15 parts | c3/75 parts | d1/10 parts |
| Ex. 21 | Toner 29 | a1/4 parts | b4/15 parts | c3/75 parts | d1/10 parts |
| Ex. 22 | Toner 30 | a1/4 parts | b4/20 parts | c3/70 parts | d1/10 parts |
| Ex. 23 | Toner 31 | a1/4 parts | b1/35 parts | c3/55 parts | d1/10 parts |
| Ex. 24 | Toner 32 | a1/4 parts | b6/35 parts | c2/55 parts | d1/10 parts |
| Ex. 25 | Toner 33 | a1/4 parts | b6/35 parts | c3/55 parts | d1/10 parts |
| Ex. 26 | Toner 34 | a1/4 parts | b1/35 parts | c3/55 parts | d1/10 parts |
| Ex. 27 | Toner 35 | a6/1 part | b1/35 parts | c3/55 parts | d1/10 parts |
| Ex. 28 | Toner 36 | a6/4 parts | b1/35 parts | c3/55 parts | d2/10 parts |
| Ex. 29 | Toner 37 | a1/1 part | b1/35 parts | c3/55 parts | d1/10 parts |
| Ex. 30 | Toner 38 | a6/4 parts | b1/35 parts | c3/55 parts | d1/10 parts |
| Ex. 31 | Toner 39 | a6/4 parts | b1/35 parts | c3/55 parts | d1/10 parts |
| Ex. 32 | Toner 40 | a6/4 parts | b1/35 parts | c3/55 parts | d1/10 parts |
| Ex. 33 | Toner 41 | a6/4 parts | b1/35 parts | c3/55 parts | d1/10 parts |
| Ex. 34 | Toner 42 | a6/4 parts | b1/35 parts | c3/55 parts | d1/10 parts |
| Ex. 35 | Toner 43 | a6/4 parts | b1/35 parts | c3/55 parts | d1/10 parts |

TABLE 6-B

| | Colorant material/pbm | Releasing agent material/pbm | Charge controlling agent material/[parts by mass] |
|---|---|---|---|
| Ex. 1 | p1/14 parts | carnauba wax/6 parts | monoazo metal complex/2 parts |
| Comp. Ex. 1 | p1/14 parts | carnauba wax/6 parts | monoazo metal complex/2 parts |
| Comp. Ex. 2 | p1/14 parts | carnauba wax/6 parts | monoazo metal complex/2 parts |
| Comp. Ex. 3 | p1/14 parts | carnauba wax/6 parts | monoazo metal complex/2 parts |
| Comp. Ex. 4 | p1/14 parts | carnauba wax/6 parts | monoazo metal complex/2 parts |
| Comp. Ex. 5 | p1/14 parts | carnauba wax/6 parts | monoazo metal complex/2 parts |
| Comp. Ex. 6 | p1/14 parts | carnauba wax/6 parts | monoazo metal complex/2 parts |
| Ex. 2 | p1/14 parts | carnauba wax/6 parts | monoazo metal complex/2 parts |
| Ex. 3 | p1/14 parts | carnauba wax/6 parts | monoazo metal complex/2 parts |
| Comp. Ex. 7 | p1/14 parts | carnauba wax/6 parts | monoazo metal complex/2 parts |
| Ex. 4 | p1/14 parts | carnauba wax/6 parts | monoazo metal complex/2 parts |
| Comp. Ex. 8 | p1/14 parts | carnauba wax/6 parts | monoazo metal complex/2 parts |
| Ex. 5 | p1/14 parts | carnauba wax/6 parts | monoazo metal complex/2 parts |
| Ex. 6 | p1/14 parts | carnauba wax/6 parts | monoazo metal complex/2 parts |
| Ex. 7 | p1/14 parts | carnauba wax/6 parts | monoazo metal complex/2 parts |
| Ex. 8 | p1/14 parts | carnauba wax/6 parts | monoazo metal complex/2 parts |
| Ex. 9 | p1/14 parts | carnauba wax/6 parts | monoazo metal complex/2 parts |
| Ex. 10 | p1/14 parts | carnauba wax/6 parts | monoazo metal complex/2 parts |
| Ex. 11 | p1/14 parts | carnauba wax/6 parts | monoazo metal complex/2 parts |
| Ex. 12 | p1/14 parts | carnauba wax/6 parts | monoazo metal complex/2 parts |
| Ex. 13 | p1/14 parts | carnauba wax/6 parts | monoazo metal complex/2 parts |
| Ex. 14 | p1/14 parts | carnauba wax/6 parts | monoazo metal complex/2 parts |
| Ex. 15 | p1/14 parts | carnauba wax/6 parts | monoazo metal complex/2 parts |
| Ex. 16 | p1/14 parts | carnauba wax/6 parts | monoazo metal complex/2 parts |
| Ex. 17 | p1/14 parts | carnauba wax/6 parts | monoazo metal complex/2 parts |
| Ex. 18 | p1/14 parts | carnauba wax/6 parts | monoazo metal complex/2 parts |
| Ex. 19 | p1/14 parts | carnauba wax/6 parts | monoazo metal complex/2 parts |
| Ex. 20 | p1/14 parts | carnauba wax/6 parts | monoazo metal complex/2 parts |
| Ex. 21 | p1/14 parts | carnauba wax/6 parts | monoazo metal complex/2 parts |
| Ex. 22 | p1/14 parts | carnauba wax/6 parts | monoazo metal complex/2 parts |
| Ex. 23 | p2/14 parts | carnauba wax/6 parts | monoazo metal complex/2 parts |
| Ex. 24 | p1/14 parts | carnauba wax/6 parts | monoazo metal complex/2 parts |
| Ex. 25 | p1/14 parts | carnauba wax/6 parts | monoazo metal complex/2 parts |
| Ex. 26 | p1/14 parts | polyethylene wax/6 parts | monoazo metal complex/2 parts |
| Ex. 27 | p1/14 parts | carnauba wax/6 parts | monoazo metal complex/2 parts |
| Ex. 28 | p1/14 parts | carnauba wax/6 parts | monoazo metal complex/2 parts |
| Ex. 29 | p1/14 parts | carnauba wax/6 parts | monoazo metal complex/2 parts |
| Ex. 30 | p1/14 parts | carnauba wax/6 parts | salicylic acid metal compound/2 parts |
| Ex. 31 | p1/14 parts | carnauba wax/6 parts | salicylic acid metal compound/2 parts |
| Ex. 32 | p1/14 parts | carnauba wax/6 parts | salicylic acid metal compound/2 parts |
| Ex. 33 | p1/14 parts | carnauba wax/6 parts | salicylic acid metal compound/2 parts |
| Ex. 34 | p1/14 parts | carnauba wax/6 parts | salicylic acid metal compound/2 parts |
| Ex. 35 | p1/14 parts | carnauba wax/6 parts | salicylic acid metal compound/2 parts |

TABLE 6-C

| | Fatty acid amide pbm | Thickness of kneaded material during cooling [mm] |
|---|---|---|
| Ex. 1 | none | 2.8 |
| Comp. Ex. 1 | none | 2.8 |
| Comp. Ex. 2 | none | 2.8 |
| Comp. Ex. 3 | none | 2.8 |
| Comp. Ex. 4 | none | 2.8 |
| Comp. Ex. 5 | none | 2.8 |
| Comp. Ex. 6 | none | 2.8 |
| Ex. 2 | none | 2.8 |
| Ex. 3 | none | 2.8 |
| Comp. Ex. 7 | none | 2.8 |
| Ex. 4 | none | 2.8 |
| Comp. Ex. 8 | none | 2.8 |
| Ex. 5 | none | 2.8 |
| Ex. 6 | none | 2.8 |
| Ex. 7 | none | 2.8 |
| Ex. 8 | none | 2.8 |
| Ex. 9 | none | 2.8 |
| Ex. 10 | none | 2.8 |
| Ex. 11 | none | 2.8 |
| Ex. 12 | none | 2.8 |
| Ex. 13 | none | 2.8 |
| Ex. 14 | N,N'-ethylene-bis(stearic amide)/2 parts | 2.8 |
| Ex. 15 | N,N'-ethylene-bis(stearic amide)/2 parts | 2.8 |
| Ex. 16 | N,N'-ethylene-bis(stearic amide)/2 parts | 2.8 |
| Ex. 17 | N,N'-ethylene-bis(stearic amide)/2 parts | 2.8 |
| Ex. 18 | N,N'-ethylene-bis(stearic amide)/2 parts | 2.8 |
| Ex. 19 | N,N'-ethylene-bis(stearic amide)/2 parts | 2.8 |
| Ex. 20 | N,N'-ethylene-bis(stearic amide)/2 parts | 2.8 |
| Ex. 21 | N,N'-ethylene-bis(stearic amide)/2 parts | 2.8 |
| Ex. 22 | N,N'-ethylene-bis(stearic amide)/2 parts | 2.8 |
| Ex. 23 | N,N'-ethylene-bis(stearic amide)/2 parts | 2.8 |
| Ex. 24 | N,N'-ethylene-bis(stearic amide)/2 parts | 2.8 |
| Ex. 25 | N,N'-ethylene-bis(stearic amide)/2 parts | 2.8 |
| Ex. 26 | N,N'-ethylene-bis(stearic amide)/2 parts | 2.8 |
| Ex. 27 | N,N'-ethylene-bis(stearic amide)/2 parts | 2.8 |
| Ex. 28 | N,N'-ethylene-bis(stearic amide)/2 parts | 2.8 |
| Ex. 29 | N,N'-ethylene-bis(stearic amide)/2 parts | 2.6 |
| Ex. 30 | N,N'-ethylene-bis(stearic amide)/2 parts | 2.8 |
| Ex. 31 | N,N'-ethylene-bis(stearic amide)/2 parts | 2.8 |
| Ex. 32 | N,N'-ethylene-bis(stearic amide)/2 parts | 2.8 |
| Ex. 33 | N,N'-ethylene-bis(stearic amide)/2 parts | 2.8 |
| Ex. 34 | N,N'-ethylene-bis(stearic amide)/2 parts | 2.2 |
| Ex. 35 | N,N'-ethylene-bis(stearic amide)/2 parts | 2.8 |

TABLE 7-A

| | | Crystalline polyester (A) | Non-crystalline resin (B) | Non-crystalline polyester (C) | Composite resin (D) |
|---|---|---|---|---|---|
| Ex. 1 | Toner 1 | a1 | b1 | c1 | d1 |
| Comp. Ex. 1 | Toner 2 | — | b1 | c1 | d1 |
| Comp. Ex. 2 | Toner 3 | a1 | — | c1 | d1 |
| Comp. Ex. 3 | Toner 4 | a1 | b1 | — | d1 |
| Comp. Ex. 4 | Toner 5 | a1 | b1 | c1 | — |
| Comp. Ex. 5 | Toner 6 | a1 | b1 | c2 | d1 |
| Comp. Ex. 6 | Toner 7 | a1 | b1 | c1 | d1 |
| Ex. 2 | Toner 8 | a1 | b1 | c1 | d1 |
| Ex. 3 | Toner 9 | a1 | b1 | c1 | d1 |
| Comp. Ex. 7 | Toner 10 | a1 | b1 | c1 | d1 |
| Ex. 4 | Toner 11 | a1 | b1 | c1 | d1 |
| Comp. Ex. 8 | Toner 12 | a1 | b1 | c1 | d1 |
| Ex. 5 | Toner 13 | a2 | b1 | c1 | d1 |
| Ex. 6 | Toner 14 | a3 | b1 | c1 | d1 |
| Ex. 7 | Toner 15 | a4 | b1 | c1 | d1 |
| Ex. 8 | Toner 16 | a5 | b1 | c1 | d1 |
| Ex. 9 | Toner 17 | a1 | b1 | c1 | d1 |
| Ex. 10 | Toner 18 | a1 | b1 | c1 | d1 |
| Ex. 11 | Toner 19 | a1 | b1 | c1 | d1 |
| Ex. 12 | Toner 20 | a1 | b1 | c1 | d1 |
| Ex. 13 | Toner 21 | a1 | b1 | c3 | d1 |
| Ex. 14 | Toner 22 | a1 | b1 | c3 | d1 |
| Ex. 15 | Toner 23 | a1 | b2 | c3 | d1 |
| Ex. 16 | Toner 24 | a1 | b3 | c3 | d1 |
| Ex. 17 | Toner 25 | a1 | b4 | c3 | d1 |
| Ex. 18 | Toner 26 | a1 | b5 | c3 | d1 |
| Ex. 19 | Toner 27 | a1 | b3 | c3 | d1 |
| Ex. 20 | Toner 28 | a1 | b3 | c3 | d1 |
| Ex. 21 | Toner 29 | a1 | b4 | c3 | d1 |
| Ex. 22 | Toner 30 | a1 | b4 | c3 | d1 |
| Ex. 23 | Toner 31 | a1 | b1 | c3 | d1 |
| Ex. 24 | Toner 32 | a1 | b6 | c2 | d1 |
| Ex. 25 | Toner 33 | a1 | b6 | c3 | d1 |
| Ex. 26 | Toner 34 | a1 | b1 | c3 | d1 |
| Ex. 27 | Toner 35 | a6 | b1 | c3 | d1 |
| Ex. 28 | Toner 36 | a6 | b1 | c3 | d2 |
| Ex. 29 | Toner 37 | a1 | b1 | c3 | d1 |
| Ex. 30 | Toner 38 | a6 | b1 | c3 | d1 |
| Ex. 31 | Toner 39 | a6 | b1 | c3 | d1 |
| Ex. 32 | Toner 40 | a6 | b1 | c3 | d1 |
| Ex. 33 | Toner 41 | a6 | b1 | c3 | d1 |
| Ex. 34 | Toner 42 | a6 | b1 | c3 | d1 |
| Ex. 35 | Toner 43 | a6 | b1 | c3 | d1 |

TABLE 7-B

| | Colorant | Toner MW main peak | Toner MW half-value width | DSC peak temp. in 90° C.-130° C. [° C.] | Endothermic energy amt. in 90° C.-130° C. [J/g] |
|---|---|---|---|---|---|
| Ex. 1 | p1 | 7,400 | 13,000 | 108 | 5 |
| Comp. Ex. 1 | p1 | 7,400 | 13,000 | — | — |
| Comp. Ex. 2 | p1 | 7,400 | 13,000 | 108 | 5 |
| Comp. Ex. 3 | p1 | 7,600 | 105,000 | 108 | 5 |
| Comp. Ex. 4 | p1 | 7,400 | 13,000 | 108 | 5 |
| Comp. Ex. 5 | p1 | 9,500 | 14,000 | 108 | 5 |
| Comp. Ex. 6 | p1 | 900 | 9,000 | 108 | 5 |
| Ex. 2 | p1 | 1,100 | 10,000 | 108 | 5 |
| Ex. 3 | p1 | 9,800 | 13,800 | 108 | 5 |
| Comp. Ex. 7 | p1 | 11,000 | 14,100 | 108 | 5 |
| Ex. 4 | p1 | 8,800 | 14,500 | 108 | 5 |
| Comp. Ex. 8 | p1 | 9,000 | 16,000 | 108 | 5 |
| Ex. 5 | p1 | 7,400 | 13,000 | 88 | 5 |
| Ex. 6 | p1 | 7,400 | 13,000 | 92 | 5 |
| Ex. 7 | p1 | 7,400 | 13,000 | 127 | 5 |
| Ex. 8 | p1 | 7,400 | 13,000 | 131 | 5 |
| Ex. 9 | p1 | 7,400 | 13,000 | 108 | 0.5 |
| Ex. 10 | p1 | 7,400 | 13,000 | 108 | 2 |
| Ex. 11 | p1 | 7,400 | 13,000 | 108 | 14 |
| Ex. 12 | p1 | 7,400 | 13,000 | 108 | 16 |
| Ex. 13 | p1 | 7,000 | 13,000 | 108 | 5 |
| Ex. 14 | p1 | 6,500 | 13,000 | 108 | 5 |

TABLE 7-B-continued

| | Colorant | Toner MW main peak | Toner MW half-value width | DSC peak temp. in 90° C.-130° C. [° C.] | Endothermic energy amt. in 90° C.-130° C. [J/g] |
|---|---|---|---|---|---|
| Ex. 15 | p1 | 3,400 | 8,900 | 108 | 5 |
| Ex. 16 | p1 | 3,800 | 9,500 | 108 | 5 |
| Ex. 17 | p1 | 7,500 | 13,100 | 108 | 5 |
| Ex. 18 | p1 | 8,000 | 13,400 | 108 | 5 |
| Ex. 19 | p1 | 3,500 | 8,500 | 108 | 5 |
| Ex. 20 | p1 | 4,000 | 9,000 | 108 | 5 |
| Ex. 21 | p1 | 9,300 | 12,800 | 108 | 5 |
| Ex. 22 | p1 | 9,500 | 13,000 | 108 | 5 |
| Ex. 23 | p2 | 7,000 | 12,500 | 108 | 5 |
| Ex. 24 | p1 | 9,000 | 13,500 | 108 | 5 |
| Ex. 25 | p1 | 7,700 | 13,000 | 108 | 5 |
| Ex. 26 | p1 | 6,900 | 12,500 | 108 | 5 |
| Ex. 27 | p1 | 7,200 | 12,500 | 110 | 5 |
| Ex. 28 | p1 | 7,000 | 12,500 | 110 | 5 |
| Ex. 29 | p1 | 6,000 | 12,500 | 108 | 2 |
| Ex. 30 | p1 | 7,000 | 12,500 | 110 | 5 |
| Ex. 31 | p1 | 7,000 | 12,500 | 110 | 5 |
| Ex. 32 | p1 | 7,000 | 12,500 | 110 | 5 |
| Ex. 33 | p1 | 7,000 | 12,500 | 110 | 5 |
| Ex. 34 | p1 | 7,000 | 12,500 | 110 | 3 |
| Ex. 35 | p1 | 7,000 | 12,500 | 110 | 5 |

TABLE 7-C

| | Releasing agent | Charge controlling agent | Fatty acid amide | X-ray diff. peak in 19°-25° | Vol. avg. particle diam.[μm] |
|---|---|---|---|---|---|
| Ex. 1 | carnauba wax | monoazo metal complex | no | yes | 6.5 |
| Comp. Ex. 1 | carnauba wax | monoazo metal complex | no | no | 6.5 |
| Comp. Ex. 2 | carnauba wax | monoazo metal complex | no | yes | 6.5 |
| Comp. Ex. 3 | carnauba wax | monoazo metal complex | no | yes | 6.5 |
| Comp. Ex. 4 | carnauba wax | monoazo metal complex | no | yes | 6.5 |
| Comp. Ex. 5 | carnauba wax | monoazo metal complex | no | yes | 6.5 |
| Comp. Ex. 6 | carnauba wax | monoazo metal complex | no | yes | 6.5 |
| Ex. 2 | carnauba wax | monoazo metal complex | no | yes | 6.5 |
| Ex. 3 | carnauba wax | monoazo metal complex | no | yes | 6.5 |
| Comp. Ex. 7 | carnauba wax | monoazo metal complex | no | yes | 6.5 |
| Ex. 4 | carnauba wax | monoazo metal complex | no | yes | 6.5 |
| Comp. Ex. 8 | carnauba wax | monoazo metal complex | no | yes | 6.5 |
| Ex. 5 | carnauba wax | monoazo metal complex | no | yes | 6.5 |
| Ex. 6 | carnauba wax | monoazo metal complex | no | yes | 6.5 |
| Ex. 7 | carnauba wax | monoazo metal complex | no | yes | 6.5 |
| Ex. 8 | carnauba wax | monoazo metal complex | no | yes | 6.5 |
| Ex. 9 | carnauba wax | monoazo metal complex | no | yes | 6.5 |
| Ex. 10 | carnauba wax | monoazo metal complex | no | yes | 6.5 |
| Ex. 11 | carnauba wax | monoazo metal complex | no | yes | 6.5 |
| Ex. 12 | carnauba wax | monoazo metal complex | no | yes | 6.5 |
| Ex. 13 | carnauba wax | monoazo metal complex | no | yes | 6.5 |
| Ex. 14 | carnauba wax | monoazo metal complex | yes | yes | 6.5 |
| Ex. 15 | carnauba wax | monoazo metal complex | yes | yes | 6.5 |
| Ex. 16 | carnauba wax | monoazo metal complex | yes | yes | 6.5 |
| Ex. 17 | carnauba wax | monoazo metal complex | yes | yes | 6.5 |
| Ex. 18 | carnauba wax | monoazo metal complex | yes | yes | 6.5 |
| Ex. 19 | carnauba wax | monoazo metal complex | yes | yes | 6.5 |
| Ex. 20 | carnauba wax | monoazo metal complex | yes | yes | 6.5 |
| Ex. 21 | carnauba wax | monoazo metal complex | yes | yes | 6.5 |
| Ex. 22 | carnauba wax | monoazo metal complex | yes | yes | 6.5 |
| Ex. 23 | carnauba wax | monoazo metal complex | yes | yes | 6.5 |
| Ex. 24 | carnauba wax | monoazo metal complex | yes | yes | 6.5 |
| Ex. 25 | carnauba wax | monoazo metal complex | yes | yes | 6.5 |
| Ex. 26 | polyethylene wax | monoazo metal complex | yes | yes | 6.5 |
| Ex. 27 | carnauba wax | monoazo metal complex | yes | yes | 6.5 |
| Ex. 28 | carnauba wax | monoazo metal complex | yes | yes | 6.5 |
| Ex. 29 | carnauba wax | monoazo metal complex | yes | no | 6.5 |
| Ex. 30 | carnauba wax | salicylic acid metal compound | yes | yes | 3.8 |
| Ex. 31 | carnauba wax | salicylic acid metal compound | yes | yes | 4.2 |
| Ex. 32 | carnauba wax | salicylic acid metal compound | yes | yes | 9.0 |
| Ex. 33 | carnauba wax | salicylic acid metal compound | yes | yes | 11.0 |
| Ex. 34 | carnauba wax | salicylic acid metal compound | yes | yes | 6.5 |
| Ex. 35 | carnauba wax | salicylic acid metal compound | yes | yes | 6.5 |

<Image Forming Apparatus>

The following image evaluations were performed using the image forming apparatus illustrated in FIG. 6. Pulverized Toner Developers 1 to 43 were contained in the developing unit 105D of FIG. 6. The developing unit 105D had the same configuration as the developing apparatus illustrated in FIG. 1. Here, developing units 105A to C were not used.

Example 36

An evaluation was performed in the same manner as Example 35 using Toner 43 and Developer 43 except that the developing unit 105D in the image forming apparatus illustrated in FIG. 6 was changed to the developing apparatus illustrated in FIG. 10.

Example 37

An evaluation was performed in the same manner as Example 35 using Toner 43 and Developer 43 except that the developing unit 105D in the image forming apparatus illustrated in FIG. 6 was changed to the developing apparatus illustrated in FIG. 13.

<Low-Temperature Fixing Property, Hot-Offset Resistance and Fine-Line Reproducibility (Initial)>

Using the image forming apparatus, images were printed with prepared Developers 1 to 43. A solid image with a deposited amount of 0.4 mg/cm$^2$ was printed on paper (TYPE6200, manufactured by Ricoh Company, Ltd.) through exposing, developing and transfer steps. A line speed of fixing was set at 160 mm/sec. Images were printed with a fixing temperature incremented by 5° C., and a lower-limit temperature (lower-limit fixing temperature: low-temperature fixing property) where no cold offset occurs and an upper-limit temperature (upper-limit fixing temperature: hot-offset resistance) where no hot offset occurs were measured. An NIP width of the fixing apparatus was 11 mm. Also, a character chart having an image area ratio of 5% (a character has a size of about 2 mm×2 mm) was printed out separately with a pulverized toner at a fixing temperature of the lower-limit fixing temperature+20° C., and fine-line reproducibility was visually evaluated. The results are shown in Table 8-A.

<<Evaluation Criteria of Low-Temperature Fixing Property>>

A: less than 130° C.
B: 130° C. or greater and less than 140° C.
C: 140° C. or greater and less than 150° C.
D: 150° C. or greater and less than 160° C.
E: 160° C. or greater <<Evaluation Criteria of Hot-Offset Resistance>>

A: 200° C. or greater
B: 190° C. or greater and less than 200° C.
C: 180° C. or greater and less than 190° C.
D: 170° C. or greater and less than 180° C.
E: less than 170° C.

<<Evaluation Criteria of Fine-Line Reproducibility (Initial)>>

A: particularly favorable
B: favorable
C: generally acceptable
D: no practical problem
E: not acceptable <Smear Resistance>

At a lower-limit fixing temperature, a half-tone image having an image area ratio of 60% and a toner deposited amount of 0.40 mg/cm$^2$±0.1 mg/cm$^2$ was printed out on paper (TYPE6200, manufactured by Ricoh Company, Ltd.). The fixed image portion was rubbed 10 times with a white cotton cloth (No. 3 cotton JIS L0803) using a clock meter, and an ID of the smear on the cloth (hereinafter referred to as smear ID) was measured and evaluated under the following criteria. The smear ID was measured using a colorimeter (X-RITE 938). Here, the color of Pulverized Toner 31 was measured with cyan, and the color of the other toners was measured with black. The results are shown in Table 8-B.

[Evaluation Criteria]

A: Smear ID was 0.20 or less
B: Smear ID was 0.21 to 0.35
D: Smear ID was 0.36 to 0.55
E: Smear ID was 0.56 or greater <Fine-Line Reproducibility (Over Time)>

After evaluation of the initial fine-line reproducibility, a character chart having an image area ratio of 5% (a character has a size of about 2 mm×2 mm) was continuously printed out on 100,000 sheets at a fixing temperature of the lower-limit fixing temperature+20° C. while the respective toners prepared as above were supplied, and fine-line reproducibility over time was visually evaluated. The same evaluation criteria as the initial fine-line reproducibility were used. The results are shown in Table 8-A.

<Heat-Resistant Storage Stability>

In a 30-mL screw-top vial, 10 g of each of the toners prepared as above was placed. The vial was tapped 100 times with a tapping machine and then stored in a thermostat at 50° C. for 24 hours. The vial was returned to a room temperature, and the toner was measured for its penetration using a penetration testing machine as an evaluation of heat-resistant storage stability. The results are shown in Table 8-B.

[Evaluation Criteria]

A: complete penetration
B: 20 mm or greater
C: 15 mm or greater and less than 20 mm
D: 10 mm or greater and less than 15 mm
E: less than 10 mm <Inconsistent Density>

After the evaluation of the fine-line reproducibility (over time), three completely solid image was printed consecutively, and inconsistent density of the printed images was visually evaluated based on the following criteria. The results are shown in Table 8-B.

[Evaluation Criteria]

A: No inconsistent density was present in the image at all.
B: Non-problematic inconsistent density was slightly observed.
D: Non-problematic inconsistent density was observed.
E: Inconsistent density beyond acceptable range was very noticeable.

TABLE 8-A

| | | Low-temp. fixing property | Hot-offset resistance | Fine-line repro. (initial) | Fine-line repro. (over time) |
|---|---|---|---|---|---|
| Ex. 1 | Toner 1 | B | B | A | A |
| Comp. Ex. 1 | Toner 2 | E | B | A | A |
| Comp. Ex. 2 | Toner 3 | A | E | A | B |
| Comp. Ex. 3 | Toner 4 | E | A | A | A |
| Comp. Ex. 4 | Toner 5 | B | B | B | D |
| Comp. Ex. 5 | Toner 6 | E | C | A | A |
| Comp. Ex. 6 | Toner 7 | B | E | A | B |
| Ex. 2 | Toner 8 | B | D | A | B |
| Ex. 3 | Toner 9 | D | B | A | A |
| Comp. Ex. 7 | Toner 10 | E | B | A | A |

TABLE 8-A-continued

| | | Low-temp. fixing property | Hot-offset resistance | Fine-line repro. (initial) | Fine-line repro. (over time) |
|---|---|---|---|---|---|
| Ex. 4 | Toner 11 | D | B | A | A |
| Comp. Ex. 8 | Toner 12 | E | B | A | A |
| Ex. 5 | Toner 13 | B | D | A | A |
| Ex. 6 | Toner 14 | B | C | A | A |
| Ex. 7 | Toner 15 | C | B | A | A |
| Ex. 8 | Toner 16 | D | B | A | A |
| Ex. 9 | Toner 17 | B | B | A | A |
| Ex. 10 | Toner 18 | B | B | A | A |
| Ex. 11 | Toner 19 | A | B | A | A |
| Ex. 12 | Toner 20 | A | B | A | A |
| Ex. 13 | Toner 21 | B | B | A | A |
| Ex. 14 | Toner 22 | A | B | A | A |
| Ex. 15 | Toner 23 | B | D | A | B |
| Ex. 16 | Toner 24 | B | C | A | B |
| Ex. 17 | Toner 25 | C | A | A | A |
| Ex. 18 | Toner 26 | D | A | A | A |
| Ex. 19 | Toner 27 | A | D | A | B |
| Ex. 20 | Toner 28 | A | C | A | B |
| Ex. 21 | Toner 29 | C | A | A | A |
| Ex. 22 | Toner 30 | D | A | A | A |
| Ex. 23 | Toner 31 | A | C | A | A |
| Ex. 24 | Toner 32 | C | C | A | A |
| Ex. 25 | Toner 33 | A | C | A | A |
| Ex. 26 | Toner 34 | A | C | A | A |
| Ex. 27 | Toner 35 | A | B | A | A |
| Ex. 28 | Toner 36 | A | B | C | D |
| Ex. 29 | Toner 37 | C | B | B | B |
| Ex. 30 | Toner 38 | A | A | C | D |
| Ex. 31 | Toner 39 | A | A | B | C |
| Ex. 32 | Toner 40 | A | A | B | B |
| Ex. 33 | Toner 41 | A | A | C | C |
| Ex. 34 | Toner 42 | A | A | A | A |
| Ex. 35 | Toner 43 | A | A | A | A |
| Ex. 36 | Toner 43 | A | A | A | A |
| Ex. 37 | Toner 43 | A | A | A | A |

TABLE 8-B

| | | Heat-resistant storage stability | Smear resistance | Inconsistent density |
|---|---|---|---|---|
| Ex. 1 | Toner 1 | B | B | B |
| Comp. Ex. 1 | Toner 2 | D | B | B |
| Comp. Ex. 2 | Toner 3 | E | B | B |
| Comp. Ex. 3 | Toner 4 | B | B | B |
| Comp. Ex. 4 | Toner 5 | E | B | D |
| Comp. Ex. 5 | Toner 6 | C | B | B |
| Comp. Ex. 6 | Toner 7 | E | B | B |
| Ex. 2 | Toner 8 | C | B | B |
| Ex. 3 | Toner 9 | B | B | B |
| Comp. Ex. 7 | Toner 10 | B | B | B |
| Ex. 4 | Toner 11 | B | B | B |
| Comp. Ex. 8 | Toner 12 | B | B | B |
| Ex. 5 | Toner 13 | D | B | B |
| Ex. 6 | Toner 14 | C | B | B |
| Ex. 7 | Toner 15 | B | B | B |
| Ex. 8 | Toner 16 | B | B | B |
| Ex. 9 | Toner 17 | D | B | B |
| Ex. 10 | Toner 18 | C | B | B |
| Ex. 11 | Toner 19 | C | B | B |
| Ex. 12 | Toner 20 | D | B | B |
| Ex. 13 | Toner 21 | C | B | B |
| Ex. 14 | Toner 22 | B | A | B |
| Ex. 15 | Toner 23 | C | A | B |
| Ex. 16 | Toner 24 | C | A | B |
| Ex. 17 | Toner 25 | A | A | B |
| Ex. 18 | Toner 26 | A | A | B |
| Ex. 19 | Toner 27 | D | A | B |
| Ex. 20 | Toner 28 | D | A | B |
| Ex. 21 | Toner 29 | A | A | B |
| Ex. 22 | Toner 30 | A | A | B |
| Ex. 23 | Toner 31 | B | A | B |

TABLE 8-B-continued

| | | Heat-resistant storage stability | Smear resistance | Inconsistent density |
|---|---|---|---|---|
| Ex. 24 | Toner 32 | A | A | B |
| Ex. 25 | Toner 33 | A | A | B |
| Ex. 26 | Toner 34 | B | B | B |
| Ex. 27 | Toner 35 | A | A | B |
| Ex. 28 | Toner 36 | C | A | D |
| Ex. 29 | Toner 37 | D | A | B |
| Ex. 30 | Toner 38 | A | A | B |
| Ex. 31 | Toner 39 | A | A | B |
| Ex. 32 | Toner 40 | A | A | B |
| Ex. 33 | Toner 41 | A | A | D |
| Ex. 34 | Toner 42 | B | A | B |
| Ex. 35 | Toner 43 | A | A | B |
| Ex. 36 | Toner 43 | A | A | A |
| Ex. 37 | Toner 43 | A | A | A |

Aspects of the present invention are as follows.

<1> A toner for forming an electrophotographic image, including at least four types of binder resins, wherein the binder resins include at least:

a crystalline polyester resin (A);

a non-crystalline resin (B);

a non-crystalline resin (C); and a composite resin (D) which includes a condensation polymerization resin unit and an addition polymerization resin unit, wherein the non-crystalline resin (B) includes a chloroform insoluble matter, wherein the non-crystalline resin (C) has a softening temperature (T½) lower than that of the non-crystalline resin (B) by 25° C. or more, and wherein the toner has a main peak between 1,000 to 10,000 in a molecular weight distribution obtained by GPC from a tetrahydrofuran soluble matter, and the toner has a half-value width of the molecular weight distribution of 15,000 or less.

<2> The toner for forming an electrophotographic image according to <1>, wherein the toner has an endothermic peak in a range of 90° C. to 130° C. in an endothermic peak measurement of the toner by a DSC.

<3> The toner for forming an electrophotographic image according to <2>, wherein the toner has an endothermic energy amount of the endothermic peak of 1 J/g to 15 J/g in the endothermic peak measurement of the toner by the DSC.

<4> The toner for forming an electrophotographic image according to any one of <1> to <3>, wherein the non-crystalline resin (C) has a main peak between 1,000 and 10,000 in a molecular weight distribution obtained by GPC from a tetrahydrofuran soluble matter, and the non-crystalline resin (C) has a half-value width of the molecular weight distribution of 15,000 or less.

<5> The toner for forming an electrophotographic image according to any one of <1> to <4>, wherein the toner includes a fatty acid amide compound.

<6> The toner for forming an electrophotographic image according to any one of <1> to <5>, wherein the non-crystalline resin (B) includes 5% by mass to 40% by mass of the chloroform insoluble matter.

<7> The toner for forming an electrophotographic image according to any one of <1> to <6>, wherein the toner includes 2% by mass to 20% by mass of the chloroform insoluble matter.

<8> The toner for forming an electrophotographic image according to any one of <1> to <7>, wherein the toner includes a carbon black.

<9> The toner for forming an electrophotographic image according to any one of <1> to <8>, wherein the non-crystalline resin (B) and the non-crystalline resin (C) are polyesters.

<10> The toner for forming an electrophotographic image according to any one of <1> to <9>, wherein the toner includes a salicylic acid metal compound.

<11> The toner for forming an electrophotographic image according to any one of <1> to <10>, wherein the toner includes a releasing agent, and the releasing agent includes carnauba wax.

<12> The toner for forming an electrophotographic image according to any one of <1> to <11>, wherein the crystalline polyester resin (A) includes an ester bond in a molecular main chain thereof represented by a general formula below:

$$[—OCO—R—COO—(CH_2)_n—]$$

where R represents a straight-chain unsaturated aliphatic dicarboxylic residue having 2 to 20 carbon atoms, and n represents an integer of 2 to 20.

<13> The toner for forming an electrophotographic image according to any one of <1> to <12>, wherein the composite resin (D) is a composite resin including a polyester condensation polymerization resin unit and a vinyl resin addition polymerization unit.

<14> The toner for forming an electrophotographic image according to any one of <1> to <13>, wherein the toner has at least one diffraction peak at $2\theta=19°$ to $25°$ in an x-ray diffraction pattern by a powder x-ray diffraction apparatus.

<15> The toner for forming an electrophotographic image according to any one of <1> to <14>, wherein the toner has a volume-average particle diameter of 4 μm to 10 μm.

<16> A method for forming the toner for forming an electrophotographic image according to any one of <1> to <15>, including:

melt-kneading a toner material including at least four types of binder resins; and cooling the melt-kneaded material, wherein the melt-kneaded material has a thickness of 2.5 mm or greater in the cooling.

<17> An image forming method, includes at least:

forming an electrostatic latent image, wherein the electrostatic latent image is formed on an electrostatic latent image bearing member;

developing, wherein a visible image is formed by developing the electrostatic latent image using a toner;

transferring, wherein the visible image is transferred to a recording medium; and fixing, wherein the transferred image transferred on the recording medium is fixed, wherein the toner is the toner for forming an electrophotographic image according to any one of <1> to <15>.

<18> The image forming method according to <17>, wherein the image forming method includes:

a developer bearing member, which rotates while supporting on a surface thereof a two-component developer including a toner for forming an electrophotographic image and a magnetic carrier, and which supplies the toner to a latent image on a surface of a latent image bearing member at a location facing the latent image bearing member for development; and a developer supplying path equipped with a developer supplying and conveying member, which conveys the developer along an axial direction of the developer bearing member and supplies the developer to the developer bearing member;

wherein the developer which has passed the location facing the latent image bearing member is collected by developer paths, wherein the developer paths include a developer conveying member, are partitioned by a partition member from the developer supplying path at a center excluding at least both ends in a longitudinal direction and convey the developer along an axial direction of the developer bearing member, wherein the image forming method includes:

the developer bearing member;

the developer supplying path equipped with the developer supplying and conveying member, which conveys the developer along an axial direction of the developer bearing member and supplies the developer to the developer bearing member;

a developer collecting path equipped with a developer collecting and conveying member, which conveys the developer collected from the developer bearing member after passing a location facing the latent image bearing member along an axial direction of the developer bearing member as well as in the same direction as the developer supplying and conveying member; and a developer stirring path, which is equipped with a developer stirring and conveying member and supplies the developer to the developer supplying path, wherein the developer stirring and conveying member is supplied with: an excess developer, which has been unused for developing and conveyed to a most downstream side of a conveying direction of the developer supplying path; and a collected developer, which has been collected from the developer bearing member and conveyed to a most downstream side of a conveying direction of the developer collecting path, and the developer stirring and conveying member conveys the developer in a direction opposite to the developer supplying and conveying member along an axial direction of the developer bearing member while stirring the excess developer and the collected developer;

wherein the three developer paths including the developer collecting path, the developer supplying path and the developer stirring path are respectively partitioned by the partition members, wherein the developer stirring path and the developer collecting path are allocated substantially at the same elevation, and wherein the developer supplying path is allocated at an elevation greater than the other two developer paths.

<19> The image forming method according to <17>, wherein the image forming method includes:

a developer bearing member, which rotates while supporting on a surface thereof a two-component developer including a toner for forming an electrophotographic image and a magnetic carrier, and which supplies the toner to a latent image on a surface of a latent image bearing member at a location facing the latent image bearing member for development; and a developer supplying path equipped with a developer supplying and conveying member, which conveys the developer along an axial direction of the developer bearing member and supplies the developer to the developer bearing member;

wherein the developer which has passed the location facing the latent image bearing member is collected by developer paths, wherein the developer paths include a developer conveying member, are partitioned by a partition member from the developer supplying path at a center excluding at least both ends in a longitudinal direction and convey the developer along an axial direction of the developer bearing member, wherein the image forming method includes:

the developer bearing member;

the developer supplying path equipped with the developer supplying and conveying member, which conveys the developer along an axial direction of the developer bearing member and supplies the developer to the developer bearing member; and a developer stirring path, which is equipped with a developer stirring and conveying member and supplies the developer to the developer supplying path, wherein the developer stirring and conveying member is supplied with an excess developer, which has been unused for developing and conveyed to a most downstream side of a conveying direction of the developer supplying path and the developer stirring and conveying member conveys the developer in a direction opposite to the developer supplying and conveying member along an axial direction of the developer bearing member while stirring the excess developer, wherein the developer supplying path and the developer stirring path are partitioned by the partition member at a center excluding at least both ends in a longitudinal direction, and wherein the developer which has passed the location facing the latent image bearing member is collected by a developer stirring path, is mixed with the developer conveyed in the developer stirring path and is then supplied to the developer supplying path.

<20> A process cartridge, including;

an image bearing member; and a developing unit which forms a visible image of an electrostatic latent image formed on the image bearing member with a developer including a toner and a carrier, wherein the process cartridge integrally supports the image bearing member and the developing unit, wherein the process cartridge is detachably mounted on an image forming apparatus body, and wherein the toner is the toner for forming an electrophotographic image according to any one of <1> to <15>.

This application claims priority to Japanese applications No. 2011-201954 filed on Sep. 15, 2011 and No. 2012-199607 filed on Sep. 11, 2012, and incorporated herein by reference.

What is claimed is:

1. A toner for forming an electrophotographic image, wherein said toner comprises at least the following four binder resins:

a crystalline polyester resin (A);

a non-crystalline resin (B);

a non-crystalline resin (C); and a composite resin (D) which comprises a condensation polymerization resin unit and an addition polymerization resin unit, wherein the non-crystalline resin (B) is present in the toner in an amount of 10-40% by mass relative to the total mass of the toner, is different from non-crystalline resin (C), and comprises a chloroform insoluble matter, wherein the non-crystalline resin (C) is present in the toner in an amount of 50-90% by mass relative to the total mass of the toner, is different from non-crystalline resin (B), and has a softening temperature (T½) lower than that of the non-crystalline resin (B) by 25° C. or more, and wherein the toner has a main peak between 1,000 to 10,000 in a molecular weight distribution obtained by GPC from a tetrahydrofuran soluble matter, and the toner has a half-value width of the molecular weight distribution of 15,000 or less.

2. The toner for forming an electrophotographic image according to claim 1, wherein the toner has an endothermic peak in a range of 90° C. to 130° C. in an endothermic peak measurement of the toner by a DSC.

3. The toner for forming an electrophotographic image according to claim 2, wherein the non-crystalline resin (C) has an endothermic energy amount of the endothermic peak of 1 J/g to 15 J/g in the endothermic peak measurement of the toner by the DSC.

4. The toner for forming an electrophotographic image according to claim 1, wherein the non-crystalline resin (C) has a main peak between 1,000 and 10,000 in a molecular weight distribution obtained by GPC from a tetrahydrofuran soluble matter, and the non-crystalline resin (C) has a half-value width of the molecular weight distribution of 15,000 or less.

5. The toner for forming an electrophotographic image according to claim 1, wherein the toner further comprises a fatty acid amide compound.

6. The toner for forming an electrophotographic image according to claim 1, wherein the non-crystalline resin (B) comprises 5% by mass to 40% by mass of the chloroform insoluble matter.

7. The toner for forming an electrophotographic image according to claim 1, wherein the toner comprises 2% by mass to 20% by mass of the chloroform insoluble matter relative to the total mass of the toner.

8. The toner for forming an electrophotographic image according to claim 1, wherein the toner further comprises a carbon black.

9. The toner for forming an electrophotographic image according to claim 1, wherein the non-crystalline resin (B) and the non-crystalline resin (C) are polyesters.

10. The toner for forming an electrophotographic image according to claim 1, wherein the toner further comprises a salicylic acid metal compound.

11. The toner for forming an electrophotographic image according to claim 1, wherein the toner further comprises a releasing agent, and the releasing agent comprises carnauba wax.

12. The toner for forming an electrophotographic image according to claim 1, wherein the crystalline polyester resin (A) comprises an ester bond in a molecular main chain thereof represented by a general formula below:

$$[—OCO—R—COO—(CH_2)_n—]$$

where R represents a straight-chain unsaturated aliphatic dicarboxylic residue having 2 to 20 carbon atoms, and n represents an integer of 2 to 20.

13. The toner for forming an electrophotographic image according to claim 1, wherein the composite resin (D) is a composite resin comprising a polyester condensation polymerization resin unit and a vinyl resin addition polymerization unit.

14. The toner for forming an electrophotographic image according to claim 1, wherein the toner has at least one diffraction peak at 2θ=19° to 25° in an x-ray diffraction pattern by a powder x-ray diffraction apparatus.

15. The toner for forming an electrophotographic image according to claim 1, wherein the toner has a volume-average particle diameter of 4 μm to 10 μm.

16. A method for forming the toner of claim 1, comprising:

melt-kneading a toner material comprising said four binder resins; and cooling the melt-kneaded material, wherein the melt-kneaded material has a thickness of 2.5 mm or greater in the cooling.

17. An image forming method, comprising:

forming an electrostatic latent image, wherein the electrostatic latent image is formed on an electrostatic latent image bearing member;

developing, wherein a visible image is formed by developing the electrostatic latent image using a toner according to claim 1;

transferring, wherein the visible image is transferred to a recording medium; and fixing, wherein the transferred image transferred on the recording medium is fixed.

18. The image forming method according to claim 17, wherein the developing uses a developing unit which comprises:

a developer bearing member, which rotates while supporting on a surface thereof a two-component developer comprising a toner for forming an electrophotographic image and a magnetic carrier, and which supplies the toner to a latent image on a surface of a latent image bearing member at a location facing the latent image bearing member for development; and a developer supplying path equipped with a developer supplying and conveying member, which conveys the developer along an axial direction of the developer bearing member and supplies the developer to the developer bearing member;

wherein the developer which has passed the location facing the latent image bearing member is collected by developer paths, wherein the developer paths comprise a developer conveying member, are partitioned by a partition member from the developer supplying path at a center excluding at least both ends in a longitudinal direction and convey the developer along an axial direction of the developer bearing member, wherein the developing unit comprises:

the developer bearing member;

the developer supplying path equipped with the developer supplying and conveying member, which conveys the developer along an axial direction of the developer bearing member and supplies the developer to the developer bearing member;

a developer collecting path equipped with a developer collecting and conveying member, which conveys the developer collected from the developer bearing member after passing a location facing the latent image bearing member along an axial direction of the developer bearing member as well as in the same direction as the developer supplying and conveying member; and a developer stirring path, which is equipped with a developer stirring and conveying member and supplies the developer to the developer supplying path, wherein the developer stirring and conveying member is supplied with: an excess developer, which has been unused for developing and conveyed to a most downstream side of a conveying direction of the developer supplying path; and a collected developer, which has been collected from the developer bearing member and conveyed to a most downstream side of a conveying direction of the developer collecting path, and the developer stirring and conveying member conveys the developer in a direction opposite to the developer supplying and conveying member along an axial direction of the developer bearing member while stirring the excess developer and the collected developer;

wherein the three developer paths comprising the developer collecting path, the developer supplying path and the developer stirring path are respectively partitioned by the partition members, wherein the developer stirring path and the developer collecting path are allocated substantially at the same elevation, and wherein the developer supplying path is allocated at an elevation greater than the other two developer paths.

19. The image forming method according to claim 17, wherein the developing uses a developing unit which comprises:

a developer bearing member, which rotates while supporting on a surface thereof a two-component developer comprising a toner for forming an electrophotographic image and a magnetic carrier, and which supplies the toner to a latent image on a surface of a latent image bearing member at a location facing the latent image bearing member for development; and a developer supplying path equipped with a developer supplying and conveying member, which conveys the developer along an axial direction of the developer bearing member and supplies the developer to the developer bearing member;

wherein the developer which has passed the location facing the latent image bearing member is collected by developer paths, wherein the developer paths comprise a developer conveying member, are partitioned by a partition member from the developer supplying path at a center excluding at least both ends in a longitudinal direction and convey the developer along an axial direction of the developer bearing member, wherein the developing unit comprises:

the developer bearing member;

the developer supplying path equipped with the developer supplying and conveying member, which conveys the developer along an axial direction of the developer bearing member and supplies the developer to the developer bearing member; and a developer stirring path, which is equipped with a developer stirring and conveying member and supplies the developer to the developer supplying path, wherein the developer stirring and conveying member is supplied with an excess developer, which has been unused for developing and conveyed to a most downstream side of a conveying direction of the developer supplying path and the developer stirring and conveying member conveys the developer in a direction opposite to the developer supplying and conveying member while stirring the excess developer in an axial direction of the developer bearing member, wherein the developer supplying path and the developer stirring path are partitioned by the partition member at a center excluding at least both ends in a longitudinal direction, and wherein the developer which has passed the location facing the latent image bearing member is collected by a developer stirring path, is mixed with the developer conveyed in the developer stirring path and is then supplied to the developer supplying path.

20. The toner for forming an electrophotographic image according to claim 1, wherein crystalline polyester resin (A) is present in the toner in an amount of 1-15% by mass relative to the total mass of the toner and composite resin (D) is present in the toner in an amount of 3-20% by mass relative to the total mass of the toner.

* * * * *